US008286906B2

(12) United States Patent
Ripplinger

(10) Patent No.: US 8,286,906 B2
(45) **Date of Patent: *Oct. 16, 2012**

(54) CORRUGATED FLANGES FOR SPOOLS AND REELS

(75) Inventor: C. Robert Ripplinger, Millville, UT (US)

(73) Assignee: Sonoco Development, Inc., Hartsville, SC (US)

( * ) Notice: Subject to any disclaimer, the term of this patent is extended or adjusted under 35 U.S.C. 154(b) by 54 days.

This patent is subject to a terminal disclaimer.

(21) Appl. No.: 12/498,198

(22) Filed: Jul. 6, 2009

(65) Prior Publication Data

US 2009/0314877 A1 Dec. 24, 2009

Related U.S. Application Data

(60) Continuation of application No. 12/111,000, filed on Apr. 28, 2008, now Pat. No. 7,556,217, which is a continuation of application No. 11/095,754, filed on Mar. 31, 2005, now Pat. No. 7,364,113, which is a continuation of application No. 10/617,126, filed on Jul. 10, 2003, now Pat. No. 6,874,726, which is a continuation of application No. 09/774,389, filed on Jan. 29, 2001, now Pat. No. 6,598,825, which is a continuation-in-part of application No. 09/434,609, filed on Nov. 5, 1999, now Pat. No. 6,179,245, which is a division of application No. 09/023,318, filed on Feb. 13, 1998, now Pat. No. 6,003,807.

(51) Int. Cl.
*B65H 75/14* (2006.01)

(52) U.S. Cl. ..... 242/614.1; 242/118.4

(58) Field of Classification Search ..... 242/118.6, 242/118.61, 118.62, 118.7, 608.3, 613.4, 242/614, 614.1, 610.6, 608.4, 613.5, 118.4
See application file for complete search history.

(56) References Cited

U.S. PATENT DOCUMENTS 382,091 A 5/1888 Kelsea (Continued)

FOREIGN PATENT DOCUMENTS

FR 558182 6/1957

(Continued)

OTHER PUBLICATIONS

Beacon Reel Co. brochure, date unknown, received by Applicant at Interwire Trade Exposition, May 2001, Atlanta, GA.

(Continued)

*Primary Examiner* — William E Dondero
(74) *Attorney, Agent, or Firm* — Womble Carlyle Sandridge & Rice LLP

(57) ABSTRACT

A flange design providing improved strength, fracture resistance, and the like using corrugations extending substantially radially from an arbor aperture toward a rim portion. A spool or reel may include a tubular member to receive a stranded material wrapped therearound. A first flange comprising a core portion and an outer portion may secure to one end of the first flange engaging the tubular member. A second flange may secure to the other end of the tubular member. The core portion of a flange may comprise an arbor wall defining the perimeter of an arbor aperture. The arbor wall may be directly contacted and supported by a plurality of corrugations extending radially therefrom. The outer portion of a flange may contact the core portion and extending radially away therefrom to an outer edge to restrain the stranded material in an axial direction.

11 Claims, 27 Drawing Sheets

U.S. PATENT DOCUMENTS

| | | | | | |
|---|---|---|---|---|---|
| 391,456 | A | | 10/1888 | Cross | |
| 671,446 | A | | 4/1901 | Lorscheider | |
| 773,218 | A | | 10/1904 | Mossberg | |
| 1,270,614 | A | | 6/1918 | Harmon | |
| 1,380,671 | A | | 6/1921 | Mossberg | |
| 1,410,014 | A | | 3/1922 | Hurlburt | |
| 1,448,355 | A | | 3/1923 | Bowen | |
| 1,566,788 | A | | 12/1925 | Clark | |
| 1,613,925 | A | | 1/1927 | Boykin | |
| 1,675,507 | A | | 6/1928 | Mossberg | |
| 1,811,517 | A | | 6/1931 | Mossberg | |
| 1,891,709 | A | | 12/1932 | Hescock | |
| 1,911,427 | A | | 5/1933 | Bureau | |
| 2,059,709 | A | | 11/1936 | Rueger | |
| 2,089,787 | A | | 8/1937 | Goldberg | |
| 2,156,363 | A | | 5/1939 | Tucker, Jr. | |
| 2,193,158 | A | | 3/1940 | Bezanson | |
| 2,547,574 | A | | 11/1951 | Gazet | |
| 2,574,845 | A | | 11/1951 | Schaeffer | |
| 2,626,764 | A | | 1/1953 | Dunlap | |
| 2,643,830 | A | | 6/1953 | Paeplow et al. | |
| 2,911,163 | A | | 11/1959 | Warrick | |
| 2,928,623 | A | | 3/1960 | Mayhew | |
| 3,099,414 | A | * | 7/1963 | Kuika | 242/614 |
| 3,108,758 | A | | 10/1963 | Hill | |
| 3,235,203 | A | * | 2/1966 | Antliff | 242/608.4 |
| 3,284,021 | A | | 11/1966 | Ryll et al. | |
| 3,323,743 | A | | 6/1967 | Landgraf | |
| 3,501,110 | A | | 3/1970 | Hopgood et al. | |
| 3,552,677 | A | | 1/1971 | Hacker | |
| 3,565,363 | A | | 2/1971 | Mizuguchi | |
| 3,591,104 | A | | 7/1971 | Hafner | |
| 3,757,626 | A | | 9/1973 | Kulp | |
| 3,817,475 | A | | 6/1974 | Goldstein | |
| 3,854,509 | A | | 12/1974 | Bailey | |
| 3,861,606 | A | | 1/1975 | Loquineau et al. | |
| 3,966,139 | A | | 6/1976 | Terpak | |
| 4,128,215 | A | | 12/1978 | Underwood | |
| 4,184,650 | A | | 1/1980 | Nelson et al. | |
| 4,244,535 | A | | 1/1981 | Moodie | |
| 4,252,587 | A | | 2/1981 | Harden et al. | |
| 4,345,724 | A | | 8/1982 | Lindell | |
| 4,412,661 | A | | 11/1983 | Wise et al. | |
| 4,512,361 | A | | 4/1985 | Tisbo et al. | |
| 4,512,532 | A | | 4/1985 | Dittrich | |
| D281,482 | S | | 11/1985 | Suzuki | |
| 4,561,607 | A | | 12/1985 | Vagan | |
| 4,620,676 | A | | 11/1986 | Missalla | |
| 4,624,421 | A | | 11/1986 | Takeuchi | |
| RE32,510 | E | | 9/1987 | Tisbo et al. | |
| 4,726,534 | A | | 2/1988 | Chenoweth | |
| 4,895,316 | A | | 1/1990 | Salloum | |
| 4,903,913 | A | | 2/1990 | McCaffrey | |
| 4,976,475 | A | | 12/1990 | Bjorkqvist | |
| 4,997,142 | A | | 3/1991 | Grant | |
| 5,106,031 | A | | 4/1992 | Sanda et al. | |
| 5,137,204 | A | | 8/1992 | Compagnucci | |
| 5,143,316 | A | | 9/1992 | Goetz et al. | |
| 5,197,689 | A | | 3/1993 | Barone | |
| 5,203,516 | A | | 4/1993 | Donaldson | |
| 5,236,145 | A | | 8/1993 | Floury et al. | |
| 5,252,369 | A | | 10/1993 | Akao et al. | |
| 5,265,821 | A | | 11/1993 | Takatori | |
| 5,379,965 | A | * | 1/1995 | Isler et al. | 242/586.6 |
| 5,464,171 | A | * | 11/1995 | Ripplinger | 242/609.1 |
| 5,474,254 | A | | 12/1995 | Faulkner | |
| 5,605,305 | A | | 2/1997 | Picton | |
| 5,660,354 | A | | 8/1997 | Ripplinger | |
| 5,897,075 | A | | 4/1999 | Elder et al. | |
| 6,003,807 | A | | 12/1999 | Ripplinger | |
| 6,179,245 | B1 | | 1/2001 | Ripplinger | |
| 6,234,421 | B1 | | 5/2001 | Cox et al. | |
| 6,398,154 | B1 | | 6/2002 | Cox et al. | |
| 6,450,441 | B2 | | 9/2002 | Ripplinger | |
| 6,598,825 | B2 | * | 7/2003 | Ripplinger | 242/608.3 |
| 6,874,726 | B2 | * | 4/2005 | Ripplinger | 242/610.6 |
| 6,991,197 | B2 | | 1/2006 | Cox et al. | |
| 7,364,113 | B2 | | 4/2008 | Ripplinger | |
| 7,556,217 | B2 | | 7/2009 | Ripplinger | |
| 2009/0314877 | A1 | | 12/2009 | Ripplinger | |

FOREIGN PATENT DOCUMENTS

| | | |
|---|---|---|
| FR | 2573739 | 5/1986 |
| GB | 1006495 | 10/1965 |
| WO | WO 02/47875 | 6/2002 |

OTHER PUBLICATIONS

Sonoco Crellin brochure, date unknown, received by Applicant at Interwire Trade Exposition, May 2001, Atlanta, GA.

Sonoco Crellin brochures, pp. 1-29, date unknown, received by Applicant at Interwire Trade Exposition, May 2001, Atlanta, GA.

GMP-Genpak brochures, pp. 1-7, date unknown, received by Applicant at Interwire Trade Exposition, May 2001, Atlanta, GA.

Reel Core brochures, pp. 1-8, date unknown, received by Applicant at Interwire Trade Exposition, May 2001, Atlanta, GA.

Enviroreel brochures, pp. 1-14, date unknown, received by Applicant at Interwire Trade Exposition, May 2001, Atlanta, GA.

The Re-Wood Co brochure, date unknown, received by Applicant at Interwire Trade Exposition, May 2001, Atlanta, GA.

Reel Options brochure, date unknown, received by Applicant at Interwire Trade Exposition, May 2001, Atlanta, GA.

Mossberg Industries, Inc. brochures, pp. 1-9, date unknown, received by Applicant at Interwire Trade Exposition, May 2001, Atlanta, GA.

The George Evans Corp. brochure, date unknown, received by Applicant at Interwire Trade Exposition, May 2001, Atlanta, GA.

Pittsfield Plastics Engineering, Inc. brochures, pp. 1-8, date unknown, received by Applicant at Interwire Trade Exposition, May 2001, Atlanta, GA.

Pittsfield Plastics Engineering, Inc. brochure, date unknown, received by Applicant at Interwire Trade Exposition, May 2001, Atlanta, GA.

Madem brochure, date unknown, received by Applicant at Interwire Trade Exposition, May 2001, Atlanta, GA.

R-2 Systems brochures, pp. 1-11, date unknown, received by Applicant at Interwire Trade Exposition, May 2001, Atlanta, GA.

Woodland Container Corp. brochure, date unknown, received by Applicant at Interwire Trade Exposition, May 2001, Atlanta, GA.

P & R Specialty brochure, pp. 1-4, date unknown, received by Applicant at Interwire Trade Exposition, May 2001, Atlanta, GA.

Carris Coilpack brochure, date unknown, received by Applicant at Interwire Trade Exposition, May 2001, Atlanta, GA.

Table of contents and Advertisements of the Directory of Wire Companies of North America, 1991 Edition, for Carris Reels, Inc. and the Bridge Mfg. Co., Inc., Sonoco Products Co., Carlton Manufacturing Co., Crellin, Inc. and Mossberg Industries, Inc. (6 pages) published by Business Information Services, Inc.

* cited by examiner

CORRUGATED FLANGES FOR SPOOLS AND REELS

RELATED APPLICATIONS

This patent application is a continuation of co-pending U.S. patent application Ser. No. 12/111,000 filed Apr. 28, 2008 (which will issue as U.S. Pat. No. 7,556,217 on Jul. 7, 2009), which is a continuation of U.S. patent application Ser. No. 11/095,754, filed on Mar. 31, 2005 (now U.S. Pat. No. 7,364,113, issued Apr. 29, 2008), which is a continuation of U.S. patent application Ser. No. 10/617,126, filed on Jul. 10, 2003 (now U.S. Pat. No. 6,874,726, issued Apr. 5, 2005), which is a continuation of U.S. patent application Ser. No. 09/774,389, filed Jan. 29, 2001 (now U.S. Pat. No. 6,598,825, issued Jul. 29, 2003), which is a continuation-in-part of U.S. patent application Ser. No. 09/434,609, filed Nov. 5, 1999 (now U.S. Pat. No. 6,179,245, issued Jan. 30, 2001), which is a division of U.S. patent application Ser. No. 09/023,318, filed Feb. 13, 1998 (now U.S. Pat. No. 6,003,807, issued Dec. 21, 1999).

BACKGROUND

1. The Field of the Invention

This invention relates to spools and reels for receiving stranded materials, and, more particularly, to novel systems and methods for producing plastic flanges for reels and spools as take-up of electrical wire during manufacture.

2. The Background Art

Spools and reels have suffered from a lack of intelligent application of technology for many years. Spools date back hundreds if not thousands of years. Wooden spools and reels have been used in the textile industry as well as various electrical industries for many years with almost no innovation in their structures. Some use of plastic materials began a few decades ago. Nevertheless, manufacturing techniques continue to fall short of implementing all of the principles of engineering that are available.

Manufacturing techniques tend to focus on the simplicity of manufacture, and the simplicity of design, rather than the optimization of strength, weight, stiffness, non-catastrophic failure modes, and the like. Some of these latter considerations have been found to be significant in the manufacture and use of plastic spools and reels. Accordingly, developments by Applicant have provided improved methods for providing spools and reels having substantially reduced weight with improved stiffness and cost. Moreover, failure modes are available to provide "graceful degradation" of performance rather than catastrophic failure of spools and reels in situations such as the dropping of loaded reels or spools.

Spools and reels are used in many industries. However, in the wire and cable industry, the comparative weight of stranded material on a reel or spoon is greater than others of similar size in other industries. Fracture of flanges near an outer diameter thereof is common if dropped. Likewise, due to the conventional shapes of central tubes (hubs, cores, etc.), the junctions with flanges are not inherently resistant to fracture from impact loads caused by dropping. Dropping from a working bench is common for reels and spools. Manufacturing processes for manufacturing reels and spools, as well as manufacturing processes for wire and other stranded materials, typically compels smooth circumferential edges at the outermost diameter of a flange. Accordingly, a spool not retained on an arbor during use (using the wire, rather than manufacturing and taking up the wire) may roll easily across any flat surface. Thus, while a spool or reel is considered tare weight in shipping wire and cable, and a disposable item whose cost is to be minimized a spool or reel must function reliably and durably during its entire useful life.

Otherwise, a substantial length of stranded material may be damaged beyond use. The material held on a spool or reel having a value of a few dollars may itself have a value of one thousand times the cost of a spool. A value two orders of magnitude greater than that of the spool is routine for wire of common usage.

3. State of the Art

Stranded materials, upon manufacture, are typically taken up directly onto a reel or spool. The take-up spool or reel receives the strand directly from the last step in the manufacturing process. Thereafter, the filled spool is effective for storage and handling purposes. Upon sale or distribution, the spool is often placed on an arbor, either alone or with other spools, for convenient dispensing of the linear or stranded material. Linear or stranded materials include electrical wire whether in single or multiple strands and cable (comprising multiple wires), rope, wire rope, hose, tubing, chain and plastic and rubber profile material (generally any polymeric or elastomeric extruded flexible material).

In general, a host of elongate materials as diverse as pharmaceutical unit dose packages, fiberoptic line and log chains are stored on spools. Likewise, ribbon, thread and other stranded materials are wrapped on spools.

The requirement for a spool in the manufacture and handling of wire is substantially different from spools in the textile industry. For example, the weight of wire is several times the weight of thread or rope. The bulk of wire, which translates to the inverse of density, is substantially lower for wire than for hose, tubing or even chain.

Meanwhile, most spools are typically launched on a one way trip. The collection and recycling of spools is hardly worth the effort, considering that their materials are not easily recyclable.

In the art, a typical spool has a tube portion extending between two flange portions positioned at either end of the tube portion. A spool may have a rounded rim or rolled edge at the outermost diameter. This rim serves structural as well as aesthetic and safety purposes. Spools may be manufactured in a variety of tube lengths. Each flange is fitted by some fixturing to one end of the tube and there retained. Details of spools are contained in the U.S. Pat. No. 5,464,171 directed to a mating spool assembly for relieving stress concentrations, incorporated herein by reference.

The impact load of a spool of wire dropping from a bench or other work surface to a floor in a manufacturing environment is sufficient to fracture the spool in any of several places. Fracture may damage wire, preclude removal, or release the wire in a tangled, useless mass.

Spools may break at the corner where the tube portion meets the flange portion or may fracture at an engagement portion along the tube portion. Spools may break near the corner between the flange and the tube portion where a joint bonds or otherwise connects the tube portion to the flange portion.

Spools and reels experience significant breakage during drop tests when manufactured in styrene or styrene-based plastics such as ABS. Polyolefins are very tough materials. Tough means that a material can tolerate a relatively large amount of straining or stretching before rupture. By contrast, a material which is not tough will usually fracture rather than stretch extensively. As a result, when a reel of wire is dropped, the energy of impact breaks the spool.

Polyolefins, by contrast, may actually be drawn past yielding into their plastic elongation region on a stress-strain chart. Polyolefins thus elongate a substantial distance. The result is that olefinic plastics will absorb a tremendous amount of energy locally without rupture. Thus, the wire on a spool which has been dropped does not become a tangled mat of loops.

Given their toughness, olefinic parts will bend, strain, distort, but usually not break. Nevertheless, olefinic plastics are not typical in the art of wire spools. Polyolefin parts are not bonded into multi-piece spools. However, lack of a solvent is one problem, lack of a durable adhesive is another. Therefore, any spool would have to be manufactured as unit of a specific size. The inventory management problem created by unique spools of various sizes is untenable, although the cost of some olefinic resins is lower than that of styrene-based resins.

Moreover, the cycle time of molds directly related to material properties is usually much faster for styrene-based resins. The designs available use wall thicknesses which result in warpage as well. All these factors, as well as others, combine to leave olefinic resins, and bonded parts made therefrom, largely unused in the spool industry.

In drop tests, a spool may be dropped axially, radially or canted off-axis. In a radial drop, spools that break typically fail near the middle of the length of the tube. In axial drops, flanges may separate from tubes in failed spools. In an off-axis drop, flanges typically fracture, and may separate from tubes, releasing wire.

Large spools are typically called reels in the wire industry. Heavy-duty reels of 12 inches in diameter and greater (6 feet and 8 feet are common) are often made of wood or metal. Plastic spools of 12-inch diameter and greater are rare and tend to be very complex. The rationale is simple. Inexpensive plastics are not sufficiently strong or tough to tolerate even ordinary use with such a large mass of wire or cable wrapped around the spool.

Moreover, large flanges for reels are very difficult to manufacture. Likewise, the additional manufacturing cost of large spools is problematic. High speed molding requires quick removal after a short cycle time. Flanges are typically manufactured to have very thick walls. Increased thicknesses directly lengthen cycle times. Thus, designs do not scale up. Therefore, the flanges have very slow cooling times and molding machines have low productivity in producing them.

Styrene plastic is degraded by recycling. That is, once styrene has been injection molded, the mechanical properties of the resulting plastic are degraded. Thus, if a spool is recycled, ground up into chunks or beads and re-extruded as part of another batch, the degradation in quality can be substantial. Olefinic plastics improve over styrene-based plastics in that olefinic plastics can be completely recyclable. The mechanical properties of an olefinic plastic are virtually identical for reground stock as for virgin stock.

In reels, a 12-inch diameter unit is instructive. Such a spool is usually manufactured of wood. Nevertheless, a plastic spool in 12-inch diameter may also be manufactured with a pair of plastic flanges holding a layered cardboard (paperboard) tube detained therebetween. The flanges are typically bolted together axially to hold the tube within or without a circumferential detent as with wooden reels.

The reels have an additional difficulty when they are dropped during use. The flanges do not stay secured. The flange and tube are often precarious wooden assemblies held together by three or more axial bolts compressing the flanges together. The tube is prone to slip with respect to the flanges, breaking, tilting or otherwise losing its integrity under excessive loads. Such loads result from the impact of dropping onto a floor from a bench height or less. For the largest reels, rolling over or into obstacles or from decks during handling is more likely to be the cause of damage.

Very large cables, having an outside diameter up to several inches is taken up during manufacturing on a very large reel, from two feet to eight feet in diameter. The current state of the art dictates wooden reels comprised of flanges capturing a barrel-like tube of longitudinal slats therebetween. The two flanges are held together by a plurality of long bolts extending therethrough.

Wooden reels are not typically recyclable. A splinter or blemish in a reel can damage insulation on new cable or wire wrapped therearound at the manufacturing plant. Damaged insulation destroys much of the value of a reel of cable or wire. That is, the wire must be spliced, or may have damage extending over several wrapped layers of wire. Splices segmenting the original length of wire wrapped on the reel add costs in labor, reliability, service and the like.

Wood cannot be recycled and reconstructed cost effectively. In addition, the plurality of bolts and nails must be removed with other related metal hardware. The reels do not effectively burn without the labor investment of this dismantling operation.

Also, a wooden reel that is slightly out of adjustment, damaged, or broken, is problematic. A broken reel leaves a large area splintered to damage wire insulation. A reel which is loose will tilt and twist as the slats shift with respect to the flanges.

Steel reels tend to be more frequently recyclable. However, each must be returned in its original form to be reused. Thus, the bulk of transfer is as large as the bulk of original shipment, although the weight is less. Also, steel is heavy, subject to damage by the environment such as by stains, rust, peeling of paint, denting, accumulation of coatings or creation of small burrs on surfaces and corners. For example, when a reel is rolled over a hard surface, sharp objects, grit or rocks tend to raise small burrs on the outer edge of the flange. Similarly, contact with any sharp or hard object can raise burrs on the inside surfaces of the flanges.

As with wooden reels, only to a greater extent, a burr on a steel reel tends to act like a knife, slicing through insulation and ruining wire. Perhaps the most difficult aspect of burrs is that they are hardly detectable at sizes which are nevertheless highly damaging to insulation. Of course the weight and cost of steel reels is another factor in the difficulty of employing them for delivery of cable.

What is needed is a design for large (12 inches greater diameters) and small diameter (typically 6½-inch outside diameter) plastic spool flanges, which can tolerate the energy of being dropped when fully wrapped with wire. In addition, even in the standard styrene-based plastic spools, a better design is desired. What is needed in large reels of from a foot to eight feet approximately in outside flange diameter is a reel which is dimensionally stable, maintains structural integrity in service and during accidental dropping, which will not fracture or separate at a flange if it is dropped, and which is economically recyclable.

In a large reel, on the order of two to eight feet in diameter, what is needed is a lightweight, high-strength reel. The reel should not tend to damage wire when scratched, gouged, or otherwise having a burr raised on any key surface. Similarly, a large reel should be resilient enough that it does not maintain a permanent set, such as a steel reel will, when damaged. A plastic reel should be formed in a design that resists fracture and of a material which is tough. The material should be flexible enough that a burr will not damage insulation. A large reel should be recyclable. Recycling is most efficient if a reel can be reground near the site of use. Empty reels are more voluminous than they are heavy.

Moreover a design is needed that provides improved toughness by virtue of design, regardless of the toughness of the material. Catastrophic failure of reels and spools limits their applicability within the wire and cable industry. The risk of losing the use of the stranded material held thereon is not to be risked for the cost of using plastic spools and reels.

BRIEF SUMMARY AND OBJECTS OF THE INVENTION

In view of the foregoing, it is a primary object of the present invention to provide spools and reels and a method of designing them that will optimize strength, stiffness, fracture, distortion, toughness, and so forth at various locations within the flanges for survival of drop tests.

It is an object of the invention to provide various flange designs that can absorb shock or impact loads without completely fracturing.

It is an object of the invention to provide a design of, and method for designing, flanges of spools and reels having controlled fracture and controlled distortion in order to optimize survival of flanges and the integrity of the flange-to-tube transitions in configurations of spools having minimum weight and highest produceability in molding outputs.

It is an object of the invention to provide selective distortion, stiffness, and fracture of a flange in order to protect the integrity of a core or hub region of the flange.

It is an object of the invention to provide an eccentric application of impact loads transmitted from a rim toward a core region of a flange connecting to a tube portion, whether the tube is initially formed integrally or separately from the flange.

It is an object of the invention to provide multiple regions within the web of a flange, with the regions adapted to provide differing material properties, including different sections, moments of inertia, stiffness, strength, toughness, fracture-resistance, fracture-susceptibility, and the like.

It is an object of the invention to provide increased stiffness in the web while employing thinner walls, yet such that impact loads will not separate a rim and web from a core region of a flange, but maintain mechanical integrity of the flange especially in the tube transition region.

The invention solves this multiplicity of problems with flanges for plastic spools and reels formed in a multi-piece structure preferably by molding from olefinic, ABS, styrenic, and other plastics. Some of the designs may be made tough, even when manufactured of styrene-based plastics. The designs are particularly well adapted to manufacture using molded polyethylene and polypropylene or similar olefinic plastics regardless of tube (core) retention methods.

The structures and methods of the invention apply to spools and reels of all sizes. However, a structure that can be injection molded in a 6½-inch flange diameter may have to be roto-molded (tumble-molded) to produce an eight foot diameter spool or reel. Consistent with the foregoing objects, and in accordance with the invention as embodied and broadly described herein, an apparatus and method are disclosed, in suitable detail to enable one of ordinary skill in the art to make and use the invention.

In one presently preferred embodiment of an apparatus in accordance with the invention, a central tube or core section may be disposed between two flanges. Construction of the core and flange joints may be done in accordance with various approaches known in the art, as well as those articulated in U.S. Pat. No. 5,464,171, incorporated herein by reference.

Nevertheless, a tube may be completely hollow, ribbed or corrugated, itself. Alternatively, tubes may be arranged to fit within cavities formed in flanges, or to fit outside a sleeve protruding inwardly from a flange, or both at once. In certain embodiments, a flange and tube may be molded in a single piece with a mating tube and associated flange being molded in another piece. The two pieces may then be bonded together by a suitable means to provide a complete spool or reel.

Hybrid spools and reels may be formed using different materials for flanges than for tubes (cores). In other embodiments, a single material may be used for both flanges and tubes assembled from two or more parts. In one presently preferred embodiment, a cardboard tube may be adapted to fit over sleeves protruding from integrally formed flanges extending therefrom.

In one embodiment, flanges may be corrugated to provide a multiplicity of beneficial features. Thickness of walls, more complete closure of cavities (on all sides but one, for example), selective fracture resistance and fracture susceptibility, stiffness, strength, rigidity, a moment of inertia, a section, and so forth may be affected.

Corrugations may be arranged in a spoke-like configuration extending radially from a core or a hub portion of a flange. Alternatively, corrugations may extend radially at uniform or non-uniform circumferential angles. Corrugations may extend circumferentially between orthogonal surfaces thereto or surfaces non-orthogonal thereto in order to optimize weight, strength, stiffness, toughness, and other significant functionality.

Corrugations may terminate in selective angles with respect to tangents to the hub (core) portion, and at different selected angles with respect to tangents to a rim or outer circumference of a flange. Moreover, an angle of sweep measured between a tangent of a corrugation edge proximate a core and such an angle measured proximate a rim may differ by any suitable number of degrees. Accordingly, corrugations may be formed to direct loads radially between a hub and rim portion of a flange.

Alternatively, corrugations may be arranged to preclude direct transfer of loads normal to any tangents to a hub, rim, or both. Loads may include compression, tension, shear, bending, and so forth. Corrugation surfaces may be designed to provide a selected strength, stiffness, and toughness at any location within a flange. Corrugations may provide axial loading to retain stranded material, even after substantial damage to a flange. Moreover, the balance between strength, stiffness, and toughness may be designed specifically to be different at different locations within a flange. Accordingly, flanges may be designed specifically to address loading caused by different types of falls, a major source of damage in use.

Eccentric and tangential interception of corrugations by a hub of a flange may be designed to promote absorption of energy of an impact, by distortion, selective fracture, or by rigid survival. However, in certain embodiments, portions of a flange may be designed to fail to a selected extent in a selected region in order to protect other portions of the flange that would result in more costly damage if allowed to fracture.

Thus, for example, outer portions of a flange may be permitted to crush, bend, break, and so forth in order absorb certain loads. The rim having greater circumference, more material may be naturally provided for absorbing such damage. Meanwhile, a hub may be configured to minimize damage, since a hub may be substantially smaller than a rim (outer diameter or outermost portion) of a flange. In one presently preferred embodiment, bending loads may selectively fracture corrugation walls on one axial side, while transferring loads away to other areas. This re-distribution may reduce fractured circumference at the core, maintaining integrity while permitting fracturing of adequate length to absorb shock loads.

Even near a hub, geometries of flanges may promote selective fracture. For example, selected portions of corrugations may be designed to have thicknesses, angles, and loads calculated to cause a fracture of a limited length and direction. Other nearby locations may be configured with geometries, materials, thicknesses, and so forth to virtually preclude fracture in a similar circumstance. Both features, one susceptible to ready fracture at a known location, and one resistant to expected fracture at a nearby location may provide selective fracture for absorption of energy without catastrophic failure. Catastrophic failure may be regarded as a failure that is likely to destroy the contents of a spool or reel, render it otherwise useless due to increased effort to retrieve, or create an impossibility or difficulty of supporting and retrieving stranded materials, and the like.

In other embodiments, circumferential corrugations may be used. Moreover, angled or curved corrugations may be used in combination with one another, or circumferential corrugations, or with surfaces of various configurations in order to optimize fracture toughness, strength, stiffness, etc. In one embodiment, a flange may be subdivided radially to provide portions having greater or lesser resistance to fracture or energy absorption. Corrugations may have axial depth. Axial depth may be constant or variable in a radial, axial, or circumferential direction. Nevertheless, molding considerations may provide or benefit from certain uniformities.

Inner surfaces of flanges, those surfaces in contact with the stranded materials stored thereon, may be smooth or corrugated. Accordingly, distances across corrugations may be uniform or non-uniform in a radial, circumferential, or axial direction. Moreover, a directorix may be defined for each corrugation, and even each surface extending in a more-or-less radial direction. Thus, adjacent surfaces or directrices defining surfaces extending radially but connected circumferentially by orthogonal or other surfaces, may have different angles, and may be angled, curved, both, or alternating.

As a practical matter, inner surfaces or interior surfaces of a spool may desirably be designed to extend circumferentially a greater portion of circumference of a flange at any given radius. Thus, the inner, clear span of a stranded material between axial support surfaces will be a relatively lesser fraction of the overall circumference at any radius. Nevertheless, multiple corrugations having sufficiently high frequency to provide short clear spans may obviate any necessity for non-uniformity in a circumferential expanse of any corrugation on an inner or outer surface of a flange. Likewise, surface liners, such as a paperboard, or re-ground plastics, and other inexpensive materials may be installed during manufacture, or after manufacture, to separate wire or other stranded materials from touching an interior flange surface or from tending to escape axially into corrugations corresponding to exterior flange surfaces.

Various alternative embodiments of corrugated spools and reels may be fabricated to have corrugations in various shapes, orientations, and locations. For example, corrugated core regions associated with the portion of a flange within an outer diameter of a connecting tube may be corrugated in various configurations, just as the outer portion of the flange may be corrugated in various configurations.

The core and outer portion of a flange need not be corrugated in the same manner, the same pattern, the same direction, or with any other similar orientation. Moreover, the core and the outer portion of a reel may be made as separate pieces, and secured together with the same fastener that secures the intervening or connecting tube in place. Alternatively, a different fastener may hold the core and outer portion together, while a tube fastener holds the flange to the tube.

In selected embodiments, a core may not require corrugations, but may have apertures to accommodate the two prongs of tools or a tool such as a stapler. A true stapler has an active prong comprising the head, which delivers the staple, and an inactive or anvil prong, for receiving the staple and bending the ends thereof.

The apertures allow access to a tube by a two-prong or double prong tool (e.g. stapler), and to the portions of a reel flange designed to hold the tube. Access may be provided by an aperture and a recess (part of a corrugation) or by a pair of corrugations located radially inside and radially outside of the tube.

In selected embodiments, cross-sections may be defined to run radially, and thus vary in circumferential dimension along a radius. Cross-sections may be rectangular, trapezoidal, sinusoidal, or of any variety, provided in any other corrugated system. Alternatively, corrugations may be disposed to run with cross-sections normal to a circumferential direction. That is, a corrugation may extend with its own longitudinal direction lying along a circumferential path about a flange, that is, wherein a cavity of a corrugation cross-section appears in the radially and axially extending plane with respect to the flange.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 12 is a schematic axial view of a flange in accordance with the invention having corrugations of different core angels;

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the apparatus and methods of the present invention is not intended to limit the scope thereof. Rather, the scope of the invention is as broad as claimed herein. The illustrations merely represent certain, presently preferred embodiments of the invention. Embodiments of the invention will be best understood by reference to the drawings, wherein like parts are designated by like numerals throughout.

Those of ordinary skill in the art will, of course, appreciate that various modifications to the details of the apparatus and methods illustrated in the Figures may easily be made without departing from the essential characteristics of the invention. Thus, the following description of the Figures is by way of example, and not limitation, and simply illustrates certain presently preferred embodiments consistent with the invention as claimed.

Figure 1:
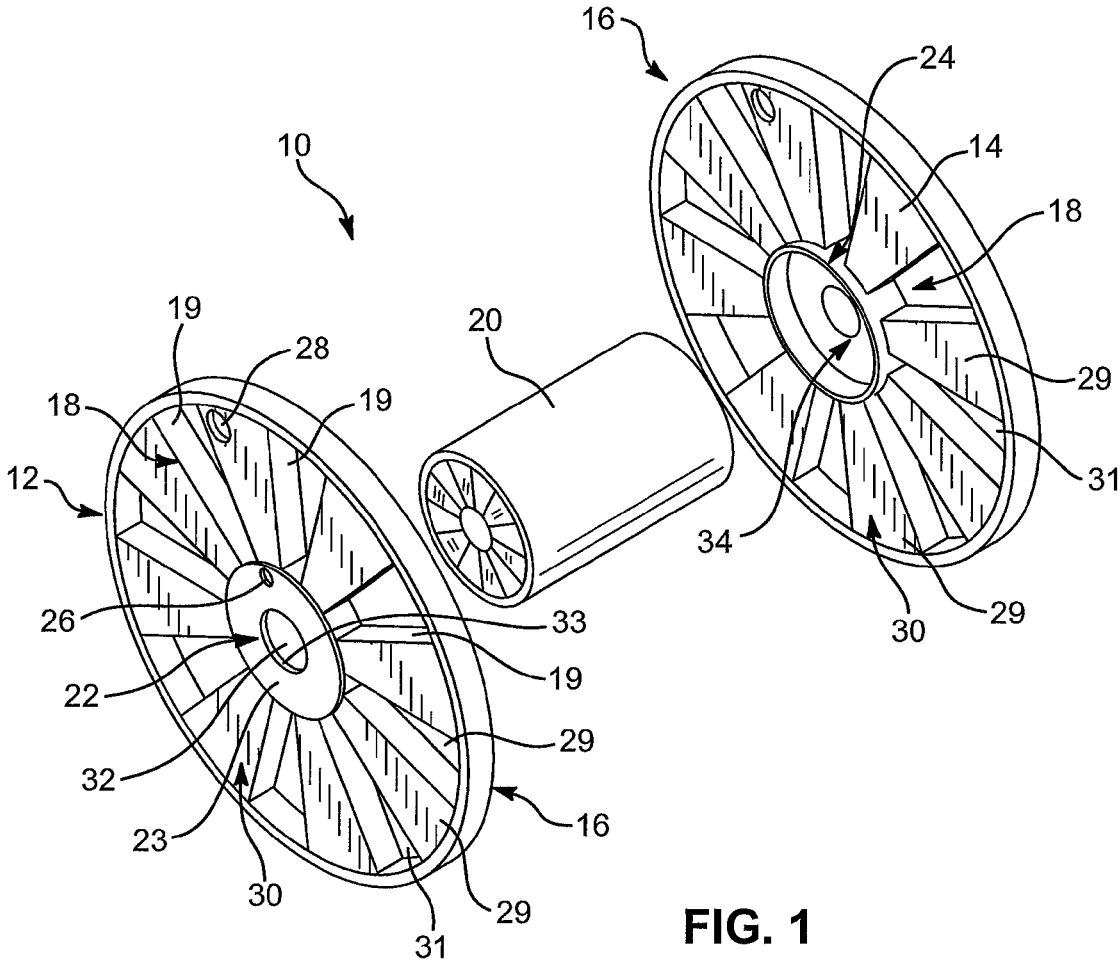
FIG. 1 is a perspective, exploded view of one embodiment of a spool made in accordance with the invention.

Referring to FIG. 1, an apparatus 10 may be referred to as a spool 10 or reel 10. The apparatus 10 may include flanges 12, 14, each being provided with a rim 16 and web 18. The web 18 may extend continuously or discontinuously in a radial, circumferential, axial, or all such, or any combination of such directions. The web 18 extends, whether continuously or periodically (e.g. perforated, spoked, etc.), between a region proximate a tube 20 and the rim 16 near an outermost circumference of a flange 12. In speaking of flanges 12, 14, in general, a single flange 12 may be referred to, and may be interpreted as including features that may be included in all flanges 12, 14, but need not be necessarily inputted thereto in all embodiments.

The web 18 extends between the rim 16 and a core 22 or hub 22 near the tube 20 and intended to engage the tube 20 in certain presently preferred embodiments. In other embodiments, the tube 20 may be formed in parts integrated with respected flanges 12, 14, and bonded or otherwise fastened to form the tube 20 as an integrated portion of a single-piece spool.

As a practical matter, a cap 23 may be positioned as part of the core 22 or applied thereto in order to seal, space, or otherwise serve the flange 12. For example, the cap 23 may be a portion of the external portion of the core 22. Meanwhile, an interior portion 24 of a core 22 may be tubular in nature, and may include multiple tubes or sleeves for capturing or otherwise engaging the tube 20 extending between the flanges 12,14.

The cap 23 may be provided in order to provide an aperture 26 for receiving a driver or dog from a machine on which the apparatus 10 may rotate. Other apertures 27, 28 may be used for other functions such as starting and tying, respectively, the stranded material (e.g. wire) wrapped about the tube 20 between the flanges 12,14.

Each flange 12,14 may be provided with corrugations 30. Corrugations 30 may be configured to have cavities 31 on opposite, alternating sides of each respective flange 12,14. The alternating nature of the cavity 31 and the surfaces 29 is somewhat arbitrary. That is, when viewing a flange 12,14 from one side, (e.g. axially speaking) the raised portion may be thought of as a surface 29 and the depressed portion may be thought of as a cavity 31, not withstanding each cavity 31 is defined by a surface 29.

An arbor aperture 32 may be sized to rotate freely and support the apparatus 10 on an arbor during delivery from, or wrapping of the contained, stranded material thereon. The arbor aperture 32 may have a surface 33 operating as an arbor bearing 33 for supporting the weight of the apparatus 10 while accommodating friction, wear, and other structural requirements.

A cavity 34 may be provided as part of the inside portion 24 of a core. Inside refers to the location seen from the same side of a flange 12, 14 as the stranded material would occupy. The cavity 34 may receive the tube 20. Alternatively, a cavity 34 may be corrugated, ribbed, or otherwise filled. In one embodiment, the cavity 34 may be irrelevant. In such an embodiment, a rim 20 may be designed to extend over an outermost diameter of the core 22, and more particularly an inside portion 24 of a core 22. As noted, the cavity 34 may simply be an extension of a tube 20 made in two parts, each part integrally formed with its respective flange 12, 14.

Figure 2:
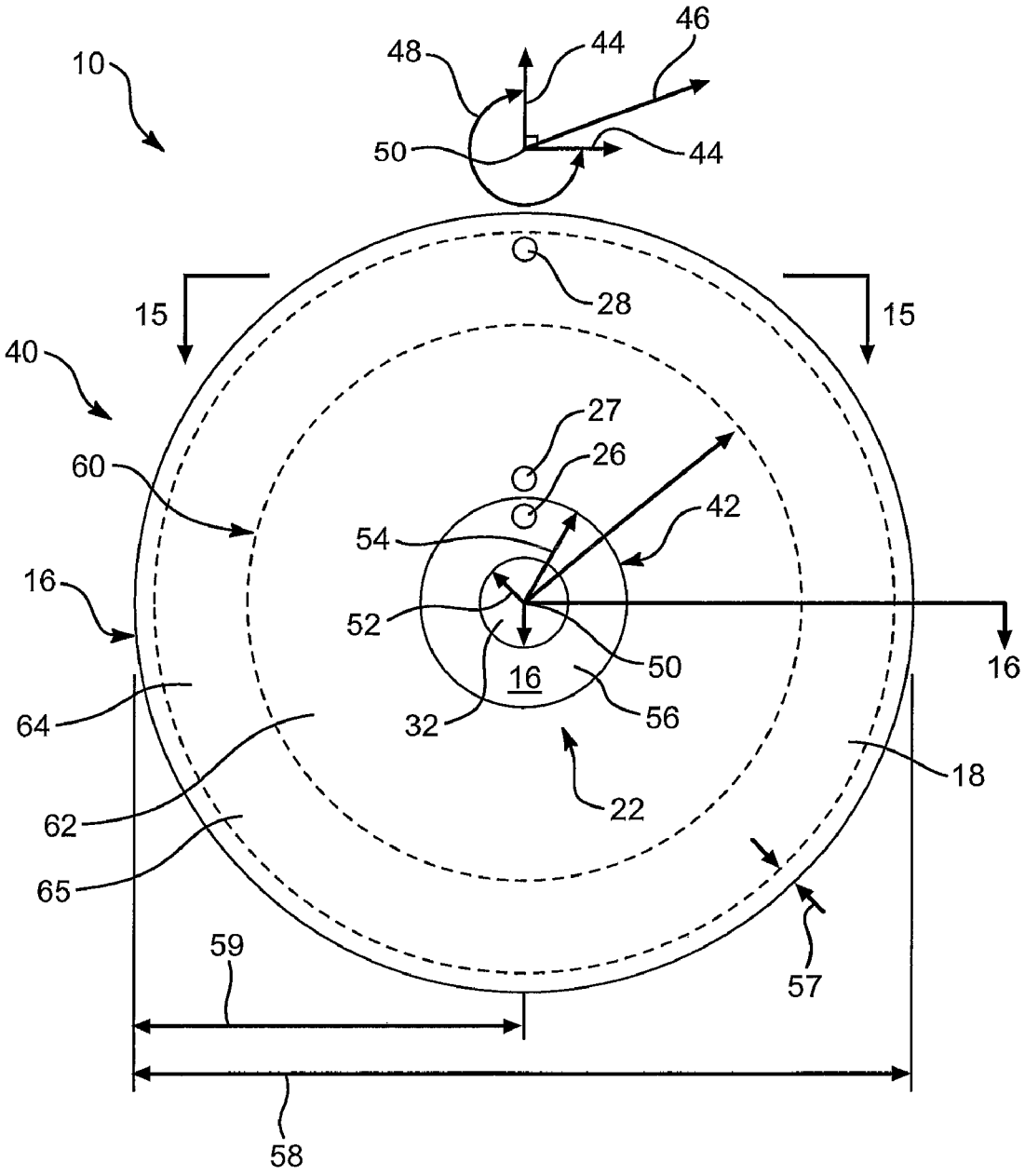
FIG. 2 is a schematic end elevation view of a geometry for defining features of reels and spools made in accordance with the invention.

Referring to FIG. 2, and to FIGS. 1-16 generally, an apparatus 10 may include flanges 12,14 in which the web 18 extends in a variety of shapes between a rim 16 and a core 22. In general, the direction of a specific corrugation 30 may extend in any of the directions available. Corrugations 30 may be shaped to appear like spokes 38, although the specific functionality may be substantially different.

For example, viewing the flange portion 10 of an apparatus 10 in FIG. 2, the core portion 22 may be surrounded by the web 18 extending in a radial direction 44, having a thickness in an axial direction 46 at any location, and extending circumferentially 48 or in a circumferential direction 48. The directions radially 44, axially 46, and circumferentially 48 may be defined with respect to a center 50 or axis 50 of the apparatus 10. The arbor aperture 32 may be defined by an arbor radius 52 formed within the cap 23 having a capped radius 54.

Each of the corrugations 30 may extend axially, radially, and circumferentially, as needed to connect the core 22 and the rim 16. The outermost flanged diameter 58 may be thought of as the effective outer diameter of the apparatus 10 and the flange 12. In one presently preferred embodiment, the thickness 57 of the rim 16 may be substantially, even orders of magnitude, less than the outermost diameter 58. Thus, the flange radius 59 about the center 50 is substantially the same on either side of the rim 16, in such a circumstance.

In certain embodiments, the rim 57 may not exist other than to be the edge of the flange 12. However, in keeping with structural mechanics factors, a rim 16 may extend axially away from a surface 29 of a web 18. In certain embodiments, the surface 29 may be flush with the rim 16, axially. In other embodiments, the rim 16 may extend axially away from the surface 29 beyond that amount needed to define the cavity 31 with respect thereto.

In certain selected embodiments, a flange 12 may be formed to have a core region 62 of the web 18 extending a portion of the flange radius 59 away from the core 22 (hub 22, cap 23, etc.). The remainder of the radius 59 may be covered by a rim region 64 of the flange 12 as illustrated by a generic flange portion 40. The rim region 64 of a web 18 is distinct from the rim 16. A rim 16 may typically extend orthogonally away from a surface 65 defining the web 18.

Thus, a core region 62 is that portion of a flange 12 and specifically of the web 18 of a flange 12 extending between a core 22 and some detectable or significant transition portion 60 or transition 60 of the web 18. Between the rim 16 and the transition 60 extends the rim portion of the web 18 of the flange 12. The transition 60 may be positioned anywhere desired for improving the structural integrity of a flange 12. Meanwhile, in general, a spool 10 or a reel 10 may be manufactured with or without any of the apertures 26, 27, 28, 32 as determined to be suitable for the apparatus 10.

The significance of the transition 60, which may be a mathematical circle or other geometry as well as a region having some radial dimension that is not insignificant, is for providing differing balances of strength, weight, stiffness, toughness, fracture-resistance, and fracture-susceptibility of the flange 12. Moreover, the direction of corrugations may change between the core region 62 and the rim region 64.

For example, a flange 12 may have corrugations 30 extending in a completely or substantially radial direction. A flange 12 may have corrugations 30 forming the web 18 and extending exclusively in a circumferential direction. Alternatively, the flange 12 may have corrugations 30 having a circumferentially curving aspect extending between the core 22 and the rim 16 continuously or discontinuously. In one embodiment, both curved and straight corrugations may exist in a single flange. In certain embodiments, certain types of corrugations 30 may be disposed in the core region 62 of the flange 12 as compared with corrugations 30 in the rim portion 64 of the flange 12.

Moreover, the rim portion 64 may be designed to promote or resist crushing, fracture, resilience, etc. The core region 64 may be designed to resist or promote deflection, distortion, crushing, fracture, or the like. However, in one presently preferred embodiment, the core 22 must not be completely separable from the core region 62 of the flange 12. Thus, the material characteristics of the rim region 64 and the core region 62 of the flange 12 may be designed to absorb shock, fracture, distortion, energy, and so forth without improper failures. Catastrophic failure (being rendered unusable, complete separation, rendering useless, etc.) of an apparatus 10 is to be avoided.

Nevertheless, spools 10 and reels 10 are dropped periodically. Such drops should be accommodated by a selected design for a flange 12. Accordingly, the generic flange portion 40 illustrates the transition 60 in a dashed circle indicating that it may or may not exist and it may be moved radially inward or outward. Similarly, the rim 16 is delimited by the outermost diameter 58 and a dashed circle interior thereto indicating that the construction, thickness, and even existence of a rim 16 are design parameters that may be traded off against other considerations.

Thus, in general, a spool 10 or reel 10 may have a flange portion 40 of a flange 12 designed to optimize the performance of the apparatus 10 by a combination of structural stiffness, toughness, strength, weakness, distortion, energy absorption, selective fracture, and so forth.

Figure 3:
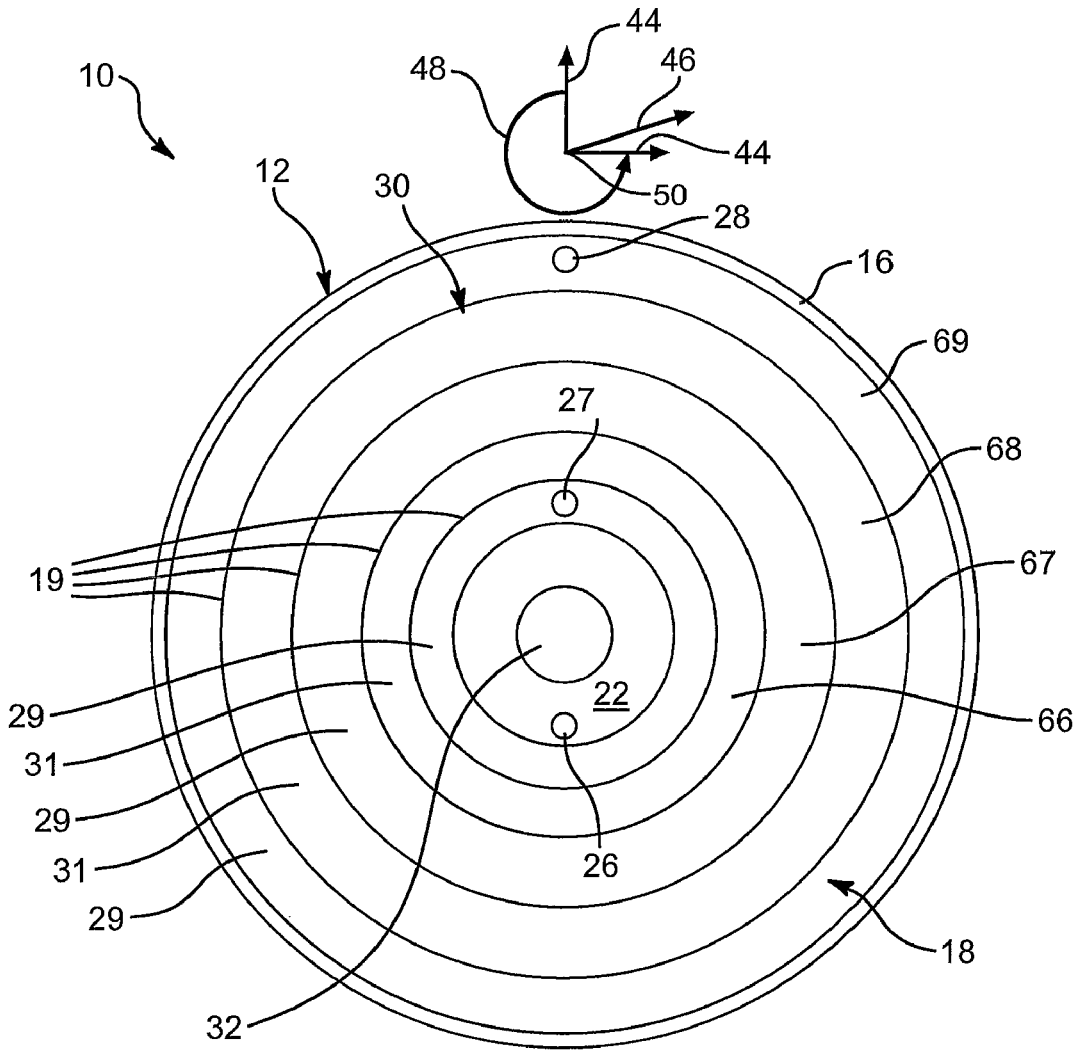
FIG. 3 is a schematic diagram of an end elevation view of a spool in accordance with the invention having circumferential corrugations.

Referring to FIG. 3, an apparatus 10 may have corrugations 66, 67, 68, 69 extending in a circumferential direction 48. A web 18 of a flange 12 may have numerous corrugations 30. The corrugations may be disposed to have alternating surfaces 29 and cavities 31. The extent in a radial direction 44 of any cavity 31 or surface 29 may be selected by a designer. Nevertheless, one may note that circumferential corrugations 66-69 may reduce the probability of transmitting a shock load directly from the rim 16 to the core 22.

Substantial fracture of the core 22 causing separation from the core 22 from the web 18 over more than about a third of the circumference of a core, will typically be regarded as a catastrophic failure. A fracture extent of half or more often releases the wire thereon. Accordingly, some mechanism for absorbing shock loads applied to a rim 16 by a drop of a spool 10 or a reel 10 resulting in an impact of a rim 16, may profitably be accommodated by eliminating or reducing the probability of catastrophic failure between the core 22 and the web 18 from shear, bending, or the like.

The rim 16 has a substantially larger aspect (size, radius, etc.) than does the core 22. Accordingly, less material is typically available to support a force transmitted between the web 18 and the core 22 than is available to absorb a radial or bending shock at the rim 16. Moreover, the bending moment of an axial component of a load at a rim 16 is substantially greater at the core 22 than at the rim 16.

Several factors may be accommodated in a design. However, stress levels may be far higher at any interface between the core 22 and the web 18, for a flange 12 having a constant thickness everywhere, as is good design practice for certain methods of plastics manufacture.

Figure 4:
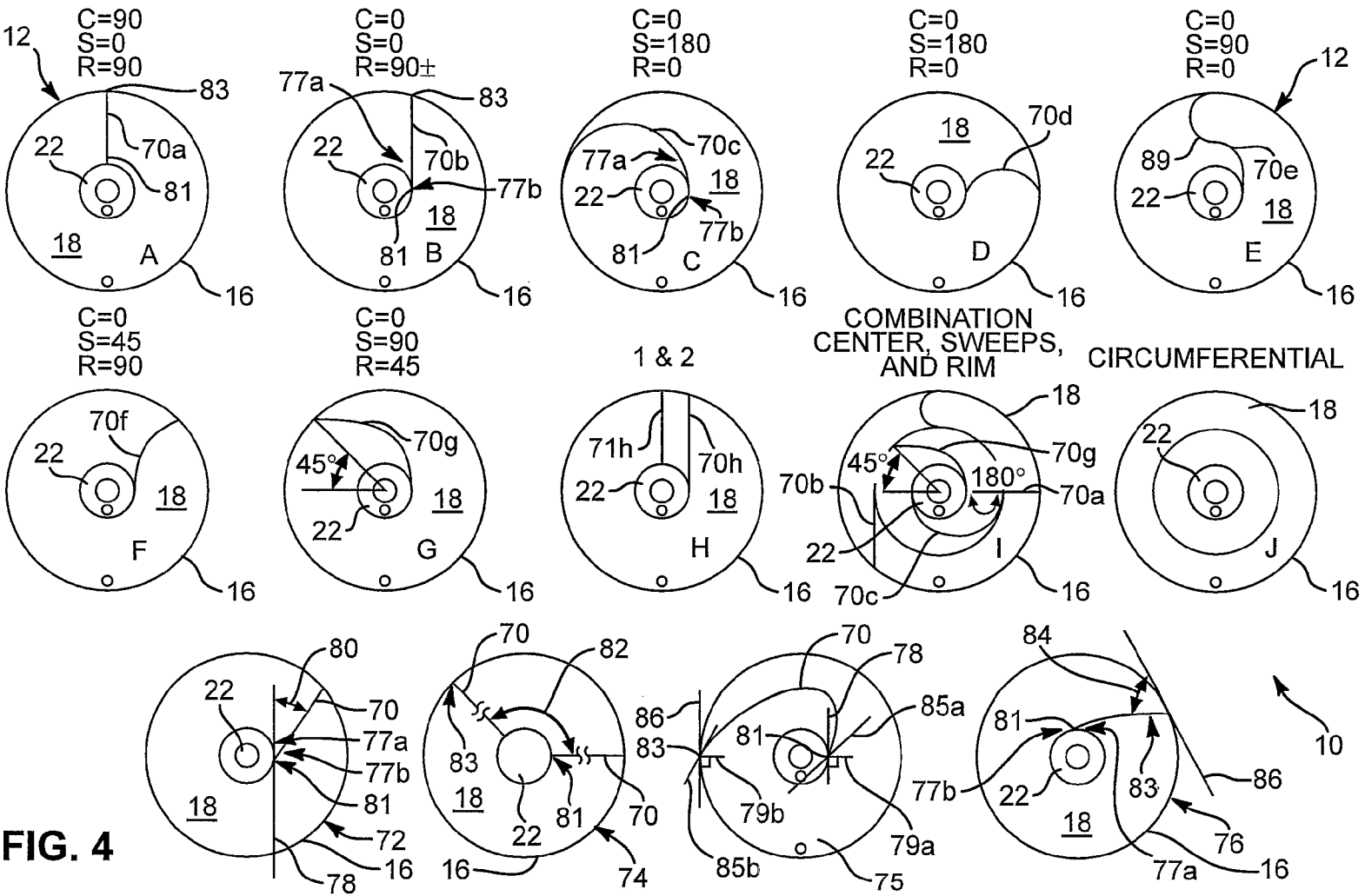
FIG. 4 is a schematic diagram of an end elevation view of a spool and reel geometry illustrating core, sweep and rim angles for a directorix defining a corrugation path for several embodiments of an apparatus in accordance with the invention.

Referring to FIG. 4, and still referring generally to FIGS. 1-16, corrugations 30 or a particular surface 19, 29, 31 extending substantially, radially, or to some extent radially to a substantial amount of its traverse or extent, may be defined or described by a directorix 70. Thus, a directorix 70*a*, 70*b*, 70*c*, 70*d*, 70*e*, 70*f*, 70*g*, 70*h*, may be regarded as a defining curvature for a selected wall 19 or connector 19 portion of a corrugation 30. One may think of a connector 19 or a wall 19 as that portion of a corrugation 30 extending from a surface 29 to the bottom of a cavity 31. Thus, a corrugation may extend principally in a radial direction 44, a circumferential direction 48, or both, while a connector 19 or a wall 19 will extend principally in an axial direction 46, and radial direction 44 to connect adjacent corrugations 30.

Each directorix 70 may have several features. Controls 72, 74, 75, 76 illustrate certain controlling features for defining the shape of a directorix 70 and its traverse between a core 22 and a rim 16. The traverse of a directorix 70 may be defined in terms of a core angle 80, a sweep angle 74, and a rim angle 76. The core angle 72 may be defined with respect to a directorix 70 and a tangent 78 to the core 22. A rim angle 84 may be defined with respect to a tangent 78 and a directorix 70. A sweep angle 82 may be defined in terms of a difference between a tangent 85*a* to a directorix 70 at a core contact point 81 and a tangent 85*b* to the same directorix 70 at a rim contact point 83.

Alternatively, a sweep angle 82 may be defined as a difference between a circumferential position of a core contact point 81 and a rim contact point 83 associated with a single directorix 70 of a corrugation 30 traversing between a core 22 and a rim 16 along a web 18. The latter definition may provide insights into how much of a web 18 has been traversed by a directorix 70 (e.g. by a wall 19 of a corrugation 18 defined by a directorix 70) in a circumferential direction. Adjacent walls 19 connected by a particular corrugation 30 may have different shapes, and thus more than one directorix 70 to define them.

In FIG. 4, the former definition of a sweep angle is used as illustrated in control 75. The latter definition of sweep angle 82 is used in the control 74. Each of the flanges in the controls A, B, C, D, E, F, G, H, I, J uses the former definition for sweep angle 82.

In general, a directorix 70 may be straight or curved. A directorix 70 may or may not include an inflection point 89 as illustrated in the directorix 70*e* of control E in FIG. 4. In certain embodiments, normals 79*a* with respect to a tangent 78 to the core 22, and normals 79*b* with respect to the rim tangent 86 may be used to define sweeps 82 and other geometric features of any directorix 70 of a flange 12.

In general, a directorix 70, and thus the corresponding wall 90 contacting a core 22 or rim 16 at a core angle 80 or rim angle 84, respectively, will affect the stress and stress concentration at the core contact point 81 or rim contact point 83, respectively. One may note that a directorix 70 approaching a core 22 fully tangent thereto may promote stress concentrations at an interior region 77*a*, while reducing them at an exterior region 77*b* with respect to the core 22 and directorix 70 (see control B, control C, and controls 72, 76).

The point of designing and controlling a core angle 80, sweep angle 82, and rim angle 84 is to control structural design elements that may thereby control the localization of distortion, stress, fracture, toughness, and so forth in a flange 12, and particularly at those locations where the web 18 of a flange 12 contacts a core 22 or a rim 16.

One may think of a stress concentration, such as that which may arise in a region 77*a*, as an invitation to structural failure locally. One may think of a smooth transition such as may occur in a region 77*b* as promoting structural integrity by removing the directionality of forces that may tend to rupture the integrity of a flange between a directorix 70 (actually the wall 19 defined by the directorix 70) and the core 22.

Accordingly, a directorix 70 may be designed to promote failure in an interior region 77*a* or a corrugation wall breaking away from a core 20. Meanwhile, the same directorix 70 may promote structural integrity with the core 22 at an exterior region 77*b* or on a axially oppositely disposed corrugated wall. Thus, during impact, a directorix 70, meaning a wall 19 defined thereby, may selectively fracture and separate at distinct locations with respect to a core 22, while others remain integral.

In FIGS. 1-16 several, substantially orthogonal surfaces result from the use of corrugations 30 in flanges 12. Accordingly, orthogonal surfaces may flex with respect to one another if not stiffened by a third mutually orthogonal surface. A separation of two surfaces may affect orthogonal surfaces until flexure becomes available to a last connecting surface. A combination of a portion of a core 22 maintaining its structural integrity with respect to a wall 19 (e.g. directorix 70) may maintain a structural contact between each surface 29, associated connecting wall 19, core 22, the cap 23, and any combination thereof. At the same time, the same corrugation 30 may selectively fracture with respect to the core 22 at a somewhat different location. Typically a wall-thickness away or more from the integral portion, to absorb the energy of impact. Nevertheless, the integral portion and transferring loads away then maintains sufficient structural integrity of the web 18 and of the entire flange 12 to prevent loss of the contained, stranded material held by the apparatus 10.

One may note that a directorix 70, such as a directorix 70*a* that is normal to the core tangent 78 and the rim tangent 86 will typically transfer impact loads directly to the cores 22 from the rim 16 in a radial direction 44. By contrast, a directorix 70, such as a directorix 70*b* may still deliver impact loads from a rim 16 to a core 22, radially eccentrically, or in bending with additional torsion outside of an axial-radial plane. Likewise, a directorix 70, such as a directorix 70*c*, 70*d*, 70*e*, 70*f*, 70*g* may not have a straight line path in a radial direction between a rim 16 and a core 22.

Web 18 may transfer loads through the wall 29, 31 (exterior or interior surfaces 29, 31 of corrugations 30). Stiffening is not readily available from the connector 19 (wall 19, directorix 70) to transmit radial loads. Nevertheless, the connector 19 may be available to provide stiffness against excessive column buckling, shell buckling or distortion, and the like in a radial direction. Bending may be resisted more by radially direct walls 19. Accordingly, the core angle 80, sweep angle 82, rim angle 84, number of corrugations 30, thicknesses thereof, and the like, may be designed to promote a selected amount of local distortion, fracture, integrity, toughness, and stiffness, and so forth within the web 18 and flange 12 generally.

Perforations within the web 18 may be used selectively to promote increased or reduced stress. For example, perforations may be provided at an interior region 77*a* to promote fracture while continuous material may provide the web 18 in a wall 29 of a corrugation 30 in the region 77*b* exterior to a core contact point 81. In one presently preferred embodiment, a bending load may fracture a corrugation 30, but each corrugation is circumferentially discontinuous at any axial position. Thus, a corrugation may part radially and axially from a core 22 along a circumferential crack at or near the core 22.

A corrugation 30 axially opposite an adjacent fractured one, will not then experience a bending load effective to separate it from the core at the circumferential location. Core angles 80 and circumferential discontinuity of corrugations tend to control the direction of cracks, precluding extensive propagation circumferentially. Thus, a continuous crack will not propagate around the core 22 circumferentially 48. The core 22 remains attached to the web 18. Moreover, the corrugations provide structural strength and stiffness in three dimensions, preventing failure of the flange 12 in service.

Figure 5:
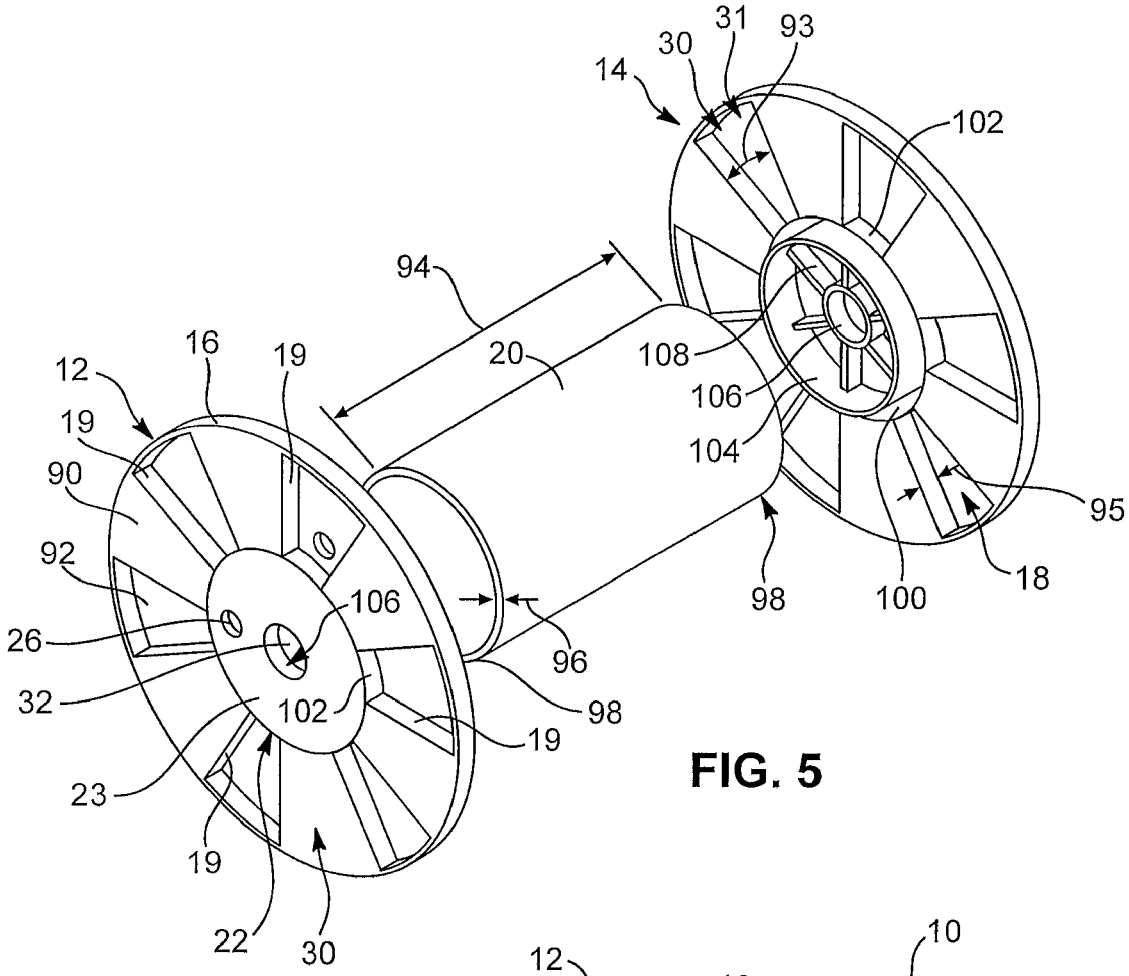
FIG. 5 is a perspective view of one embodiment of a disassembled reel made in accordance with the invention.

Referring to FIG. 5, an elevated surface 90 and a flush surface 92 or recessed surface 92 may be thought of as the surfaces themselves, or the entire walls in such locations. One may note that the flush wall 92 or the recessed wall 92, when viewed axially from outside a flange 12 provides a contact surface 92 for supporting stranded material to be wound on a tube 20. Accordingly, one may design the corrugations 30 such that any pair of adjacent connector walls 19 within a single corrugation 30 are spaced to promote greater circumferential distance 48 (see FIGS. 2-3) than that for an elevated or exterior wall 90.

Thus, the clear span 93 of wire crossing a corrugation 30 associated with an exterior wall 90 may be minimized. Alternatively, a cover 120, such as a paper board, or inexpensive material not integral with a flange 12 (see FIG. 7), may be provided to reduce bulging or pulling of stranded materials axially 46 into a cavity 31, interior to a particular corrugation 30.

A length 94 of a tube 20 may selected in accordance with a thickness 96 required to support the stranded material on a tube 20. Accordingly, the ends 98 of the tube 20 may be fitted to a slot 100 designed to support the tube 20 of the associated length 94, when fully loaded with product (stranded material), in a drop test or in an accident during operation. The core wall 102 may be designed to bond or fasten to the tube 20 in a manner calculated to maintain sufficient integrity between the tube 20 and the flange 12, 14 during a drop, thereafter.

In order to provide minimum weight, minimum wall thicknesses, and the like for each flange 12, 14, a core sleeve 104 may be designed to support the ends 98 of the tube 20. For example, less material is available to take the force of impact at the core 22. Accordingly, additional support about the slot 100 may be provided by a core sleeve 104 extending inside a tube 20, as well as the core wall 102 extending over the outside surface of the end 98.

A bearing surface 106 may be formed to extend axially away from the cap 23 of a core 22. Thus, less material may be used and wall thicknesses may be maintained at a constant value while providing additional bearing surface 106 to reduce friction and maintain integrity of the cap 23. In large reels, typically greater than one foot in diameter 58, and often several feet in diameter, the bearing surface 106 or bearing wall 106 (e.g. bearing 33) may be a critical design feature for suitable life of an apparatus 10.

As a practical matter, struts 108 may be provided inside a core 22. In one embodiment, corrugations 30 may extend to the arbor aperture 32. For example, the sleeve 104 may exist and extend axially away from the web 18 to receive the tube 20. Alternatively, struts 108 may be sized to permit the core 22 to receive the tube 20 therein. Nevertheless, in one presently preferred embodiment, large reels 10 may have a slot 100 formed between a core wall 102 and a core sleeve 104. In this latter embodiment, the struts 108 may be of any dimension desired consistent with those of the sleeve 104.

Figure 6:
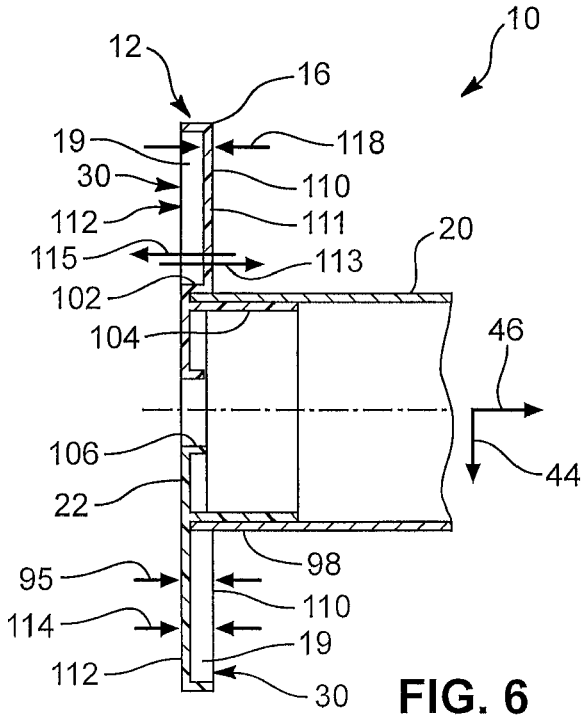
FIG. 6 is a schematic, side, radial, sectioned view of the reel of FIG. 5 illustrating both inner and outer corrugation sections.
Figure 7:
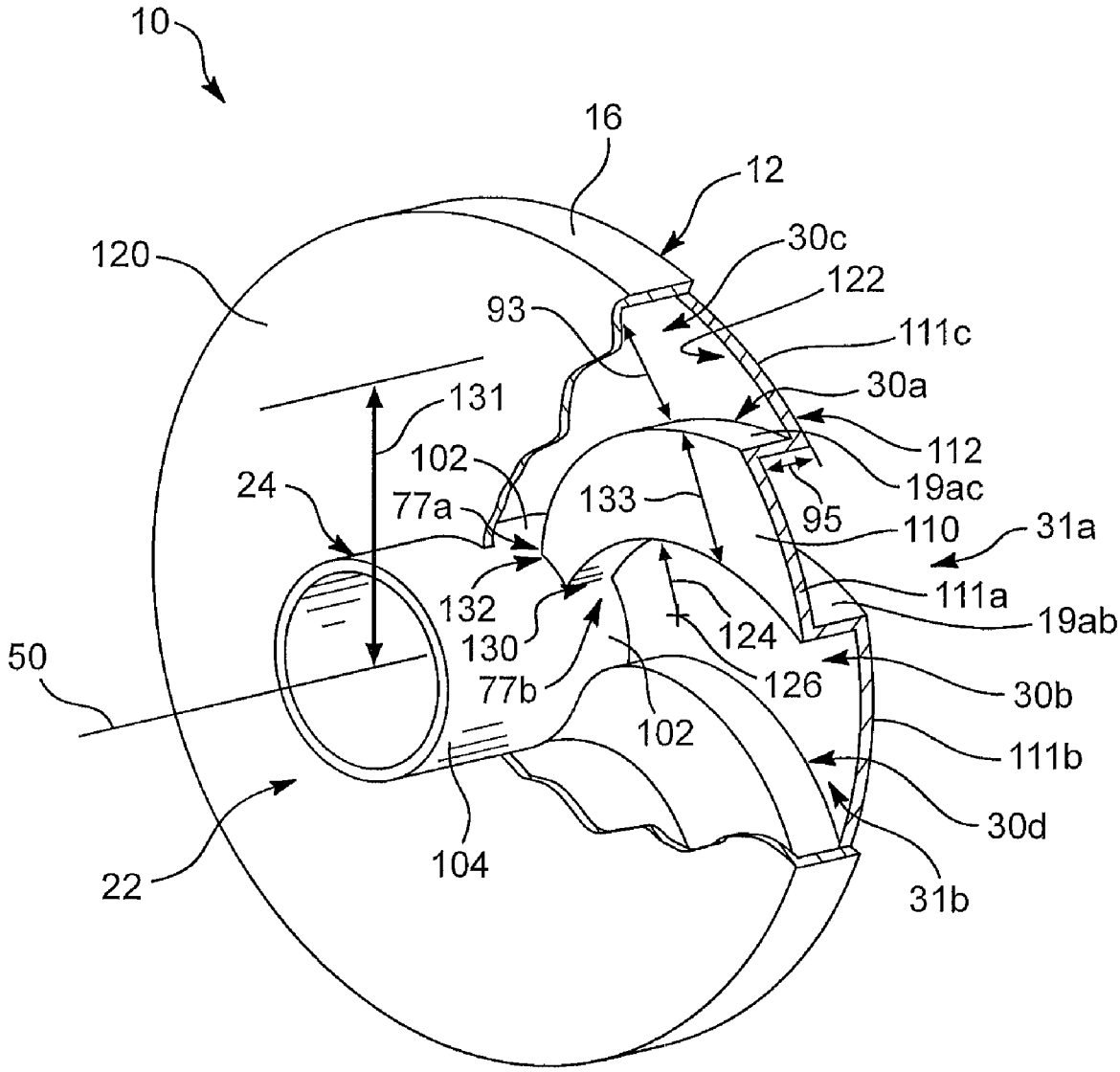
FIG. 7 is a cutaway perspective view of one embodiment of a flange in accordance with the invention, having a surface protection layer and curved corrugations.

Referring to FIGS. 6-7, and continuing to refer to the remaining FIGS. 1-16, a flange 12 of a spool or reel 10 may be provided with an inside face 110 (e.g. see also surface, faces, walls, etc. including walls 90, 92, and 29, 31). In the embodiment of FIG. 6, the inside face of a wall 111 of a corrugation 30 may be opposed to an outside face 112 thereof. Thus, an inside face 110 may be any face that is exposed to the interior of a spool 10 or a flange 10 while an exterior face 110 may be any surface exposed to an environment external to the portion of the spool 10 or reel 10 supporting or containing the stranded material. Thus, a cavity 31*a* may have an exterior surface 112 corresponding to the cavity surface 31 of FIG. 1.

Meanwhile, the same corrugation 30*a* may have an interior surface 110 corresponding to an elevated surface 90 or outer wall 29, depending on one's perspective. Thus, one may speak of a wall 111 of a corrugation 30 sharing or connecting to an adjacent wall 111 of an adjacent corrugation 30 by a connector 19 or connecting wall 19. Thus, for example, a wall 111*a* of a corrugation 30*a* forming a cavity 31*a* may share a connecting wall 19*ab* with a wall 111*b* of a corrugation 30*b*. Similarly, the wall 111*a* may share a connecting wall 19*ac* with a wall 111*c* of a corrugation 30*c*.

One may note that the region 77*a* of FIG. 7 may form a sharp angle and a stress concentration between the connecting wall 19*ac* and the core wall 102 of the core 22. Meanwhile, the region 77*b* is completely smooth or may be so designed for the connecting wall 19*ab* of the same corrugation 30*a*. Accordingly, for a radial load in tension, fracture may be anticipated in an area 77*a* before fracture in an area 77*b*. However, in bending, the web 18 may fracture along a line between 77*a* and 77*b* at maximum stress, but not usually at the same radial location on an adjacent corrugation 30*b*, 30*c* of opposite sense (inside/outside), which is acting as a fulcrum for the fracturing process. Connecting walls 19 may fracture partially or completely in an axial direction toward a fulcrum (e.g. regions between 77*a* and 77*b* for corrugations 30*b*, 30*c*).

One may also note however, that the cavity 31*a* also has various relationships with both the corrugation 30*a* and the corrugation 30*b*. Accordingly, the connecting wall 19*ab* within the cavity 31*a* may also have equivalent locations having the same geometry as the areas 77*a* and 77*b* for the corrugation 30*a*.

However, such interior 77*a* and exterior 77*b* connecting regions will have an opposite sense on opposite sides of the respective walls 19*ac* and 19*ab*, and with respect to the adjacent and corresponding corrugations 30*c*, 30*b*, respectively. Thus, upon impact, a fracture may occur, partially separating a wall 111*a* from a core 22, beginning at an area 77*a* and extending along the core 22 or the wall 102 of the core 22 toward the area 77*b*. However, adjacency of corrugations 30 may prevent extensive propagation circumferentially of any crack.

However, the wall 19*ab* may tend to fracture away from the core 22 within the cavity 31*a*. The corrugation 30 opposite a fractured one is acting as a fulcrum for fracture, yet maintaining its own integrity with the core 22 and particularly the core wall 102 in the area 77*b*. Thus, one may see that the dimensions of the corrugations 30 allow great design flexibility.

An inside face 110 of a wall 111 may be disposed opposite an outside face 112 thereof. The inside face 110 and the inside face and outside face 112 may exist for every wall 111, regardless of the disposition of the wall 111, on the inside 113 of the flange thickness 114, or on the outside 115 of the flange 12. The inside 113 direction may be thought of as the region of the spool 10 or reel 10 that holds the stranded material (e.g. wire).

Thus, the cavity depth 95 and the wall thickness 118 may typically add up to the flange thickness 114. Nevertheless, the flange thickness 114 need not be constant in a radial direction 44. Similarly, a wall thickness 118 need not be uniform in a radial direction 44 or a circumferential direction 48 but may be adapted to absorb or sustain loads. Nevertheless, constant wall thickness at all locations tends to promote uniformity of stress and reliable manufacture at consistent molding times for plastics.

Extending in a radial direction 44, a corrugation 30 may be tapered in order to reduce weight, balance forces, permit selected distortion, or provide more uniform impact loading, For example, near the rim 16, more material exists in a circumferential direction 48 to absorb loading, breakage, distortion, and the like as a result of shock loads (forces, impact) when compared with a location near or at the core wall 102.

Moreover, the bending moment on a flange 12 is greatest near the core 22 in response to a load applied near the rim 16. Thus, a tapered flange 12 having a narrower flange thickness 114 near the rim 12 may provide a closer balance or more uniform distribution of forces in the flange 12. On the other hand, selective fracture may be designed into various corrugations, as a result of a uniform flange thickness 114, thus focusing energy at the core 22 as it interfaces with the web 18 (e.g. walls 111 and connector walls 119.)

Referring to FIG. 7, one may note that a point 132 along a connector wall 19*ac* is one type of core contact point 81 or core contact line 81 for a directorix 19*ac* or connector wall 19*ac*. Similarly, for the corrugation 30*a*, the core contact line 81 or core contact point 81 is identified by the point or line 130 of tangency of the connector wall 19*ab* with the core wall 102. Thus, adjacent connector walls 19*ac*, 19*ab* operate similarly. Nevertheless, with respect to any particular corrugation 30*c*, 30*a*, respectively, the connector walls 19*ac*, 19*ab* respectively, will behave differently with respect to their own individual interior 77*a* and exterior 77*b* angles at their respective contact points 132, 130 or contact lines 132, 130.

Each connecting wall 19 may have one or more radii of curvature 124 about one or more centers 126 or center points 126. That is, the radius 124 may not be constant. Moreover, the center point 126 may not be constant. Nevertheless, in one embodiment a uniform radius 124 about a single center 126 may be selected for each connector wall 19. The design patterns 72-76 and A-G of FIG. 4 illustrate selected samples of connector walls 19, as a directorix 70, in each case. Thus, the corrugations 30 of the flange 12 of FIG. 7 may be formed as a variation of the control D or pattern D of FIG. 4.

Nevertheless, the flange of FIG. 7 may be designed to have any combination, or all combinations, or some other combinations of core angle 80, sweep angle 82, and rim angle 84, as well as inflection points 89 and one or more radii 124 of curvature about one or more centers 126 of curvature. Moreover, the relative proportion of the inner face 110 of the web 18, as compared with the outer face 112 of various corrugations 30 may be adjusted to provide more or less stiffness or distortion.

For example, if the width 133 of a corrugation 30 (e.g. 30*a*) is comparatively larger than the same dimension 133 of an adjacent corrugation 30 (e.g. 30*b*, 30*c*), at any given distance 131 or radius 131 from a central axis 50 of a flange 12, distortion may be effected. Moreover, the clear span 93 between adjacent internal corrugations 30 (e.g. on the inside face of the flange 12) may be reduced. The walls 111*a* having a larger dimension 133 may be more susceptible to distortion in an axial direction or a radial direction upon impact.

Accordingly, non-uniform stiffness within adjacent walls 111, corresponding to adjacent corrugations 30, may provide absorption of energy without failure of the fundamental structure of the flange. Nevertheless, the corrugations 30 may prevent catastrophic failure with an appropriate amount of relative stiffness where needed. Corrugations 30 having a comparatively narrower width 133 may be designed to bend or spring by virtue of having an aspect ratio closer to a value of one.

An aspect ratio may be thought of as the ratio of depth 95 of a cavity 31 with respect to a span 133 or width 133 of a single corrugation 30 at a particular radius 131. Thus, for example, interior walls 111 in contact with stranded material may have comparatively larger widths 133 than exterior walls 111 not in contact with the stranded material. Moreover, provision of a sharp angle near the transition from a connector wall 19 to a corrugation wall 111 may promote selective fracture, allowing a corrugation 30 to spring separately from its adjacent corrugation. Thus, selective local failure or separation may actually protect the overall integrity of the flange 12 under impact or shock loading.

Stress concentration inhibition may be provided by fillets in selective corners. Increased stress concentration factors may be provided by sharpening the angle between connected, especially orthogonal, surfaces. Fillets need not be constant along the entire length of a directorix 70 (connector wall 95).

In one embodiment, a corrugation 30 may be formed to have a comparatively sharper angle between a wall 111 and one of the adjacent connecting walls 19 with a comparatively more rounded transition between the same wall 111 and its opposite connecting wall 19. Thus, one connecting wall 19 will remain with one corrugation 30, while the adjacent connecting wall 19 will remain integral with the wall 111 of the next corrugation 30.

For example, a corrugation 30*a* may remain integral with the connecting wall 19*ac*, by virtue of proper location of fillets, while separating from the connector wall 19*ab* due to an absence or sharpness of fillets. Similarly, the corrugation 30*b* or 30*c* may provide selective breakage and selective integrity in order to absorb more shock with distortion and breakage.

Breakage absorbs tremendous amounts of energy. Selective breakage may absorb energy of impact in areas where the contained wire or other stranded material on a tube 20 of a reel 10 or spool 10 will not be damaged or rendered unusable or inaccessible.

If the connector walls 19 of the corrugations 30 of FIG. 7 are straightened in accordance with other designs illustrated in FIG. 4 or similar thereto, impact loads may be delivered directly from the rim 16 to the core 22. Accordingly, breakage may occur between the corrugations 30 and the core 22. Whereas the apparatus of FIG. 7 may provide eccentric loading on the core 22, reducing, absorbing, or eliminating much of the radially directed energy from the corrugations 30 to the core 22, a straight connector wall connected normal to a core tangent 78, may fracture from the core 22 at the core wall 102 or in the web 18. However, as with bending loads, once fracture occurs, a corrugation can both re-distribute loads through the web 18 and resist further failure due to its shape. A comparatively longer core wall 102 (as compared with corrugation 30 thickness 114 axially) may act as a cantilevered "barrel stave," flexing radially but not failing axially at all locations.

Again, in selected embodiments, one connector wall 19 corresponding to an individual corrugation 30 may have a core angle 80 close to perpendicular. Impact may cause shearing of the core 22 or web 18 and breakage. Meanwhile, an adjacent connector wall 19 may be curved or positioned eccentrically, tangent, or the like, with respect to the core 22 or a core tangent 78.

The wall 19 may permit torsional distortion in one or more directions 44, 46, 48. Accordingly, fracture may be reduced or eliminated for such a connector wall 19. Thus, both fracture and toughness may be provided for absorbing impact without destroying the entire structural integrity of a corrugation 30. In certain embodiments, adjacent corrugations 30, meaning in this context adjacent and on the same side (e.g. inside or outside) of the flange 12, may be disposed closer together and alternating in their impact resistance and toughness characteristics).

Figure 8:
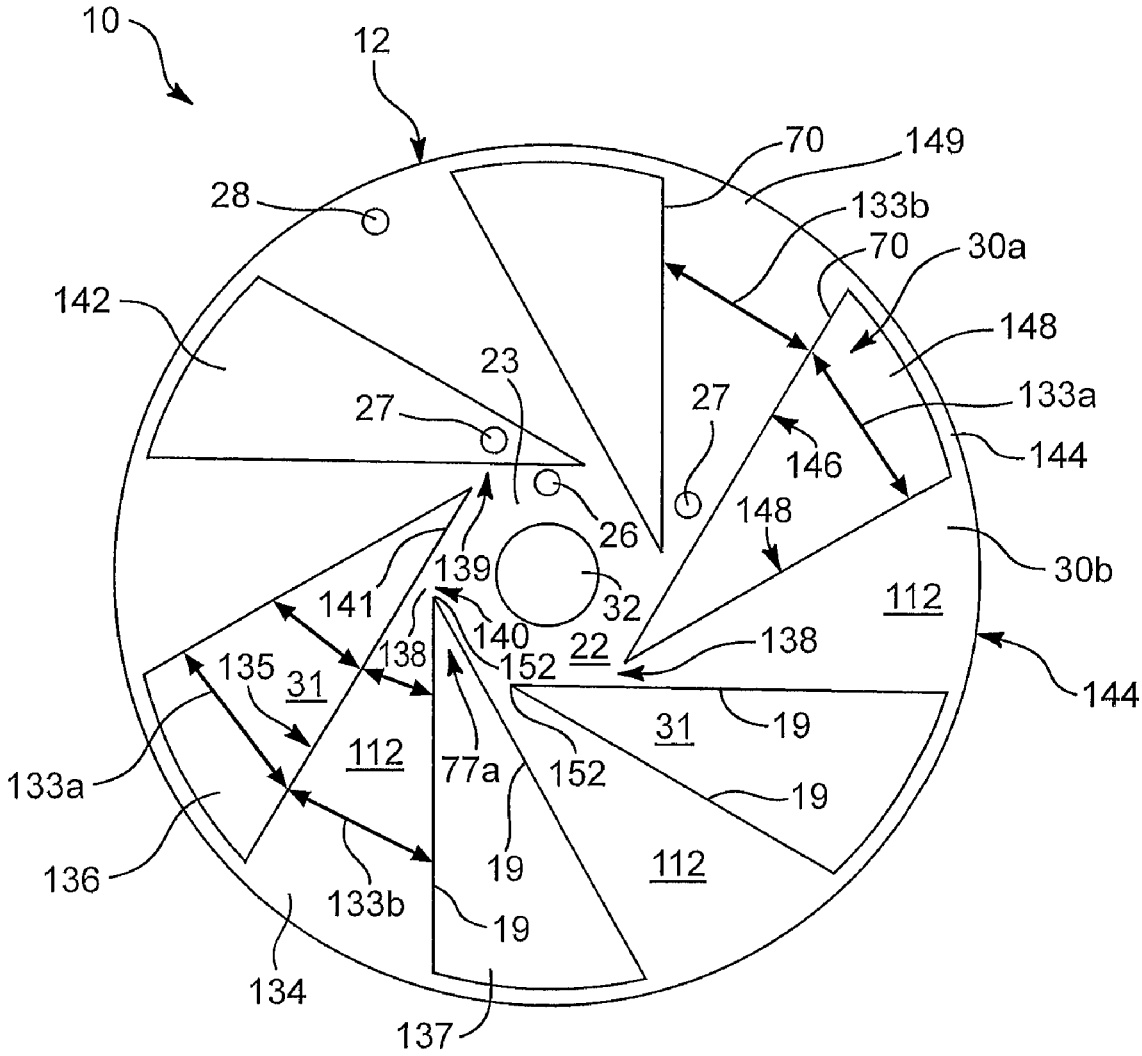
FIGS. 8-12 are schematic axial views of flanges made in accordance with the invention and having differing configurations for directorix angles for core, sweep, and rim angles as well as curvature.

Referring to FIG. 8, specifically, and to FIGS. 7-14, generally, a core 22 may be formed flush with an outer face 112 of a corrugation wall 111. A cap 23 may form a fixed end axially beyond, or flush with, the exterior surfaces 112 or outer faces 112 of the various corrugations 30.

A corrugation 134 and an adjacent corrugation 136 may share a connector wall 135, a specific instance of a wall 19. Thus, the cavity 31 of the corrugation 136 is closed on only four sides and has a single open side. By contrast, the flanges 12 of FIGS. 1 and 5 have five sides.

Accordingly, the corrugations 30, 134, 136 may be considered highly triangulated. Triangular shapes tend to be particularly rigid. Nevertheless, in view of the formation of contact areas 138 or connection areas 138, the corrugation 134 may transition within a single surface 112 to the cap 23 of the core 22. A corrugation 134 may tend to continue fracture and reduce or eliminate integrity between the portions of the web 18, or between the web 18 and core 22. However, all fracturing beginning in the corner 77*a* and proceeding circumferentially 48 a limited distance due to the circumferential discontinuity of material.

Fracture beginning in the corner 77*a* or stress-concentrating region 77*a* does not become equivalent for the corrugations 134 and 136. A corrugation 134 shares the cap 23 of the core 22, or shares a surface with the cap 23. By contrast, the region 77*a* does not have a surface on the inside 113 of the flange 12. A fracture may be propagated through the face 112 from the region 77*a*, toward the corrugation 136, across the corrugation 134. Loading may fracture corrugations 30 from cores 22. In bending, a more likely event is the fracture of a connector wall 135 under the force from one corrugation 134 (136) acting as a fulcrum and the other 136 (134) separating completely or partially from the core 22. The structural strength and stiffness of the web 18 may then redistribute loading even when partially separated from the core 22 by failure under bearing loads. The web 18 remains attached to the corrugation 134 and functional.

The contact region 141 under a fulcrum region of a corrugation 134 appears structurally to be continuation of the connector wall 135. Bending may be axially inward or outward and corrugations 30 do not generally fracture the same on axially opposite sides of a flange 12, nor in exactly the same defections. Thus overall integrity of the webs 18, and of spools 10 or reels 10 (core 22 to web 18) is excellent.

Fracture beginning through the region 138 and beginning at the corner 77*a* across the corrugation 134, once started, may tend to propagate orthogonally though the core wall 102 (not seen, see FIGS. 5-7), depending on core wall thickness 102. Alternatively, cracks may propagate orthogonally along connecting walls 19, 135.

No flush surface is available between the core 22 and the corrugation 137 to carry a fracture circumferentially, and continuously in a single direction. However, in bending, tearing or fracturing of connecting surface 135 from the core 22 can occur. Likewise, all fracture need not occur at a core 22, but may occur radially away therefrom.

An extended length of a core 22 protruding axially in an inward direction 113 (see FIG. 6) from the corner 77*a* through the corrugation 137 may propagate only so far as distortion will allow and necessitate as loads are re-distributed.

Depending on the load directions, a portion of a core wall 102 may connect to the corrugation 137, and may not completely sever the connecting wall 19 away from the corrugation 134. Selected fracture can occur from incipient points 77*a* in corrugations 137, but not from the same drop or the same bending load, typically.

The contact regions between a cap 23 and a corrugation 134 may tend to fracture about a core wall 102. Similarly, in a next corrugation 136, the region 141 may tend to be integral. A region 139 may tend to fracture, separating the outer face 112 of a corrugation 30 from the rim wall 102. Thus, the region 141 may maintain its integrity with the web 18 and rim 22, but typically in a drop or impact of an axially opposite sense, just as the corrugation 134 may. Thus, the corrugation 134 may tend to maintain integrity by reliance on the corrugations 136, 137 and the shared connector walls 19, 135.

Each of the corrugations 30 (e.g. 30*a*, 30*b*, 134, 136, 137) may have a fracture region 138 or a contact region 138 with the cap 23, which region 138 may fracture. A core contact region 140 may remain intact but orthogonal thereto as an extension of a connecting wall 19. Substantial loading may be remotely supported by the corrugations 30. The regions 138 may be thought of as the fracture regions wherein a corrugation 30 (e.g. 30*a*, 30*b*, 134, 136, 137) separates from the core 22 or itself. A region 139,140 may be viewed as an area where a connector wall 19 maintains integrity with the core wall 102 orthogonal to a rupturing corrugation face 112. In opposite bending, roles of corrugations may reverse.

Rupture may propagate circumferentially across a corrugation 30, radially through a core wall 102, segmenting the core 22 circumferentially, if the wall 102 is comparatively thin. In the latter event, cantilevered portions may extend axially parallel to one another. Maintaining a certain portion of the core 22 near the flange web 18 free from rigid adherence to a tube 20 may promote greater durability. For example, a cardboard tube 20 tends to have great toughness, not failing in very high loadings, and most drop tests. Meanwhile, a core 22 may be able to flex substantially between axial breaks propagated from sharp corners 77*a* across outer surfaces 112. Thickness design can control fracture.

Due to the nature of stress concentrations, fractures may begin in corners 77*a* and propagate radially through core walls 102, but may be substantially less likely to propagate to or beyond a connector wall 135. Whether fulcrumed in bending of flanges 12, or stripped into slatted staves by a radially and axially directed fracture sympathetic to the fractured region 138 circumferentially from a corner 77*a*, adjacent corrugations 134, 137 can survive and support one another.

Substantial loads can be re-distributed and transferred through corrugations 30 after a fracture almost anywhere between a rim 16 and a core 22. Nevertheless, the comparatively rigid triangulation of a corrugation 30 may tend to break near the core in bending. Radial components of forces may tend to rotate the core 22, or resolve forces into an eccentric, tangential load applied to, the core 22 and attached tube 20.

Other dimensions of a flange 12, and particularly of individual corrugations 30, may be designed to crush, fracture, distort, or hold. An interior corrugation 142 may be provided with a start hole 27 for wire. The start hole 27 may be positioned to relieve stress, or to propagate or to initiate fracture in a selected region. Thus, various start holes 27 (for starting wire wrap) or small stress-relief apertures 27 may be disposed periodically about a flange 12.

A rim wall 144 may extend axially 46 to any desired flange thickness 114. A connector wall 146 on an "inner" side of a corrugation 30*a* may maintain its integrity with the core wall 102. The connector wall 148 may maintain its connection to the core 22 or core wall 102, but is likely to propagate a fracture toward a corrugation 137 and cavity 31. Meanwhile, the outer connector wall 148 will likely not maintain its connection with a connector wall 146, except through the broken, and thus flexible, core 22, having sympathetic fractures orthogonal to the surfaces 112.

Providing a broader width 133*a* in an interior corrugation 136, 148 as compared to a width 133*b* of an exterior corrugation 134, 149 respectively, may promote distortion in a radial direction 44 with substantial deflection in an axial direction 46 (see e.g. FIGS. 2-3 for directions). The radius of curvature 124 of FIG. 7 may be replaced by a comparatively rigid triangular structure directing forces eccentrically toward a core tangent 78 in FIG. 8. Bending a flange 12 axially may actually create a torsional component about a radius when corrugations do not run strictly radially 44.

A single point 152 may exist for each corrugation 30 of FIG. 8 (e.g. 134, 136, 148, 149, 30*a*, 30*b*, 142 being specific examples). The single point 152 of FIG. 8 corresponds to a line 132 extending axially as a contact line 132 or contact point 81 forming a vertex 81 between tangents 78 to the core wall 102 and the connector walls 19 for a particular corrugation 30. Fileting may relieve all points 152, 81, etc.

Figure 9:
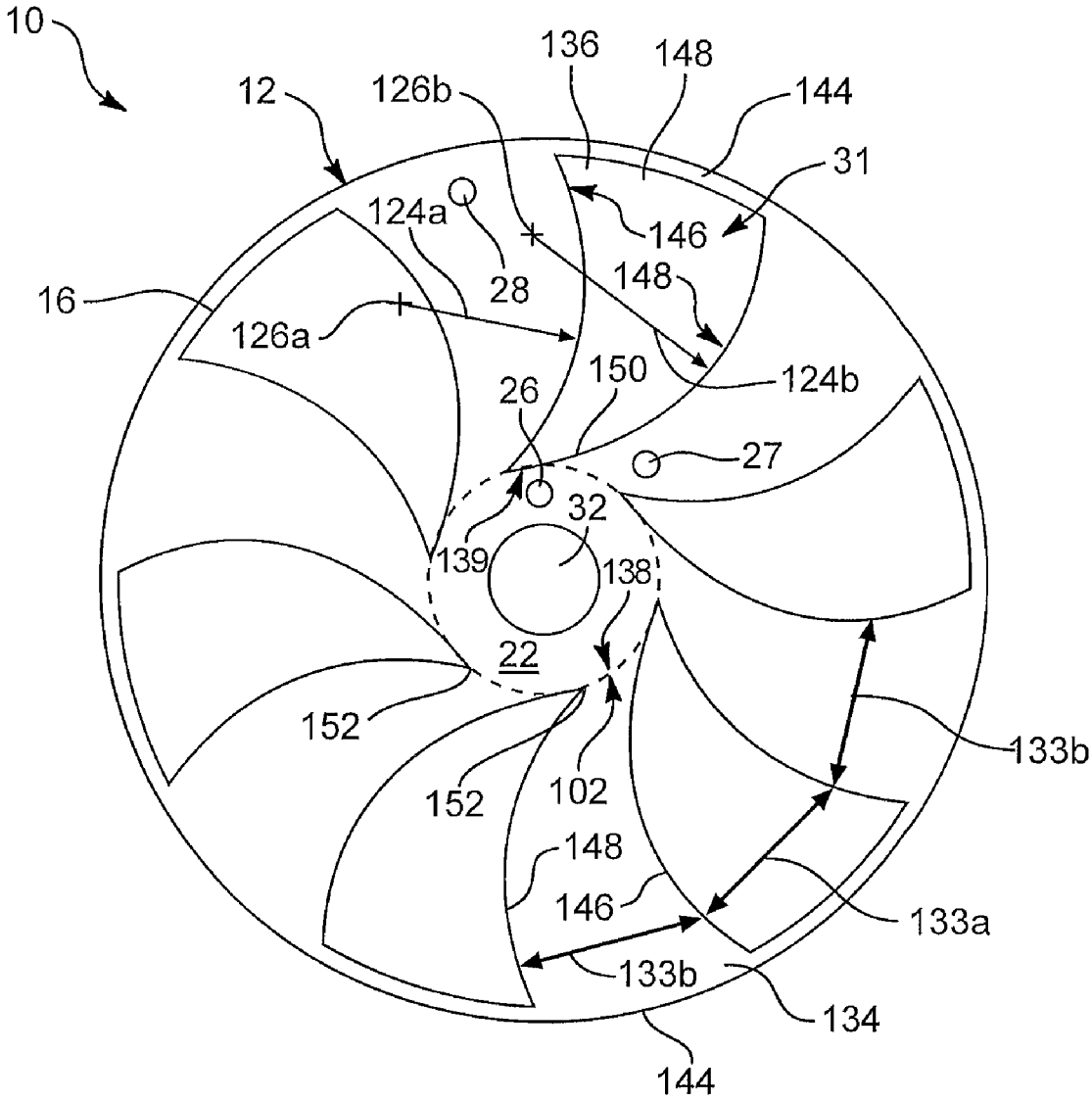

Referring to FIG. 9, and continuing to refer to FIGS. 8-14, generally, various corrugations 30 (e.g. interior corrugation 136 and exterior corrugation 134) may be defined in terms of interior connecting walls 146 and exterior connecting walls 148. Each connecting wall 146, 148 may be defined in terms of one or more radii of curvature 124*a*, 124*b*, measured from one or more centers of curvature 126*a*, 126*b*, respectively. In the embodiment of FIG. 9, a rim wall 144 may be continuous, despite the alternating inside and outside corrugations 136, 134, respectively.

The wall 102 of the core 22, illustrated in hidden lines, is tangent to the corrugations 30 (e.g. 134, 136) at particular contact points 152. The connecting region 138 between the exterior or outer corrugation 134 and the core 22 may operate to be fractured selectively in order to propagate fracture from a point 152, maintaining selective attachment of connecting walls 146 to the core wall 102.

A principal of selective proportioning of the thickness 133*a* of an inner or interior corrugation 130 in contact with the stranded material of the spool 10 or the reel 10 may provide a comparatively narrower thickness 133*b* for an exterior corrugation 134. This may be particularly effective in an embodiment such as that illustrated for FIG. 9.

Radial forces applied to the rim 16 may be largely resolved into circumferential forces applied to the core wall 102, with selective fracturing at points 152, and along connecting walls 148 (optionally), or elsewhere as desired. Bending may resolve into more torsion about a radius instead of a direct axial tension load in the web 18 or at the core 22. Selecting an aspect ratio for each exterior corrugation 134 in order to approximately equalize axial and circumferential dimensions thereof, may again provide springs, selective fracturing, and selective deflection or distortion, of interior corrugations 136 in contact with the stranded material.

In general, a completely fracture-proof spool 10 or reel 10 is not necessarily the best. All materials must distort under load. A material or design that is too stiff to accept any distortion must typically fail under less load than a similar design having more flexibility. If sufficient strength can be added to absolutely preclude rupture at operational or accidental impact loads, then selective distortion and fracture may not be required. However, a spool 10 or a reel 10 having a value two orders of magnitude less than the value of stranded material contained thereon, does not bode well for an absolutely fracture proof design.

Figure 10:
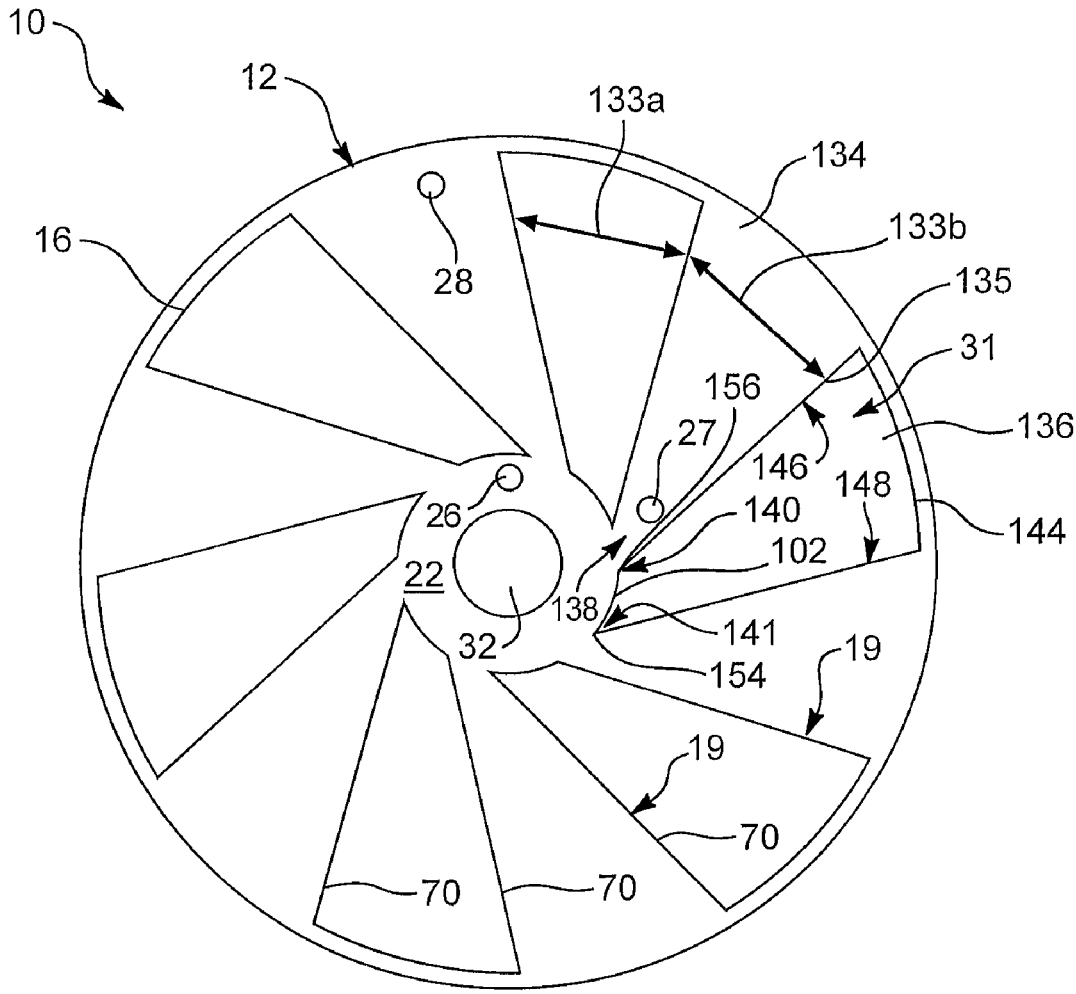

Referring to FIG. 10, one embodiment of an apparatus 10 may rely on a straight directorix 70 uniform in core angle 80, sweep angle 82 and rim angle 84 for all corrugations 30 (e.g. 134, 136) defined thereby. Nevertheless, an interior point 156 or inner point 156 and an exterior point 154 may replace the single point 152 of FIG. 9. Moreover, the core 22 is interior with respect to the core angle 80 of every directorix 70, connecting wall 70, 146, 148.

Note that no directorix 70 or corresponding connecting wall 19 (e.g. 146, 148) actually exists tangent to either the core 22 or the rim 16. Nevertheless, sufficient eccentricity exists to operate similarly to the configurations of FIGS. 8-9. However, the straight connecting walls 19 (e.g. of which the specific examples 146, 148 pertain to corrugation 136) tend to stiffen the flange to direct loads in a straight line toward the core from the rim. Again, changing comparative widths 133*a*, 133*b* to form larger interior corrugations 136 may be used to promote features here described in association with FIGS. 6-9.

The applicability of perforations, selective filleting, selective stress concentration factors, and the like may be applied at the interior points 156 or exterior points 154 in order to provide preferential fracture in the region 141 and preferential integrity in the region 140. Moreover, once some amount of fracture has occurred stress may be relieved. Moreover, inasmuch as three orthogonal surfaces appear at each of the corners 152, 154, 156, a selective fracture to separate one surface from the other two, may permit flexure between the two remaining orthogonal surfaces. So long as rigidity is maintained, loads must either be supported or materials must be distorted (deflected) or fractured. Once a single surface has been fractured away from the remaining two, at a particular corner 152, 154, 156, the flexure of the remaining two orthogonal surfaces may absorb deflection. The energy will have been absorbed by the fracture and being placed on more remote regions by virtue of that flexure.

One benefit of this design in bending of flanges 12, is that fracturing may be directed. For example, adjacent corrugations 134, 136 will not normally fracture circumferentially at a single radius, even across a single corrugation 134, 136. Corrugations will support one another in failure. More fracture, in more directions, can be absorbed with minimum loss of functional integrity of a flange 12 and spool 10.

Figure 11:
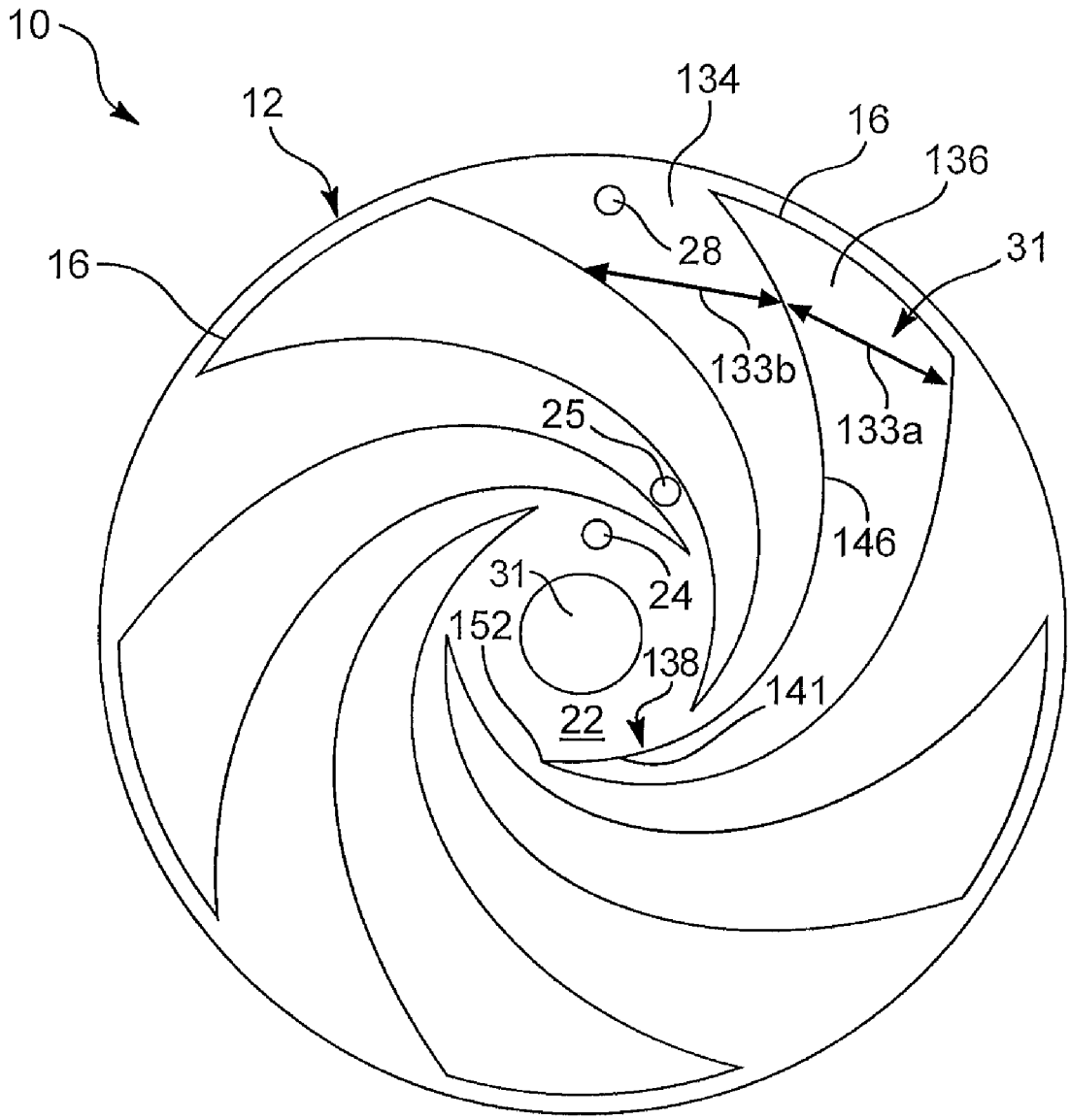

Referring to FIG. 11, a spool 10 or reel 10 may have a flange 12 in which a substantial sweep angle 82 (see FIG. 4) exists. A directorix 70 may define a connecting wall 146 between an exterior corrugation 134 and an interior corrugation 136 recessed to form a cavity 31 in the end of a flange 12. The point 152 may be designed to operate to fracture. A sufficient sweep angle with an aspect ratio between the thickness 133*b* and the thickness 133*a* much less than one can provide the selective spring, distortion, fracture, and other benefits here to for described, to an even greater degree. Bending survival may be substantially enhanced. Distortion may be traded off against stiffness in radial loading, axial bending, or both, by selection of core angle 80, sweep angle 82, and rim angle 84. Discontinuous fracture may absorb energy, while corrugations transfer loads and retain structural integrity of a flange.

Thus, more distortion may be provided, even avoiding fracture or excess fracture. Meanwhile, the nature of the transition between the core 22 and any individual corrugation 30 (e.g. 134,136) may promote regions 141 maintaining mechanical integrity with the core 22. The adaptability of orthogonal surfaces being reduced from three at a point 152 or corner 152 by fracture to leave only two, may promote uncoupling of absorption of energy through fracture, and distortion of connections through flexure, in order to absorb energy but to avoid catastrophic failure (e.g. separation) and to maintain mechanical integrity.

Figure 12:
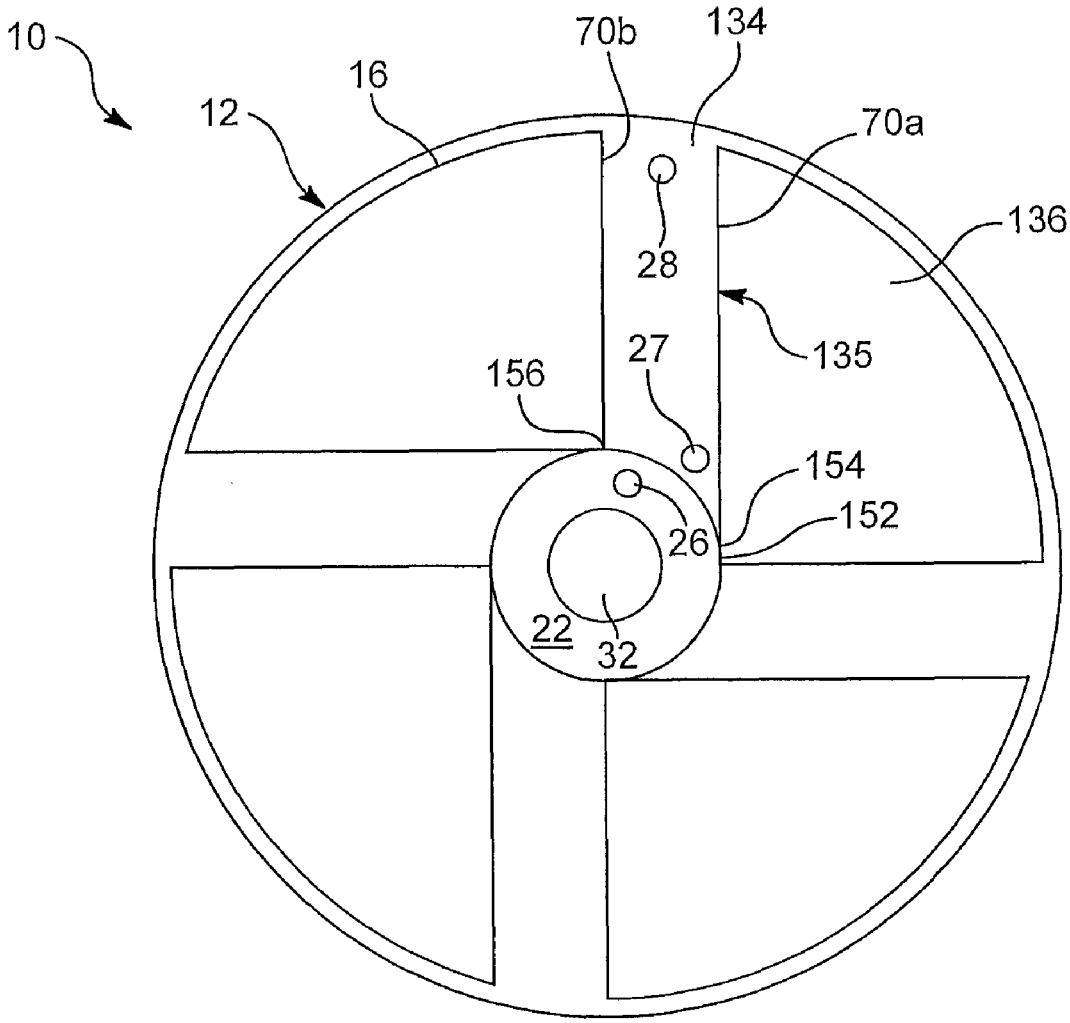

Referring to FIG. 12, a directorix 70*a* may define a connecting wall 135 between an outer corrugation 134 and an inner corrugation 136. A load applied radially may still be resolved eccentrically at the core 22. Nevertheless, a sharp interior corner 156 may be normal to a core tangent 78, while an exterior corner 154 on the same exterior corrugation 134 may be parallel to a core tangent 78. A bending load may be resolved into plate distortion and loads in both axial and circumferential directions. Fracture directions may be thus controlled.

A point 152 may be formed by connecting walls 135. Nevertheless, selection of the respective dimensions of the exterior corrugations 134 and interior corrugations 136 may leave a space for corners 154, 156 in an individual interior corrugation 136 to be separated, analogously to the structure of FIG. 10. Numbers, dimensions, and aspect ratios of corrugations 134, 136 may be selected in accordance with design choices to balance strength, rigidity, flexibility, distortion, toughness, selective fracture, and so forth as described previously.

Continuous fracture of the web 18 from the core 22 can be avoided by the directionality of loadings in bending or direct radial impact. Moreover, distortion and stiffness may be balanced against each other in olefinic plastics, while fracture lengths and directions may be balanced against weight and strength in more brittle materials maintaining system integrity.

Figure 13:
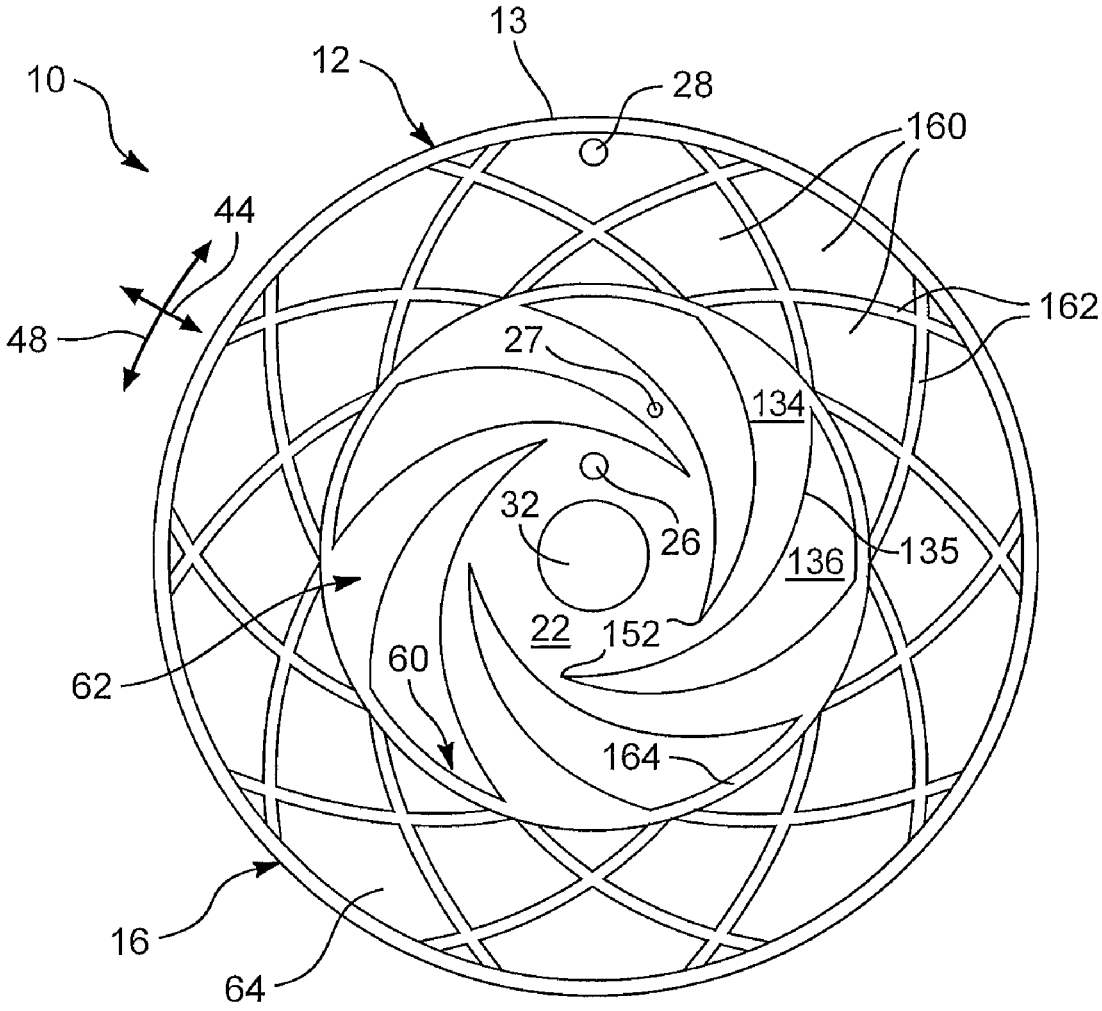
FIG. 13 is a schematic axial view of a flange in accordance with the invention having two radially distinct regions for providing varying relationships between stiffness and fracture resistance as well as eccentric loading of the flange by tangential corrugations.

Referring to FIG. 13, a spool 10 or reel 10 may include a flange 12 having panels 160 disposed interiorly (toward the wire or strand) or exteriorly, alternating therebetween, or in some designed pattern. In the embodiment of FIG. 13, the connecting walls 162 are all illustrated as viewable from the exterior as ribs 162. Nevertheless, the ribs 162 are only so displayed for the sake of clarity. As a practical matter, all of the combinations for recessing or raising individual panels 160 cannot be shown in a single figure. Accordingly, any of the panels 160 may be raised or recessed axially as desired. Thus, the ribs 162 may represent schematically the connecting walls 162 (e.g. 19) between adjacent panels 160. In the embodiment of FIG. 13, a core region 62 extends from a core 22 outward to a transition 60.

Between the transition 60 or transition region 60 and the rim 16, defined by a rim wall 13 extending circumferentially 48 and axially 46, stiffness, toughness, fracture resistance, fracture susceptibility, and the like may be traded off differently than in the core region 62. Accordingly, the rim region 64 may be designed to have very stiff, thin, fracture-susceptible walls. Thus, in a standard drop test (e.g. from workbench height) a portion of a flange 12 may be bent, crushed, or broken by axial, off-axis, or radial loads near the rim 16 in order to preserve the integrity of connections between the core 22 and the flange 12 in the core region 62.

Alternatively, the rim region 64 of the web 18 may be adapted to provided selected distortion and deflection to absorb the energy of impact, up to some pre-designed failure point at which fracture may be precipitated. Nevertheless, in the core region 62, flexibility, eccentricity, spring response, distortion, and the like as described with respect to other designs herein, may be appropriate.

The transition regions 60 may be defined by a medial rim 164. A medial rim 164 may be smooth, or somewhat abrupt, and may be analogous to the outer rim 16 of the flange 12. Accordingly, specific energy absorption mechanisms may be implemented near the medial rim 164 to mollify the transmission of radial loads toward the core 22 through the core region 62 of the flange 12.

The counter-running, connecting walls 162, tend to stiffen the flange substantially. Uniformly curved, connecting walls 162, all oriented in a single orientation and distributed circumferentially 48, may provide more flexibility, and less stiffness, both radially and in bending. The direction or sense of curvature of the connecting walls 162 in the rim region 164 and the connecting walls 135 in the core region 62 may be the same or opposite. Thus, either an inflected or a monotonic curvature or sense of curvature may be provided.

Figure 14:
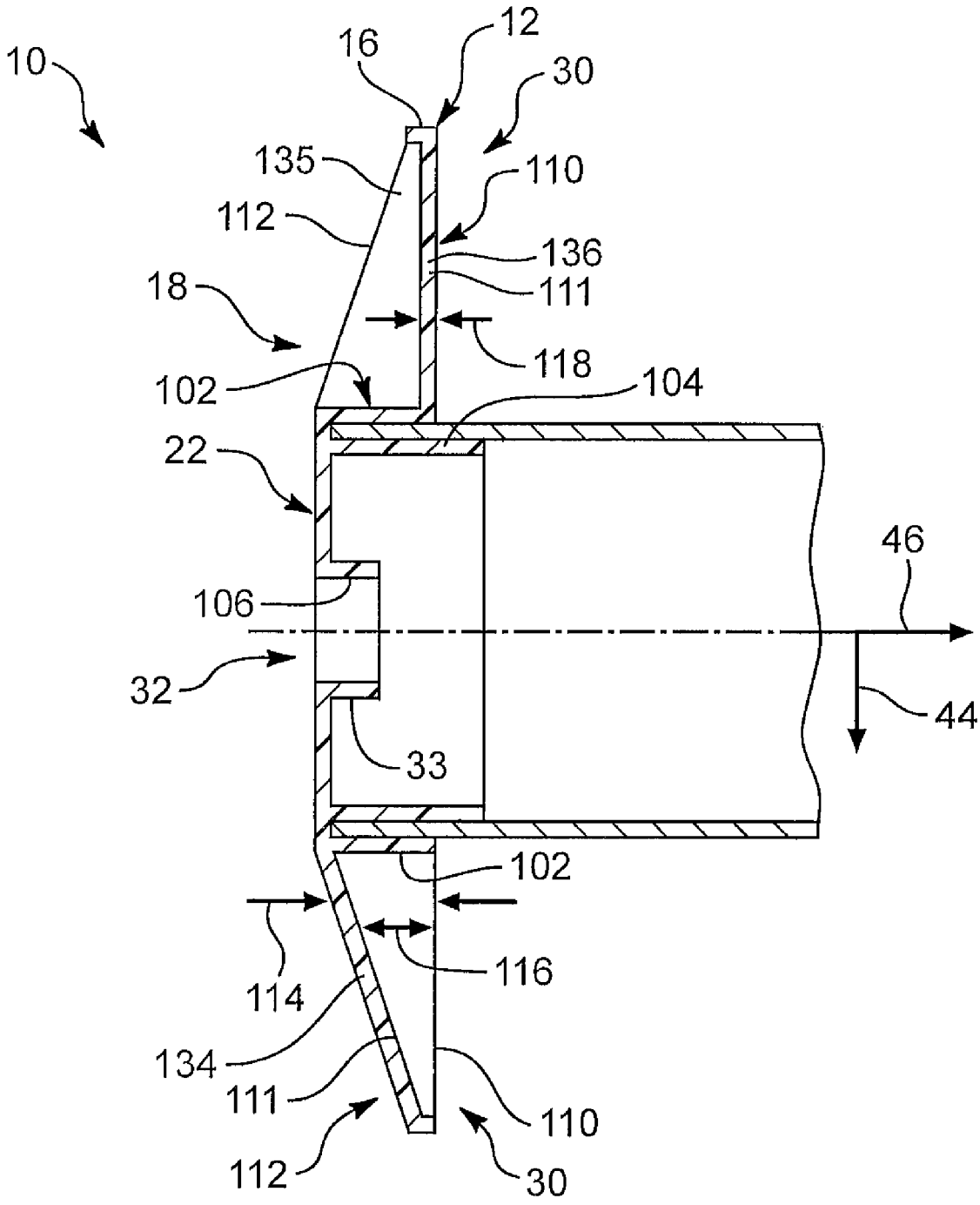
FIG. 14 is a side elevation, sectioned view of reel in accordance with the invention having a radially tapered corrugation and illustrating inner and outer faces thereof.

Referring to FIG. 14 a spool 10 or a reel 10 may be provided with tapered corrugations 30. The components of the apparatus of FIG. 14 correspond to those of FIG. 6, but show schematically a variable cavity depth 116 and flange thickness 114. The flange thickness 114 and cavity depth 116 vary with radial 44 position along the flange 12. Both outer corrugations 134 and inner corrugations 136 are illustrated in cross section. The larger size of the rim 16 may provide distributed or re-distribution of loads upon localized failure of the web 18 between the rim 16 and the core 22, as described above. Wider connecting walls 19, 135 may absorb more energy of distortion during and preceding fracture, thus protecting a wall 111 opposite one failing in bending.

Figure 15:
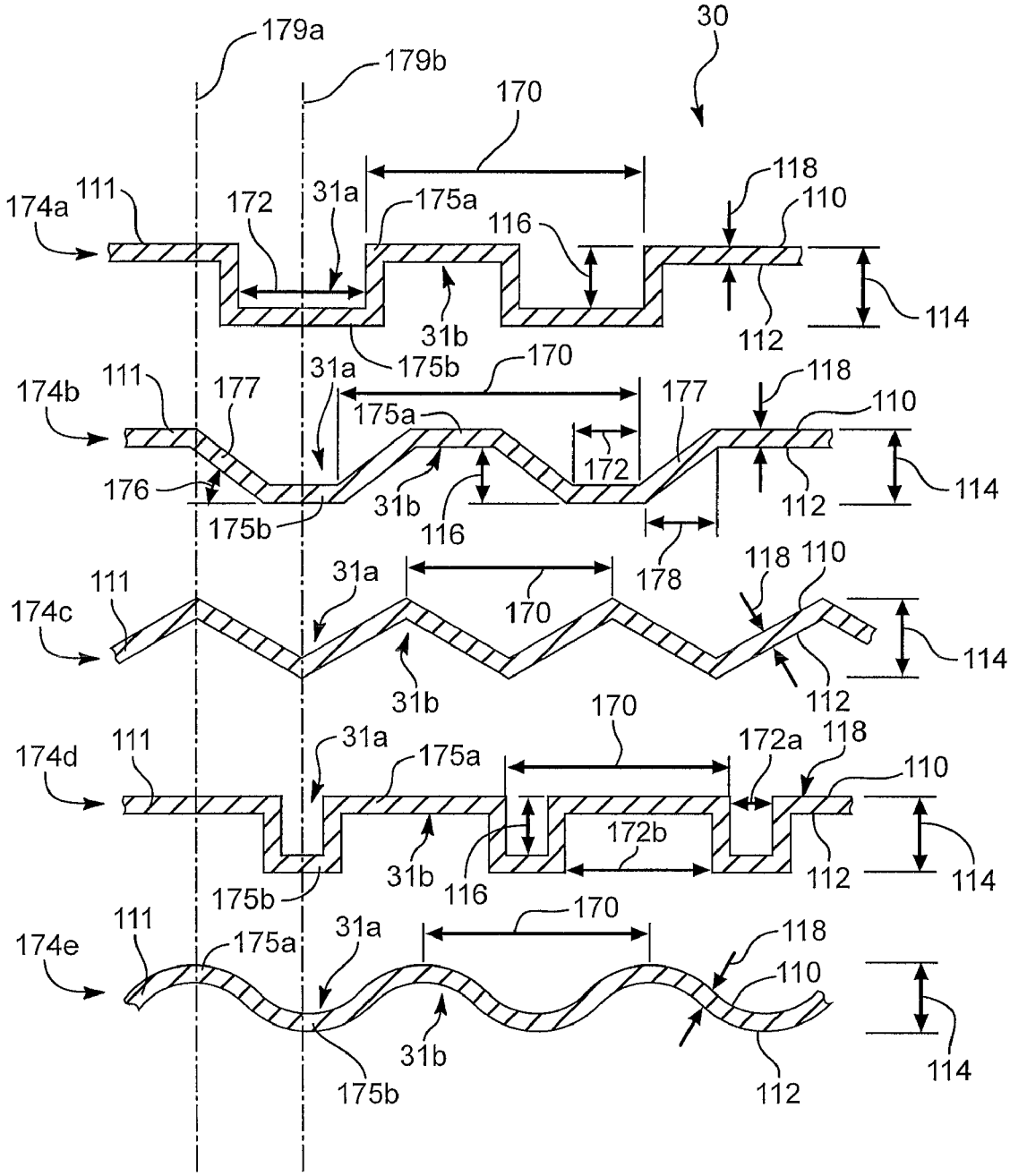
FIG. 15 is a schematic sectional view of a radial aspect of a flange in accordance with the invention, illustrating selected embodiments of corrugations.

Referring to FIG. 15. a cross-section of a flange 12, in accordance with FIG. 2 may illustrate various aspects of corrugations 30. For example, a wall 111 of a corrugation 30 may have a uniform or non-uniform pitch 170. Even with a uniform pitch 170, the circumferential span 172 within a cavity 31 of a corrugation 30 may be different for interior and exterior corrugations 30. For example, various patterns 174 (note, herein, that a trailing alphabetical character is simply a specific instance of the leading reference numeral that generically refers to all items of the same type or class) may have various aspect ratios of cavity depth 116 to width 172.

An aspect ratio may change dramatically as a cavity width 172 narrows near the core 22 and widens near the rim 16. By contrast, a cavity depth 116 may be more-or-less constant. However, a non-constant or non-uniform cavity depth 116 may be employed as illustrated in FIG. 14. Accordingly, the aspect ratio of a corrugation 30 may change dramatically from a rim having a comparatively large circumferential dimension 172 and the smallest axial dimension 116. Near the core 22, the circumferential dimension 172 will be minimized, while the axial cavity depth dimension 116 will be maximized.

The pattern 174*a* presumes a rectangular or perpendicular relationship between connecting walls 19 and the corresponding corrugation walls 175*a*, 175*b*. The description of a wall 111 as an inner wall 175*a* and an outer wall 175*b* is merely for convenience.

A trapezoidal pattern 174*b* may provide a circumferential span 172 in a cavity 31*a* interior (near the wire) that may or may not be of the same dimension when disposed exterior to the flange (away from the wire). Similarly, a cavity depth 116 may vary circumferentially according to an angle 176 at which a wall 111 extends to form a ramp 177 along a ramp span 178. The comparative proportion or aspect ratio of both the clear span 172 (clear circumferential span or open circumferential span 172) and the cavity depth 116 may be designed for a specific application.

Moreover, the aspect ratio of open spans 172 corresponding to exterior walls 175*b* and interior walls 175*a* of corrugations 30 may be selected to provide the various benefits defined herein. Thus, that aspect ratio need not be unity. Moreover, the aspect ratio of cavity depth 116 to clear span 172, or even to the total pitch 170 may be designed to promote structural integrity and energy absorption. Maximum cavity depth 116 may vary from one corrugation 30 to another 30. In one embodiment, the aspect ratio of cavity depth 116 to clear span 172 for a corrugation 30 corresponding to an exterior wall 175*b* may be of an order of magnitude of one or less. Meanwhile, the angle 176 may typically be adapted between 0 and 90 degrees accordingly. Likewise, the angle 176 will affect the span 178 associated with the ramp portion 177.

The pattern 174*c* may take on may of the attributes of the pattern 174*b*. Nevertheless, the pattern 174*c* may be seen as a degenerate form of the pattern 174*b*. The cavities 31 have collapsed (degenerate case) from trapezoids to triangles. Thus, one may compare the inside peak 179*a* corresponding to an interior wall 175*a* to the exterior or outside peak 179*b* corresponding to an interior wall 175*b* of a corrugation 30. Accordingly, a flange thickness 114 may still be defined for all of the patterns 174. Nevertheless, less surface area is presented to the stranded material in the design of the pattern 174*c*. Accordingly, stiff, stranded material, may be best adapted to the use of the flanges 12 of the pattern 174*c*.

The pattern 174*d* may be thought of as a non-uniform aspect ratio of the interior cavities 31*a* to exterior cavities 31*b* corresponding to exterior corrugation walls 175*b* and interior corrugation walls 175*a*, respectively. Thus, the span 172*a* divided by the span 172*b* may provide a circumferential aspect ratio for non-uniform corrugations 30. Likewise, uniform corrugations 30 may have a circumferential aspect ratio of one. That is, at any given radius 131 from a center 50, the circumferential aspect ratio is one for a uniformly distributed arrangement of corrugations 30 extending substantially radially. Again, the aspect ratio of cavity depth 116 to span 172*a*, as well as the aspect ratio of cavity depth 116 to the exterior or outer span 172*b* may be designed as described hereinabove.

The pattern 174*e* may be sinusoidal or otherwise curved and inflected as desired. Many of burdens and benefits of the pattern 174*e* correspond to the pattern 174*c*. As a practical matter, the pattern 174*d*, if modified slightly to permit a draft angle (for molding) less radical than the ramp 177 of the pattern 174*b*, may provide an excellent combination of flexure, toughness, stiffness, energy absorption, spring response or resilience and so forth for a flange design.

Figure 16:
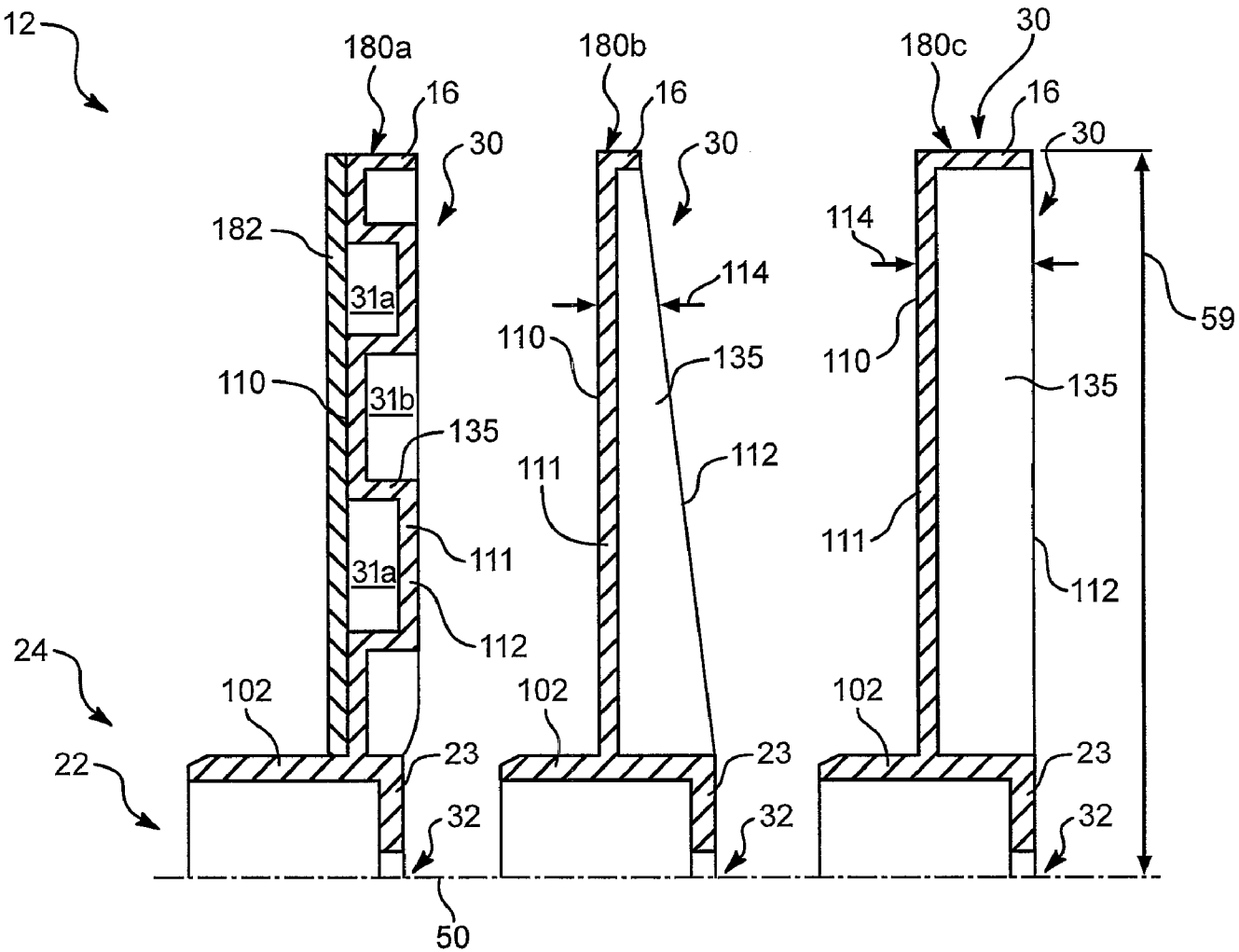
FIG. 16 is a schematic sectional view of one half of a radial surface of a flange in accordance with the invention, including spiral and circumferential corrugations, tapered corrugations, and corrugations of constant axial dimension.

Referring to FIG. 16, various configurations of flanges 12 are illustrated. In general, each flange extends from a center line 50 a distance 59 or a radius 59 to the outer extremity of a rim 16. The pattern 180*a* reflects a cross-section cut, radially through half a flange 12. The pattern 180*a* may reflect the design of FIG. 3, FIG. 7, FIG. 9, or FIG. 11, in selected embodiments. That is, the walls 111 may extend to provide interior cavities and exterior cavities 31*b*. Thus, the corrugations 30 may extend circumferentially, exclusively, or circumferentially and radially as illustrated in FIGS. 1-14. A liner 182 may be provided as illustrated in the liner 120 of FIG. 7.

The periodicity of the cavities 31*a*, 31*b* in a radial direction 44 may be governed by the frequency or circumferential pitch 170 of a directorix 70 defining corrugations 30, regularly or irregularly, about the circumference 48 of a flange 12. Accordingly a liner 182 of paper, or of some other material may be provided to promote or support stranded materials against bulging into the interior cavities 31*a*.

The pattern 180*b* illustrates a tapered corrugation 30. The corrugations 30 may be tapered regardless of which pattern 174 (see FIG. 15) is used. Similarly, the pattern 180*c* of FIG. 16 corresponds to a uniform corrugation thickness 114.

Figure 17:
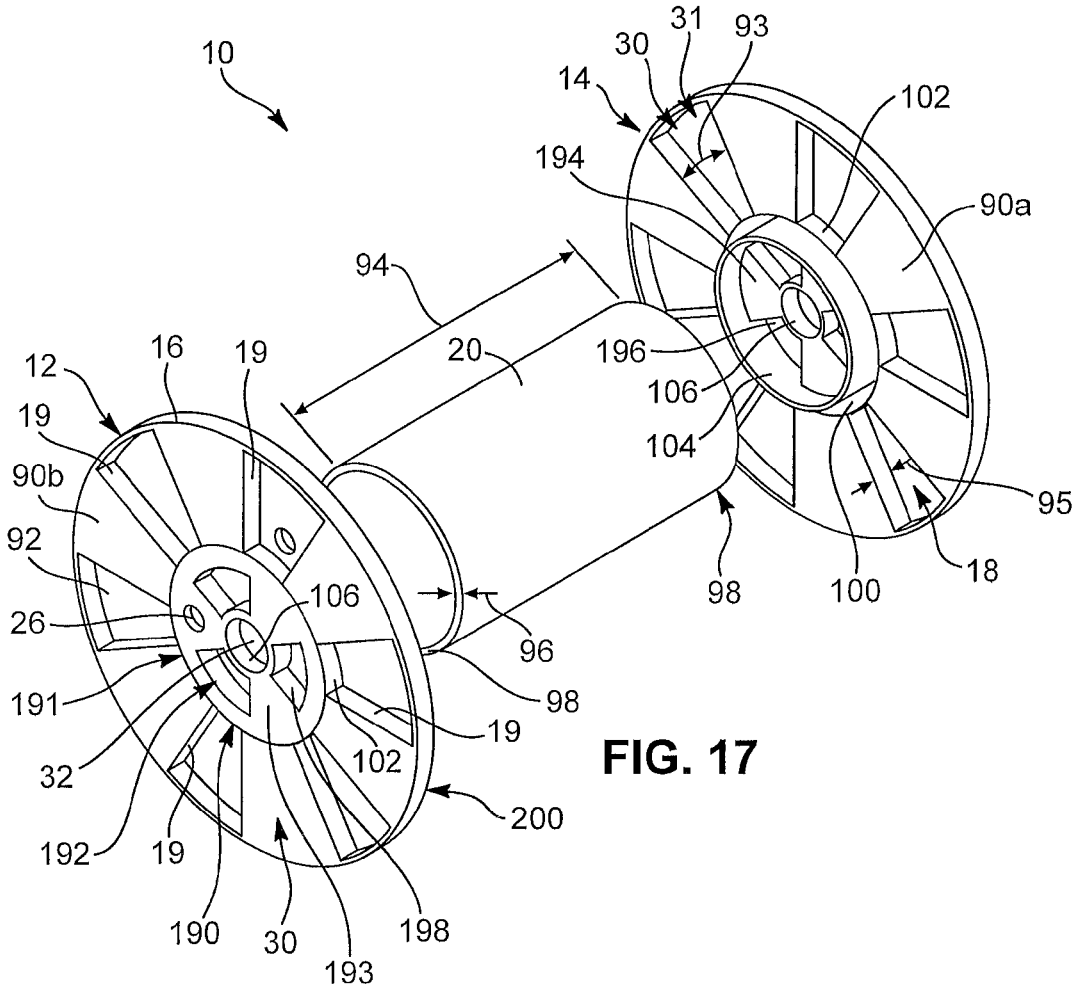
FIG. 17 is a perspective, exploded view of one alternative embodiment of a corrugated reel in accordance with the invention.
Figure 18:
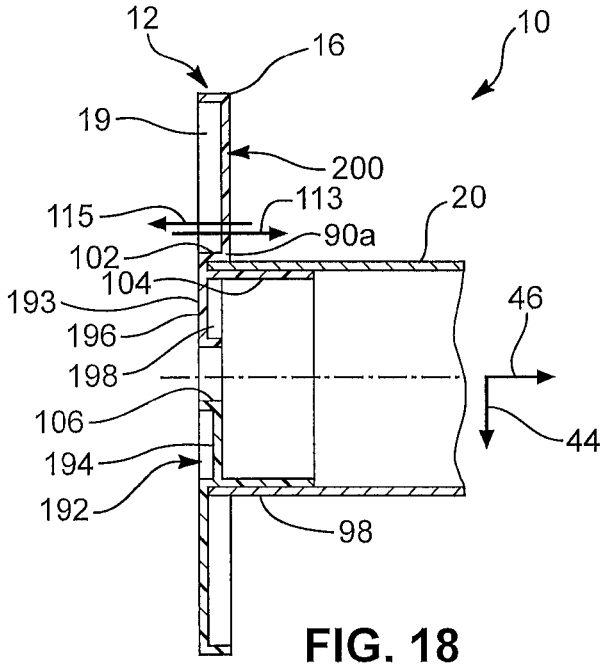
FIG. 18 is a side elevation view of a flange and tube assembly for the apparatus of FIG. 17.

Referring to FIGS. 17-18, the tube 20 may secure two flanges 12, 14 in which selected portions may be corrugated. For example, in the embodiment of FIGS. 17-18, the core 190 is itself corrugated. The core 190 may be corrugated synchronously with respect to corrugations 30 located outside (radially) of the core 190. Thus, a recess 192 or cavity 192 corresponding to the core 190 may be juxtaposed radially across a region engaging the tube 20 from a recess 31 corresponding to the corrugation 30 of the outer region 200. The core 190 may thus be synchronous, having the recesses 192 of the corrugation 191 aligned with, almost as if a continuation of, the recess 31 of a corresponding corrugation 30 in circumferential phase therewith.

In the embodiment illustrated, a wall 198 connects the web 194 corresponding to the recess 192, to the web 196 corresponding to the outer surface 193. In general, however, a corrugation 191 may have any effective cross-section. Thus, an undulating sinusoidal combination of recesses (defined by the inside web 194 or recessed web 194, with respect to a viewer) and an outside web 196 need not be so angularly defined.

A sinusoidal shape has a position or displacement along a surface that is continuous. Moreover, a first derivative of that displacement is continuous. However, the first derivative of a rectangular corrugation is discontinuous. Thus, one may speak of the inside web 194 as the portion below or axially away from a viewer, and the outside web 196 as the portion of the sinusoidal shape that is closer to a viewer.

In a sinusoidal embodiment, one may think of the webs 194, 196 as being those portions that are closest to a tangent perpendicular to an axis 46 of flange 12. The wall 198 may be considered as the location where a tangent would be approximately or most nearly parallel to an axis 46 of the flange 12.

Figure 19:
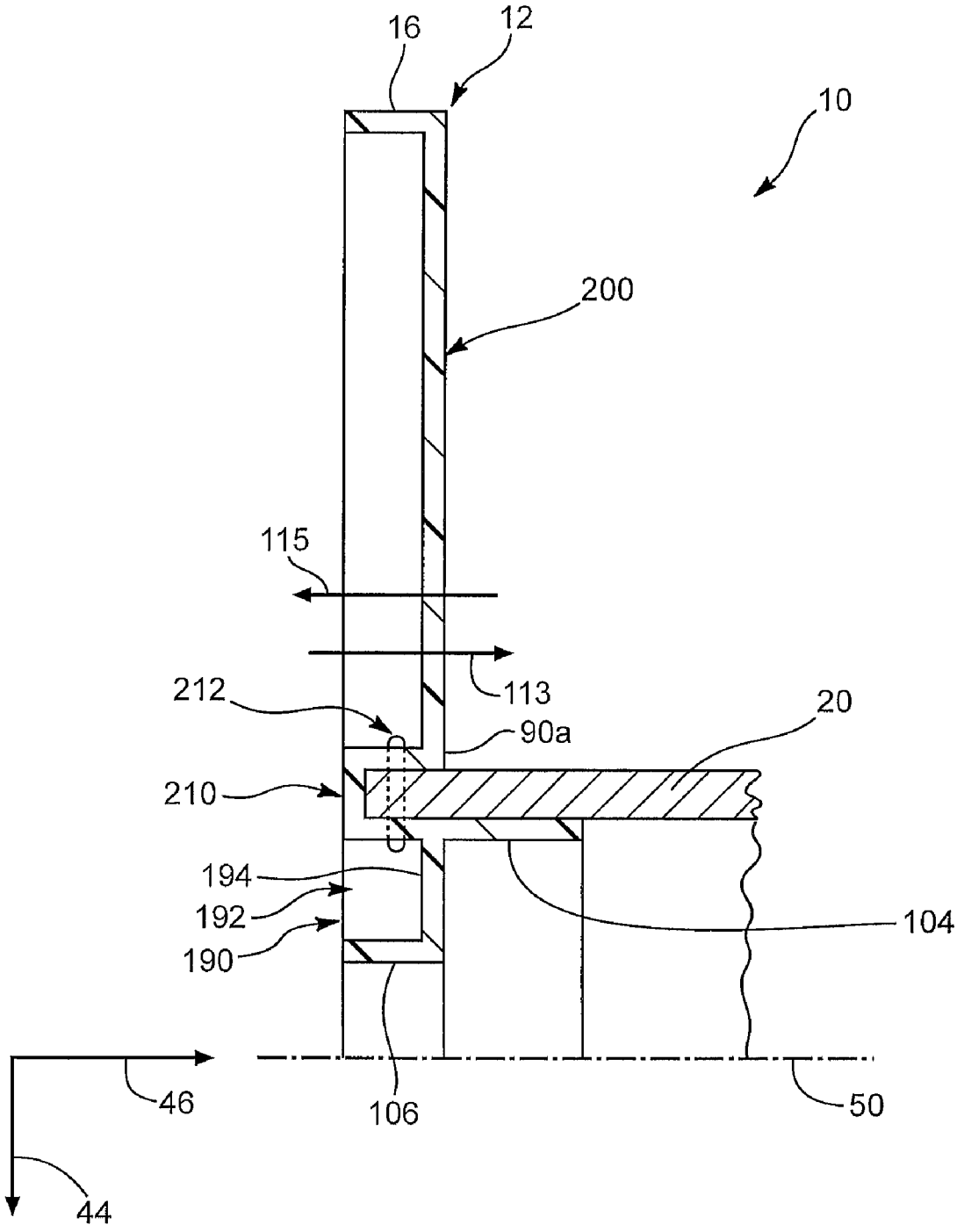
FIG. 19 is a partial, cut-away, side, elevation, cross-sectional view of one embodiment of the apparatus of FIG. 17, configured to promote the use of a folded staple fastening mechanism.
Figure 20:
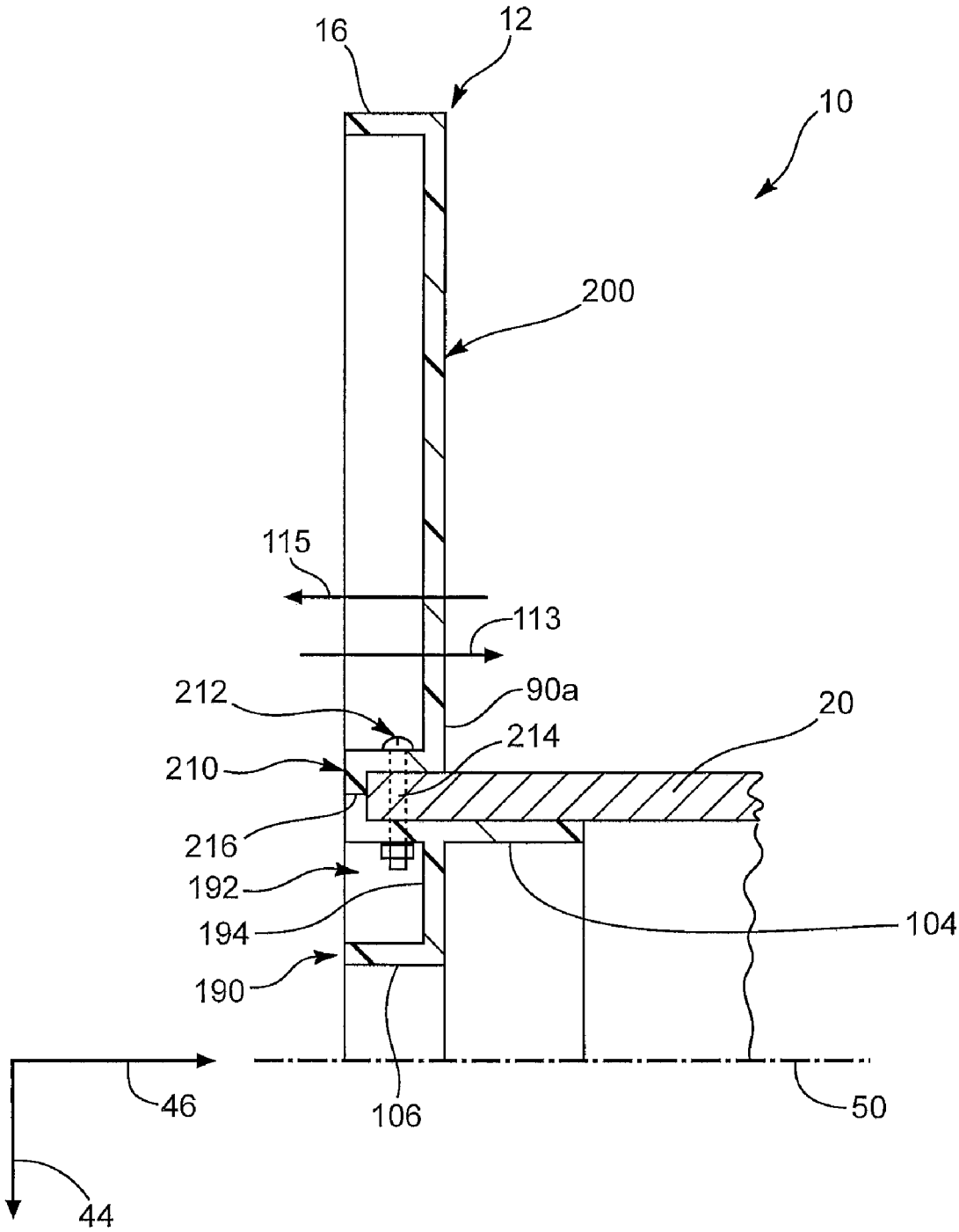
FIG. 20 is a partial, cut-away, side, elevation, cross-sectional view of one embodiment of the apparatus of FIG. 17, configured to promote the use of a bolt.

Referring to FIGS. 19-20, a core 190 and an outer region 200 of a flange 12 may be synchronous, and thus provide an alignment region 210. In an alignment region 210, access is available on both sides of a tube 20 (e.g. wall thereof) in order to position a fastener 212 therethrough. In the embodiment of FIG. 19, the fastener 212 is a staple, and the embodiment of FIG. 20 illustrates a bolt. A screw, a rivet, or other fastener as described herein may be suitably engaged to secure the tube 20 to the flange 12. Moreover, the fastener 212 may be installed by a double-pronged device in which the fastener 212 can be accessed on either or both sides of the wall of the tube 20. In this manner, a rivet or staple 212 is a possible fastener.

In general, access is only needed from either the cavity 192 of the corrugation of the core 190, or from the cavity 31 of the corrugation 30 of the outer region 200. Such an access would result in a tacking approach. For example, a screw, a staple that is not folded, or the like might be used in such a situation. However, in order to fasten a bolt 214 or fold a staple 212, access from both cavities 31, 192 may be provided by fabricating the flange 12 with synchronous corrugations 30, 191 in order to provide the region of alignment 210.

Referring to FIG. 20, the concept of synchronizing or leaving unsynchronized (asynchronous) the core 190 and the outer region 200 may be implemented in fabrication of the flange 12, as a single piece, (e.g. homogeneously molded), or by fabricating the flange 12 from distinct pieces 190, 200. For example, if the core 190 is distinct, divided from the outer portion 200 by a parting line 216, then the fastener 212 effectively assembles or fastens the core 190 to the outer portion 200. Accordingly, the core 190 may be rotated to be synchronous or asynchronous with respect to the corrugation recesses 31,192.

Figure 21:
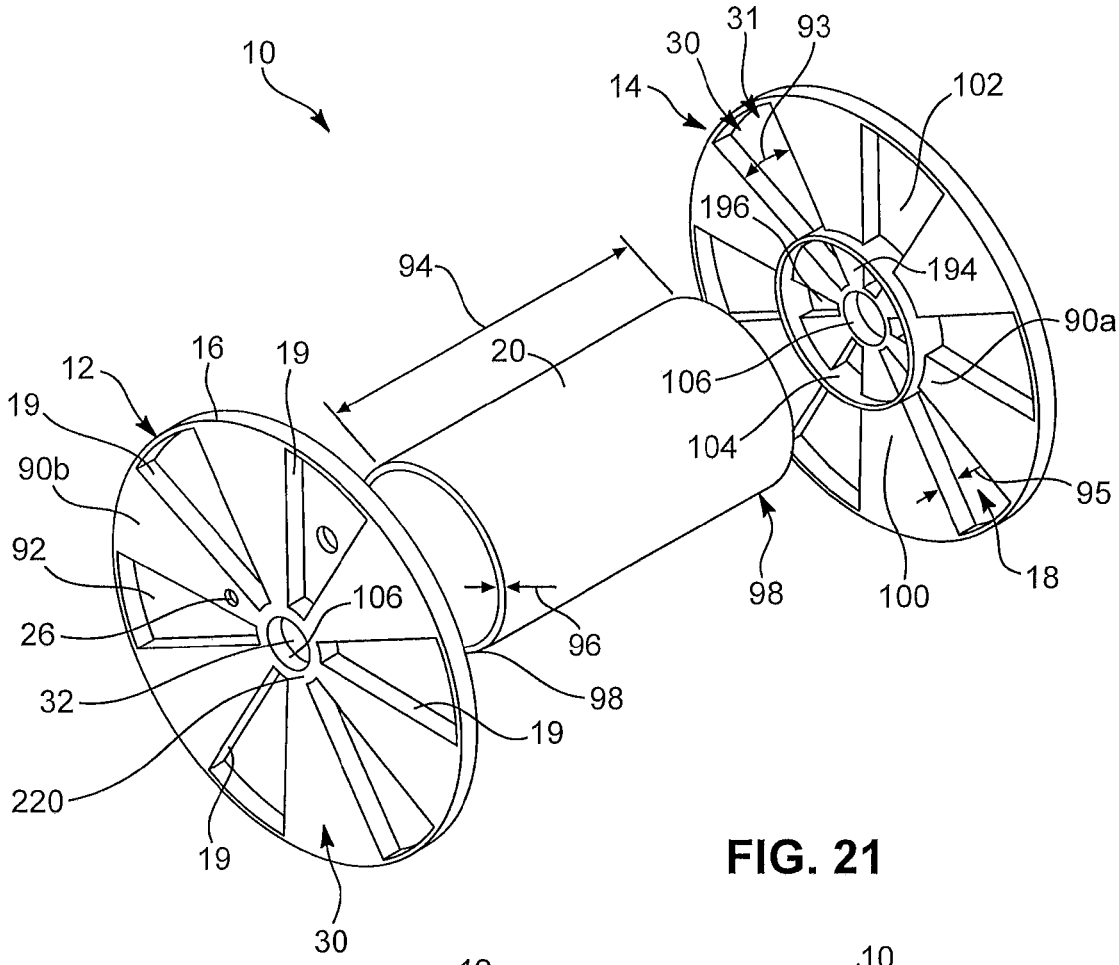
FIG. 21 is a perspective, exploded view of one alternative embodiment of a corrugated reel in accordance with the invention.
Figure 22:
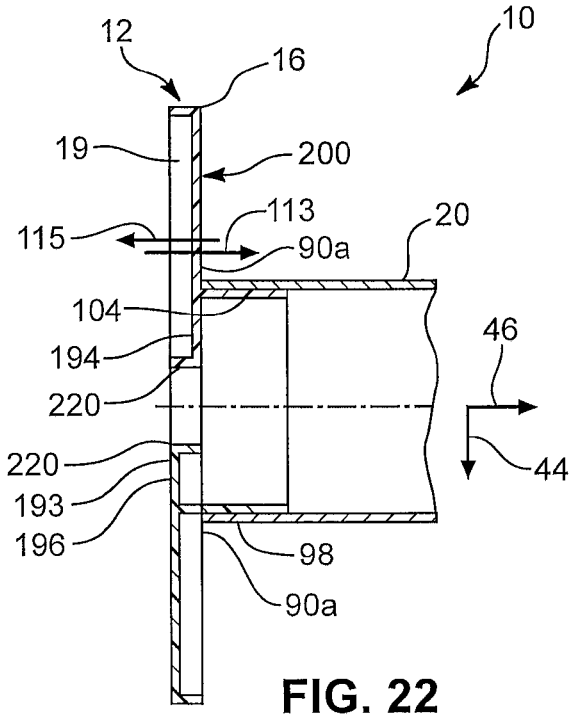
FIG. 22 is a side elevation view of a flange and tube assembly for the apparatus of FIG. 21.

Referring to FIGS. 21-22, one embodiment of a flange 12 in accordance with the invention may effectively appear to have no core 190 when viewed from certain directions. For example, from "outside" the reel 10, the outer surfaces 90*b*, corresponding to corrugations 30 having cavities 31 or recesses 31 of the flanges 12, 14 appear to extend from an arbor hole 32 out to the rim 16 or edge 16. The rim 16 may actually be a strengthened portion of a flange 12, or simply the outermost portion of an outer diameter of a single sheet of material. Thus, the corrugations 30 may extend from the arbor hole 32 radially outward to the edge 16 or a rim 16. Any of the cross-sections discussed herein may be used.

The sleeve 104 may be configured to extend axially from the flange 12 to be received within the tube 20, or to receive the tube 20 therewithin. Thus, the tube 20 may abut the flange face 90*a* or surface 90*a* or may penetrate the face 90*a* to extend toward or beyond the outer face 90*b*. Thus, the sleeve 104 need not extend axially inward between the flanges 12, 14, beyond an inner face 90*a*.

Figure 23:
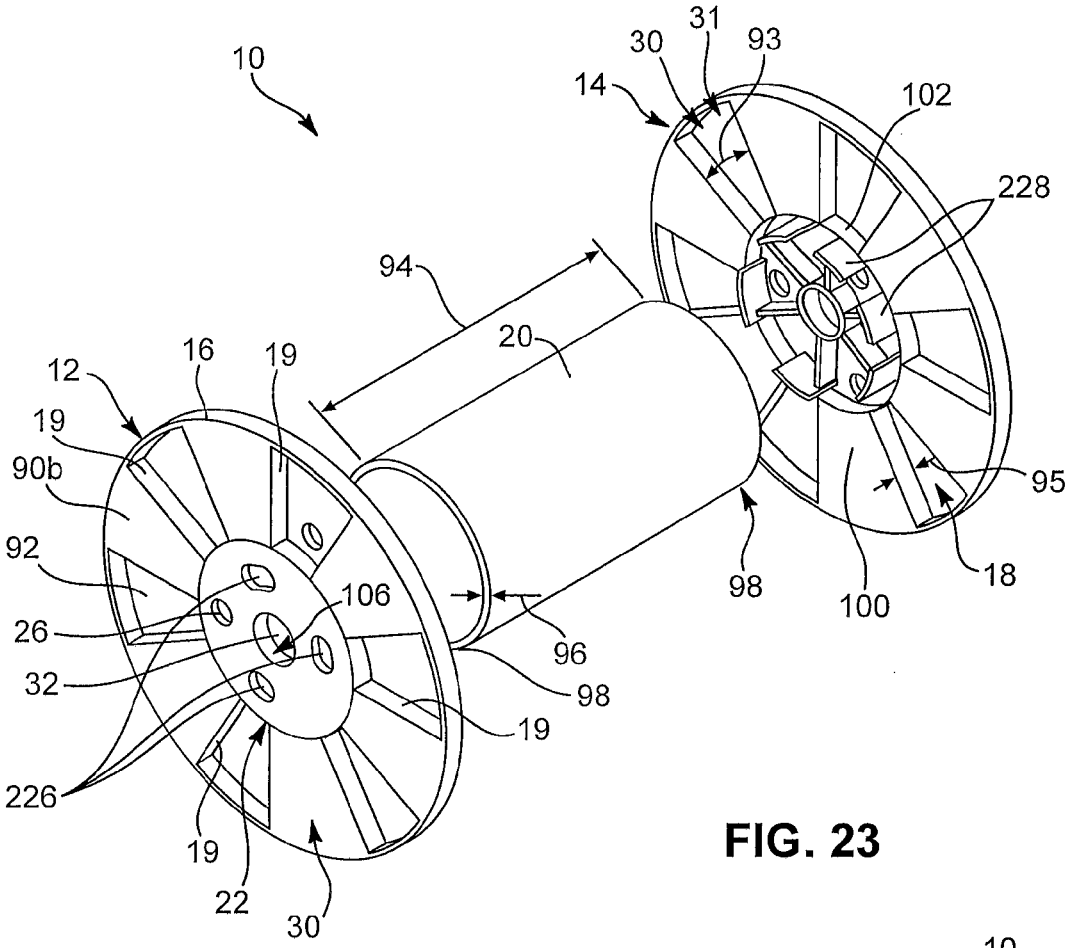
FIG. 23 is a perspective, exploded view of one alternative embodiment of a corrugated reel in accordance with the invention.
Figure 24:
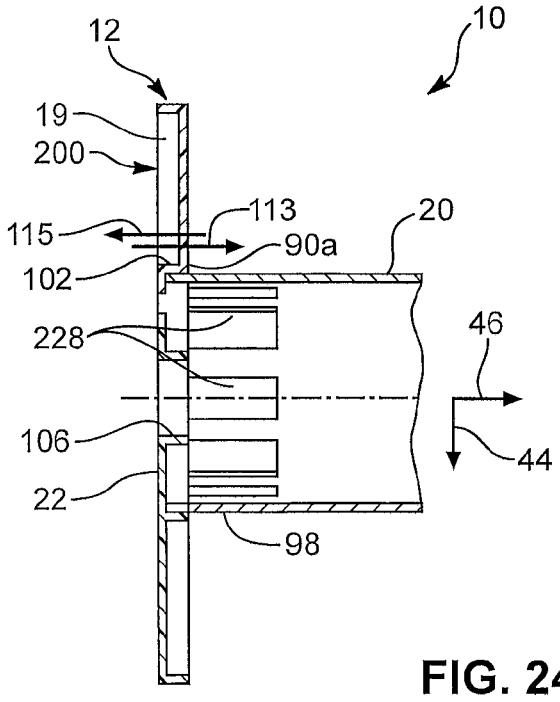
FIG. 24 is a side elevation view of a flange and tube assembly for the apparatus of FIG. 23.

Referring to FIGS. 23-24, in one alternative embodiment of an apparatus in accordance with the invention, the core 22 need not be corrugated. That is, the core 22 need not be a corrugated core 190. Rather, the core 22 may be perforated to provided apertures 226 positioned circumferentially to be radially opposite the recesses 31 of the corrugations 30. In this embodiment, two tools such as drivers or wrenches, or a double-prong tool, such as a stapler, riveter, or the like, will be able to access space both inside and outside a tube 20, in order to fasten the tube 20 securely with respect to the flange 12.

In certain embodiments, a manufacturer may rely on one or more sleeves 104. Sleeves provide relief for hoop stress. Hoop stresses arise due to loads inside or outside of a continuous sleeve 104. However, due to the improved fastening methods and the increased number and types of fastening methods available in producing an apparatus in accordance with the invention, sleeves 104 are not required. Instead, discontinuous tabs 228 can be affirmatively fastened to the tube 20.

The tabs 228 may extend from one flange 12 toward another flange 14, or may extend from a flange 12 away from a flange 14. Fasteners capable of carrying a tensile load along their principal axes can now be used. The tabs 228 may be bound to the tube 20 with radially oriented tensile forces in a fastener 212. Thus, in addition to holding a shearing load acting in an axial direction 46, the fastener may now also support a tensile load within an axis (acting radially with respect to the flange 12) of the fastener 212 itself.

Noteworthy features of the discontinuous tab 228 design include the lack of hoop stress support, which was provided by the sleeve 104. All hoop stresses imposed, whether compressive or tensile, in the tube 20 are supported only by the tube 20. With appropriate tolerances, the tabs 228 may resist compressive forces inducing hoop stress on the tube 20. However, since the tabs 228 are highly compliant in bending by comparison with a closed tube 20, which must act according to hoop stress theory, the tabs 228 primarily orient the tube 20 and secure it against axial 46 loads and are not primarily responsible for handling hoop stresses. No transfer of loads between tabs 228 is possible, without some intervening element such as a corrugation wall 198, or the tube 20 itself.

Thus, provided with apertures 226, the core 22 may provide access for a double-prong tool for fastening, even if corrugations are not required for structural reasons. The provision of tabs 228 provides locations suitable for applying penetrating fasteners or other fasteners (glue, welding, bonding, etc.).

Figure 25:
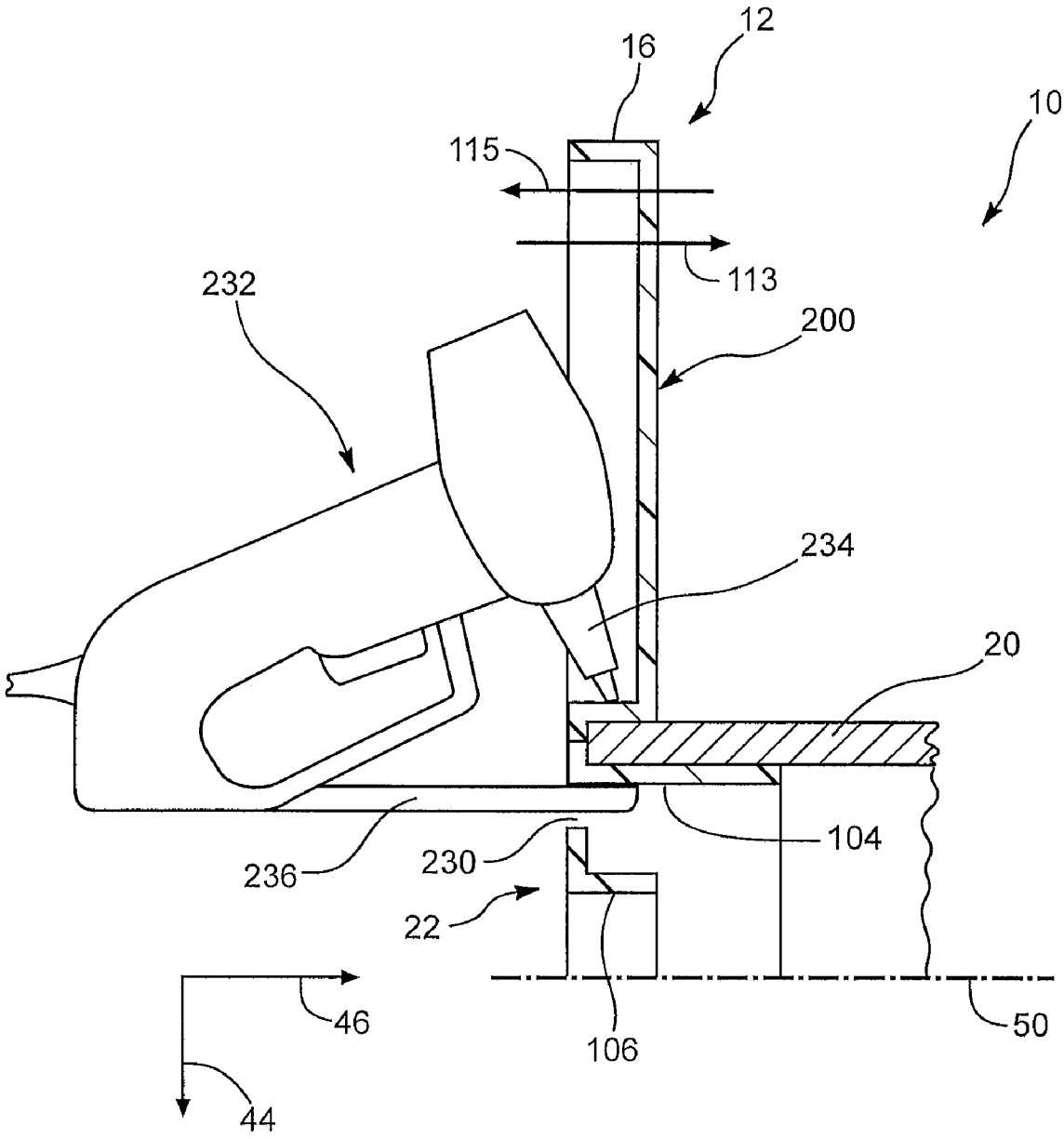
FIG. 25 is a partially cut-away, side, elevation, cross-sectional view of one alternative embodiment for a flange in the apparatus of FIG. 23, illustrating a method for fastening using two tools or a two-prong tool such as a stapler.

Referring to FIG. 25, a stapler 232 may be configured to have one or more prongs 234, 236. In the illustrated embodiment the active prong 234 comprises a head 234 or other apparatus for dispensing a fastener 212. Meanwhile, an opposing prong 236 provides an anvil 236 for receiving the fastener 212 and folding the fastener over. Accordingly, an aperture 30, or the synchronous corrugations 30, 191 of an alignment region 210, in the core 22 provides access for the anvil prong 236. Otherwise, the single prong 234 or head 234 of the stapler 232 renders the stapler 232 a mere tacker.

Other fastening devises may be similarly operable. For example, the two prongs 234, 236 in other tools may represent a screwdriver and a wrench, or a wrench and another wrench. Various types of drivers having different head shapes may be suited to different types of fasteners. The prongs 234, 236 may be wrenches, screwdrivers, other types of shaped drivers, or the like, necessary to operate at both extrema of any particular choice of fastener 212.

Figure 26:
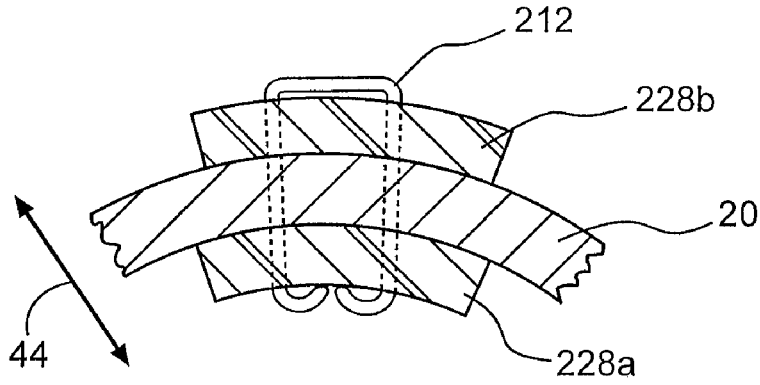
FIGS. 26-28 are end, cross-sectional views of cut-away portions of alternative embodiments of a flange suitable for use in the apparatus of FIGS. 17, 21, and 23, relying on molded tab portions associated with a flange, in order to secure a tubular member thereto in various orientations.
Figure 27:
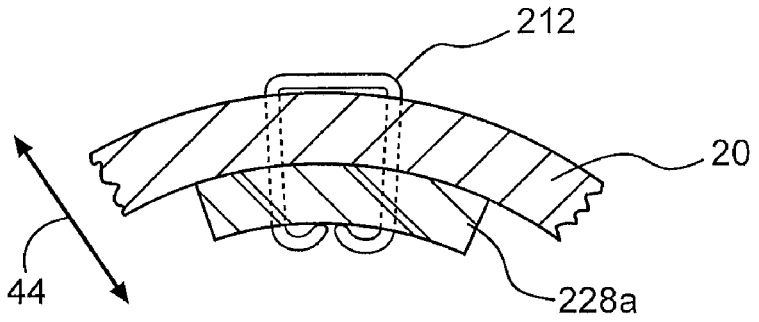
Figure 28:
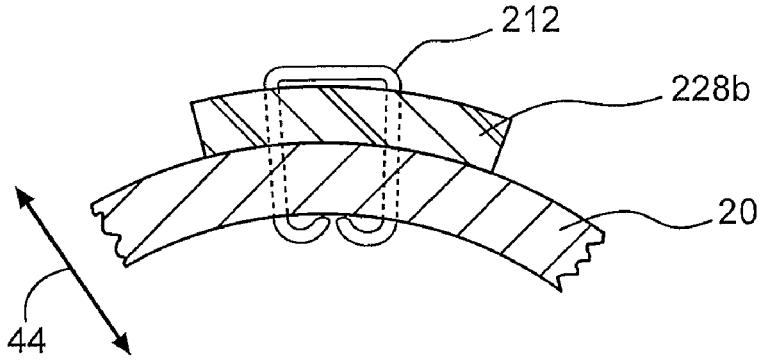

Referring to FIGS. 26-28, a tube 20 may be fastened to a tab 228 by a fastener 212. The fastener 212 may extend radially 44 through the tab 228 first, or through the tube 20 first. In certain embodiments, tabs 228*a*, 228*b* may flank a tube 20, and thus support both extrema of the fastener 212. In other embodiments, the tube 20 may be radially 44 outboard of the tab 228*a*, or may be positioned in board radially 44 with respect to the tab 228*b*. If the tube 20 is inboard of the tab 228*b*, then the tab 228*b* may preferably extend from a flange 12, 14 away from the opposing flange 14, 12, respectively.

Figure 29:
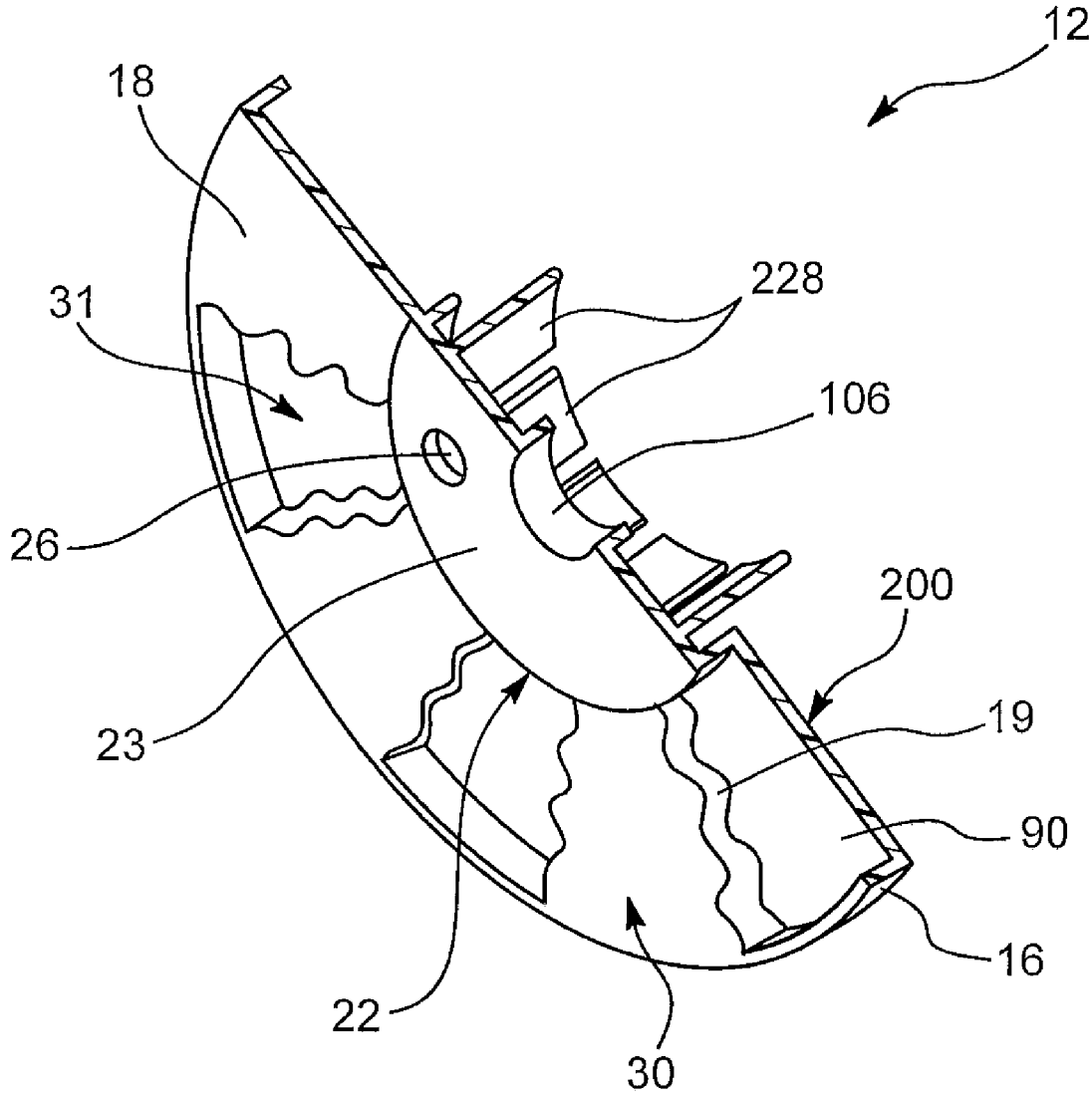
FIG. 29 is a cut-away perspective view of a portion of one embodiment of a flange in accordance with the invention, including multi-dimensional corrugations.
Figure 30:
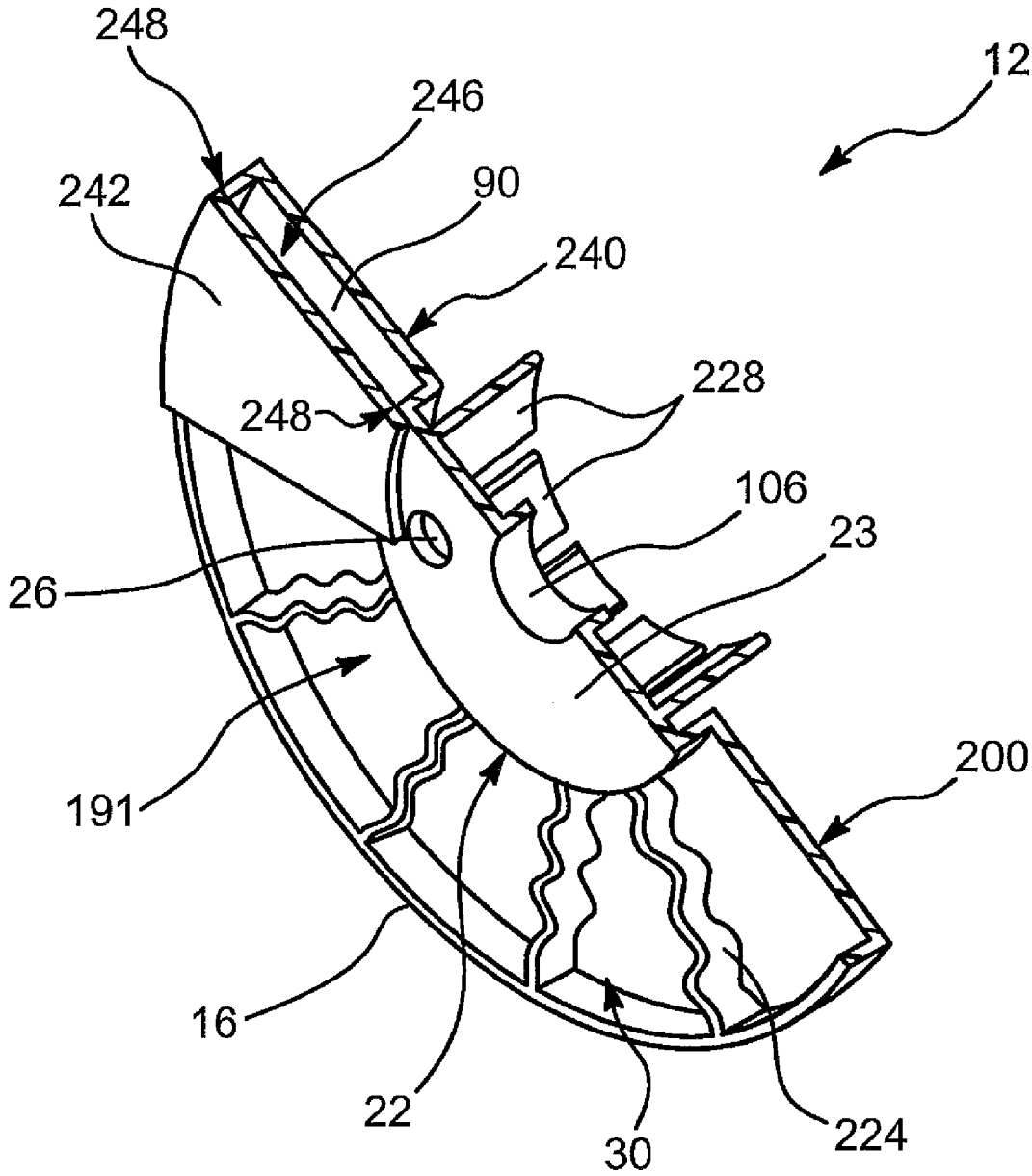
FIG. 30 is a partially cut-away, cross-sectioned, perspective view of an alternative embodiment of undulating ribs in one embodiment of a flange, also illustrating an alternative or optional closure on a flange base.

Referring to FIGS. 29-30, other options in corrugating flanges 12 may include corrugating in multiple dimensions. For example, in the embodiment of FIG. 29, corrugations 30 have side walls 19 that are themselves undulating or otherwise varying in circumferential displacement along any radial path. The corrugation walls 19 may be configured in any suitable shape. Sinusoidal shapes, rectangular, angular, acute angular, obtuse angular, trapezoidal, and the like may be suitable configurations. Moreover, the wall 19 need not extend at right angles with respect to a surface 90. The side walls 19 may be applied to any corrugation shape discussed herein.

One of the benefits of the process of corrugating the sidewall 19 is the possibility of enhancing selective breakage and distortion in order to render the entire reel 10 more survivable. That is, catastrophic failure wherein the flange 12 separates from the tube 20 or wherein the flange 12 breaks, separating the core 22 from the outer region 200, or wherein the tube 20 breaks, releasing its containment of the stranded material held thereon. Catastrophic failure is to be avoided. Distorted, damaged, chipped, partially fractured, and other conditions of flanges 12,14 may leave a flange highly serviceable, so long as the tube can exert radial force on the core 22, 190, and so long as the outer portion 200 may exert axial restraint on the stranded material.

In certain embodiments, ribs 244 may actually be corrugated in multiple dimensions. A flange 12 may effectively provide recesses 191 flanked in a circumferential direction by adjacent ribs 244. The adjacent ribs 244 are corrugated in any suitable shape, whether sinusoidal, circular, curved, angular, and so forth as described with respect to the embodiment of FIG. 29.

The embodiment of FIG. 30 may necessarily provide less stiffness in certain orientations. Nevertheless, the flange 12 of FIG. 30 may be modified in certain embodiments to render a base 240, fastenable to a closure 242 thereof as a second piece for stiffening and bonding. Thus, the closure 242 may bond to the base 240, boxing in the ribs 244, and producing significantly more stiffness. Since maximum stress is located at the outermost fiber of any structure in bending, the base 240 and closure 242 provide members suitable for supporting the bending loads experienced by the flange 12.

A cavity 246 between the base 240 and the closure 242 renders the recess 191*a* completely closed box. Contact regions 248 may include the core 22, and specifically the cap portion 23, bonded or otherwise secured to the closure 242. Likewise, the edge 16 may provide a suitable contact region 248 for the base 240 and the closure 242. The ribs 244 may be bonded to the closure 242, or may be left free. One advantage of leaving the ribs 244 non-bonded to the closure 242, may be to reduce stiffness that might otherwise provide catastrophic failure. The ability of the ribs 244 to move independently from the closure 242 may increase controlled, limited fracture to selectively absorb a certain amount of drop energy in order to effectively maintain the dimensions and serviceability of a flange 12.

Referring to FIGS. 31-39, the twin sheet concept may be considered as an optional alternative to the embodiment of FIG. 30 and may be implemented in numerous configurations. In general, a base 240 may be formed in any suitable shape. A closure 242 may be formed in any complementary shape.

The cavities 246 resulting from the fastening, securing, bonding, or otherwise positioning the base 240 and closure 242 together, may be completely empty, or may be provided a rib 244 parallel to the plane of cross-section illustrated. Such a rib 244 may be angled at any suitable angle, but may preferably be designed to completely fill the cavity 246, extending to the closure 242. In this way, additional stiffness may be selectively added as appropriate in any given design.

In general, each base 240 may secure to a closure 242 over several suitable contact regions 248. A fastener may extend through the base 240 and closure 242, or a bonding method may be implemented. For example, glue, solvent, welding, contact pressure, melting, rivets, screws, bolts, staples, or other fastening means may be effective to secure the closure 242 structurally to the base 240.

Figure 31:
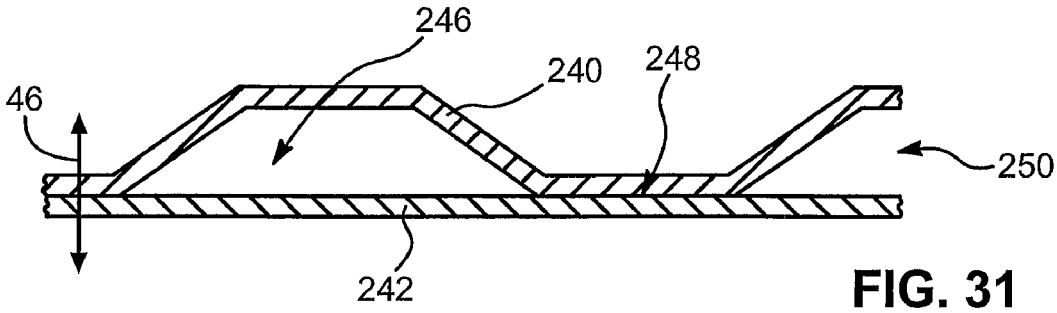
FIGS. 31-38 illustrate alternative embodiments of twin sheet constructions relying on a base and closure to form a flange in at least two pieces, in which the corrugations may run in any combination of radial or circumferential directions.
Figure 32:
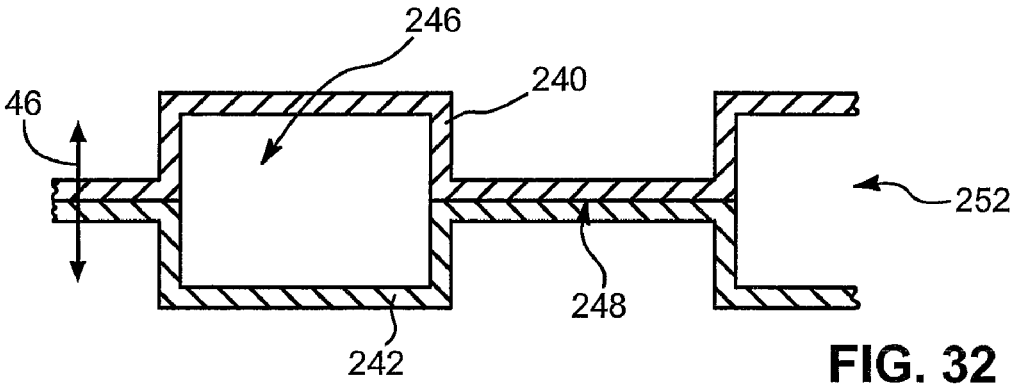

Referring to FIG. 31, while continuing to refer generally to FIGS. 31-39, the wall 250 may be suitable for use in the corrugated core 190, the outer region 200, both, or for the entire region extending between an arbor aperture 32 and the edge 16. In general, the cross-section illustrated may be regarded as either a circumferential or radial view (line of sight of a viewer), with differing results. That is, increased stiffness is typically expected when the cross-sections illustrated (see FIGS. 31-39) is normal to a radius of the flange 12.

In certain embodiments, the wall 252 may be both rectangular in cross-section, and symmetric in construction. That is, the base 240 and the closure 242 may have matching, mirror-image structures providing contact regions 248, and enclosed cavities 246.

Figure 33:
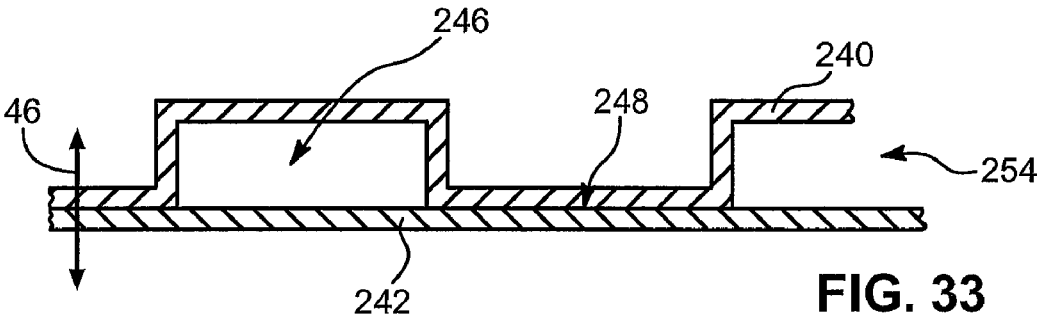

Referring to FIG. 33, a non-symmetric wall 254 relies on a rectangular cross-section for the base 240, is secured to the closure 242 in a contact region 248 to form a wall 254 of increased stiffness. The dimensions of the base 240 and closure 242 in each of the embodiments illustrated herein may be selected to provide the precise stiffness and strength desired. Accordingly, wall thicknesses, specific dimensions of corrugations, and the overall width of the wall 250-272 may be selected to optimize the use of materials, the overall weight, the structural strength, and the ability to selectively fail in a particular region of a flange 12 in order to preserve the overall integrity of a reel 10 containing a strand of material.

Figure 34:
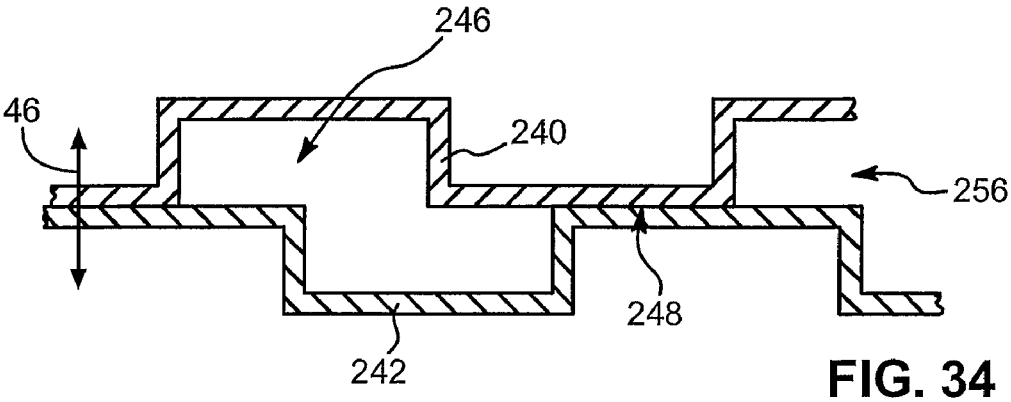

Referring to FIG. 34, a wall 256 may be offset or counter-symmetric. That is, the wall 240 and the closure 242 may be identical. According to certain embodiments described herein, the base 240 and the closure 242 may have a certain right-handedness or left-handedness. Accordingly, even if not offset in a circumferential direction, the base 240 and closure 242 may not be mirror images of one another, rather, they may be identical, and have a right or left handed orientation, resulting in a counter-symmetric arrangement.

In certain embodiments, the wall 256 may be viewed as having two parts 240, 242 which in the region of the outer portion 200, or in the region of the core 190, or in the region from the arbor aperture 32 out to the edge 16 of the flange 12, may be mirror images of one another. Nevertheless, by rotating about an axis 50 of the flange 12, the base 240 and closure 242 become somewhat offset from one another. Thus, certain flexibility and certain stiffness considerations may be balanced against one another as compared to a symmetric wall 252, or non-symmetric wall 254.

Figure 35:
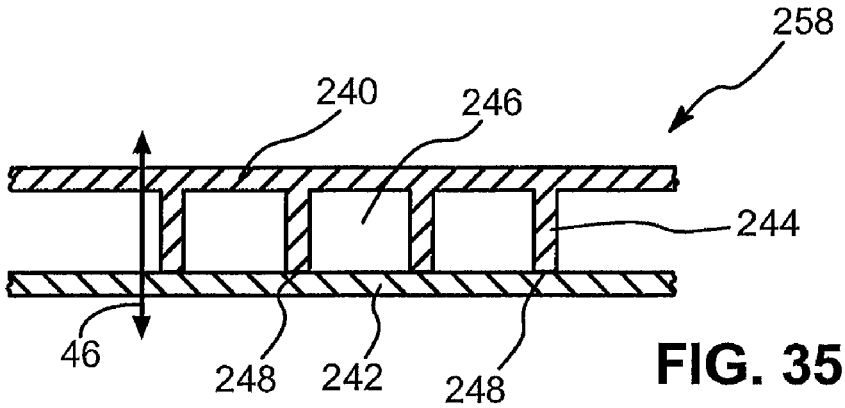

Referring to FIG. 35, a wall 258 may be constructed to provide a base 240 having ribs 244 producing cavities 246, which may or may not be filled with cross ribs 244 for extending substantially parallel to the cross-sectional plane of the wall 258 illustrated. In general, a closure 242 may have contact regions 248 associated with each rib 244, and with other selected points of contact in the flange 12.

Figure 36:
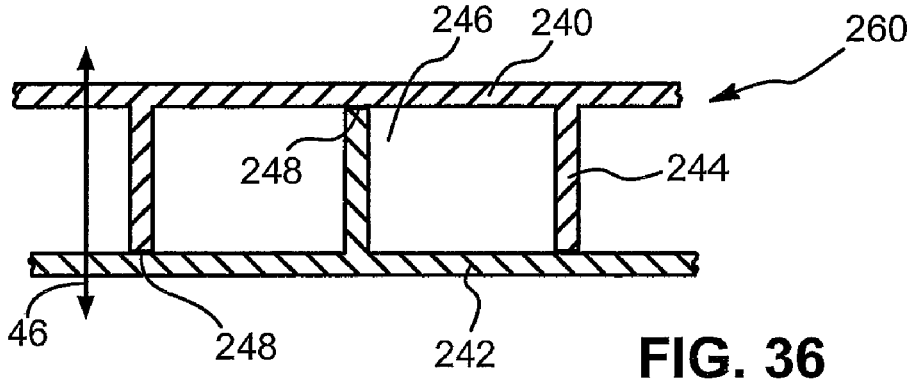

Referring to FIG. 36, in an alternative embodiment, a wall 260 may be provided with symmetric or counter symmetric construction. That is, the base 240 and the closure 242 may each be provided with ribs 244 and contact regions 248 between respective ribs 244 and the opposing part 242,240. Thus, the parts 240,242 may actually be identical to one another or may be symmetric with respect to one another, or may be made in a suitable arrangement for interleaving, so to speak, the ribs 244 of the base 240 and the closure 242.

Figure 37:
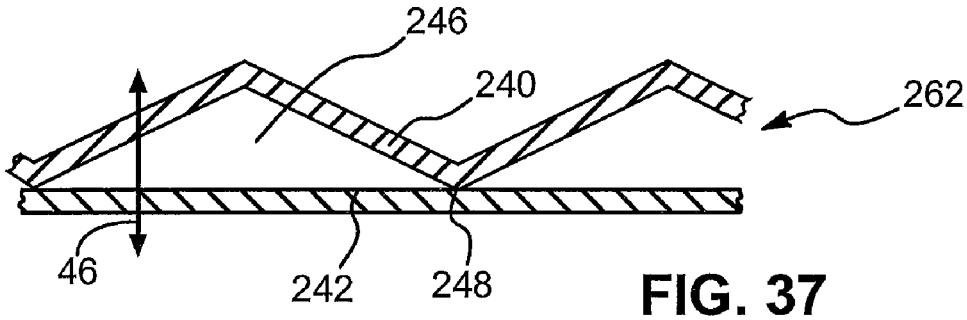

Referring to FIG. 37, in one alternative embodiment, a triangular cross-section in a wall 262 may include non-symmetric portions, a base 240 and a closure 242. The contact region 248 may be large or small, and may include an elongation of contacting vertices in order to preclude overly sharp angles or limited sizes of contact regions 248. In certain embodiments, two bases 240, or a closure 242 similar to a base 240 may be configured to produce a diamond shape. Nevertheless, in most applications of reels 10, the desire for a flat surface along an inside face 90 of a flange 12 militates in favor of a substantially flat surface 90, or a surface that is sufficiently small in void fraction that stranded materials do not bulge into a recess 31 of a corrugation 30 in the outer region 200.

Figure 38:
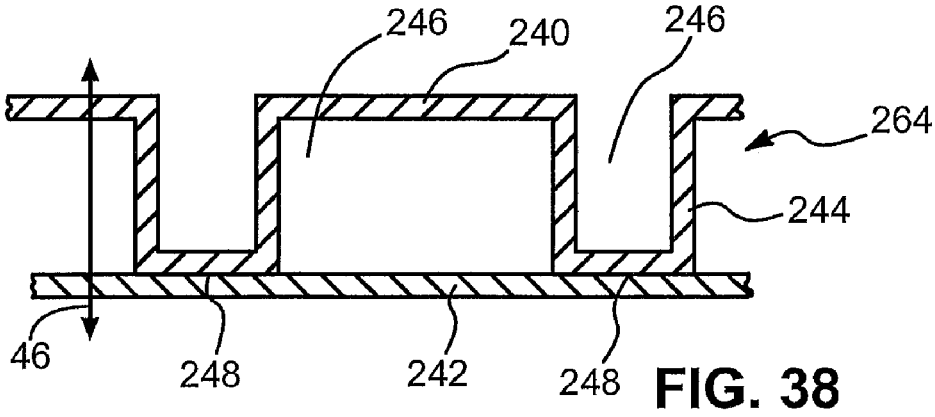

Referring to FIG. 38, a wall 264 provides a construction illustrating both a closure 242 that can be completely filled in, as well as a wall 240, which may serve as a closure 242 having a very small void fraction. Thus, the uneven distribution of the cavities 246 on alternating sides of the base 240 minimizes the opportunity for a stranded material to bulge into the cavity 246, while still providing substantial stiffness.

Figure 39:
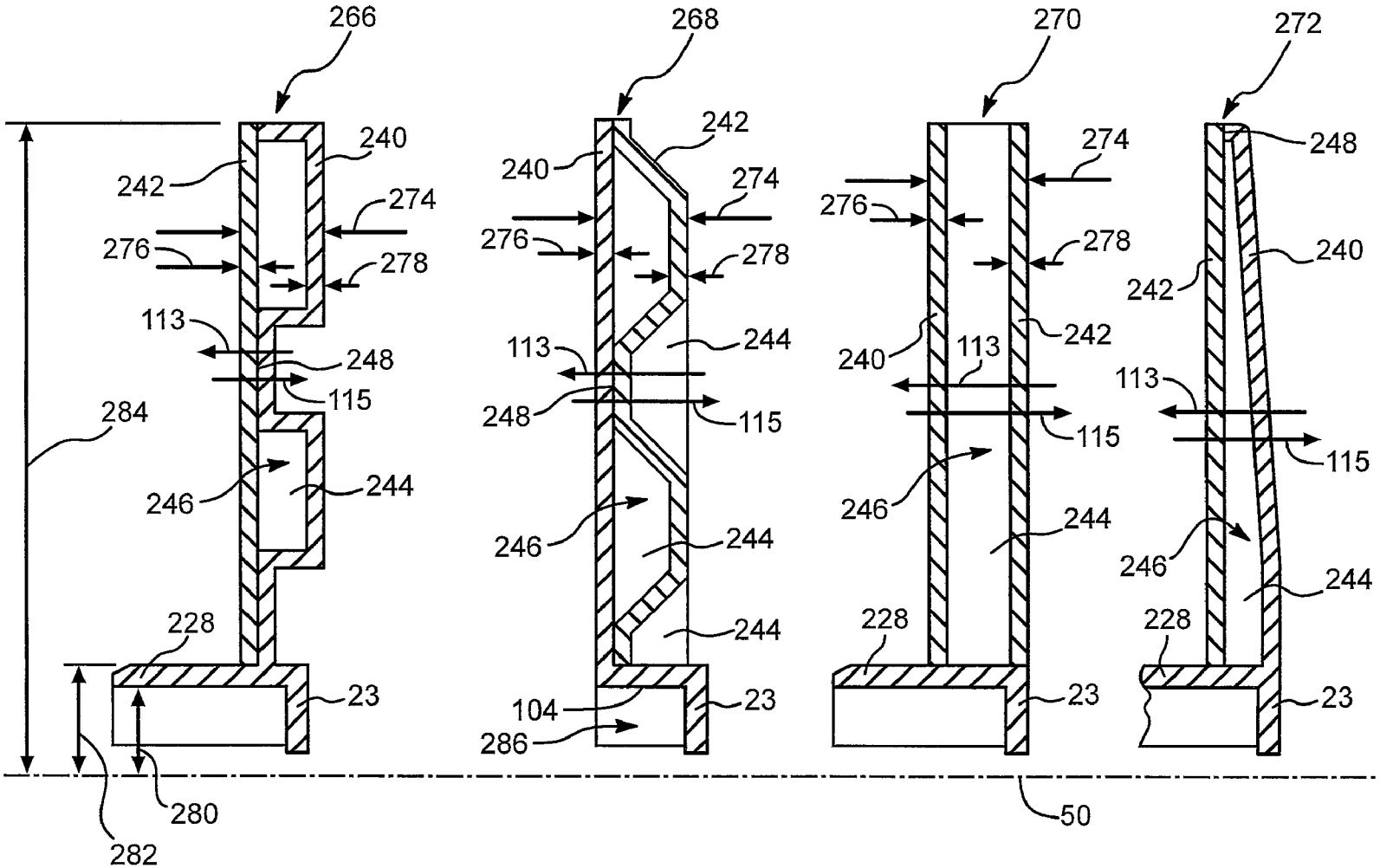
FIG. 39 is a comparison of alternative embodiments of flanges incorporating various twin sheet construction concepts.

Referring to FIG. 39, a comparison of alternative embodiments of reels 266, 268, 270, 272 or walls 266, 268, 270, 272 of reels 10 illustrates orientations that may be relied upon. FIGS. 32-38 represent radial views of cross-sections (viewer looking along a radius of a reel 10), whereas the views of FIG. 39 are circumferential views. Accordingly, spiral corrugations as described hereinabove, may be implemented according to the embodiments of FIG. 39. Furthermore, cross-sections at specific radii that do not vary may be alternative embodiments for which the cross-sections of FIG. 39 are suitable.

The wall 266 has a rectangular cross-section from a circumferential view. Similarly, the cavity 246 may include a rib 244 substantially parallel to the cross-section illustrated. However, such a rib 244 can help according to the extent of its particular filling or bracing across the cavity 246, and may be angled at any suitable angle in any of three dimensions, in order to provide the right balance of manufacturability, stiffness, strength, and selective fracture or distortion in order to protect the integrity of the reel 10.

The wall 268 illustrates a trapezoidal construction with an optional rib 244, which may be deleted in certain embodiments. In the embodiments shown, the tab 228 may be replaced with a recess 286 such that the tube 20 will penetrate the flange 12, rather than vice versa. In this embodiment, the optional rib 244 provides additional stiffness since bending moments applied to the wall 268 may reveal weak spots in the contact regions 248.

In the wall 270, the base 240 and the closure 242 are parallel. That is, the base 240 and closure 242 extend radially parallel to one another. Alternatively, in the wall 272, the base 240 tapers as it extends in a radial direction 44 away from the axis 50 to minimize the space in the cavity 246 or the weight of the rib 244, if the cavity 246 is filled with an optional rib 244 at periodic locations. One may note that the base 240 may be configured to occupy the space of the closure 242, and a closure 242 may be constructed to occupy the place of the base 240. Nevertheless, in general, a flat surface is desired for supporting the stranded material on a reel 10.

Some of the parameters available for varying the structural stiffness, strength, weight, and over all performance, as well as the resistance to distortion may rely on altering the geometries of the walls 266-272. For example, a wall thickness 274 may be varied by selecting a size for corrugations 30, 192 and recesses 31, 192 that will maximize spacing distance, in order to maximize stiffness. Alternatively, a balance may be achieved, in which a wall thickness 274 and the thickness 276 of the base 240, along with the thickness 278 of the closure 242 may be balanced against one another to provide a combination of weight, stiffness, and strength in tension, bending, compression, and buckling.

Similarly, the inner radius 280, outer radius 282 and flange radius 284 may be selected to balance the strength of the tabs 228 against the strength of the overall wall 250-272 in view of the strength of a tube 20, and the fasteners 212. Other parameters that may be considered are the size of fastened contact regions 248. The degree or extent of bonding or fastening may be provided in order to allow the base 240 to separate selectively from part of the closure 242, thus absorbing impact energy and preventing catastrophic failure.

Various plastic molding techniques may produce flanges in accordance with the invention. These techniques may include blow molding, injection molding, vacuum forming, roto-molding, and fabrication from various shapes of stock including sheet stock, pressing, die stamping, and the like. Conventional molding techniques lack the regions of closed cross-section wherein a base layer 240 may be secured by a suitable method such as bonding to a closure layer 242 over an extensive contact region in order to make corrugated, closed cross-sections as contemplated for the invention.

Individual layers 240, 242 may formed by any method individually, and later assembled. Alternatively, in selected processes, such as blow molding and roto-molding, care must be exercised in the spacing of the mold in the contact region. That is, in conventional molding, the distances required for the extensive lengths of a contact region may compromise structural integrity if left at conventional sizes. Accordingly, a mold may be fashioned having suitable dimensions to support the proper structural integrity over extended lengths and widths of contact regions 248 during molding. These distances may typically not be distances used conventionally for the molding techniques identified.

From the above discussion, it will be appreciated that the present invention provides a method and apparatus for balancing strength, stiffness, fracture, and toughness in reels and spools, incorporating material properties. Accordingly, corrugations may be adapted to several configurations and a design process calculated to protect stranded materials contained on a spool or reel.

Cost of material, molding speeds, and the like may all be affected as desired by selection of specific design criteria in accordance with the invention. Spools and reels from small unitary sizes on the order of inches or smaller may be produced according to the invention. Likewise, reels of substantial size for supporting large amounts of heavy materials such as wire, cable, wire rope, and the like may be designed in sizes having an order of magnitude on the order of feet.

The present invention may be embodied in other specific forms without departing from its basic structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes coming within the meaning and range of equivalency of the claims are to be embraced within their scope.

What is claimed and desired to be secured by United States Letters Patent is:

1. An apparatus for receiving, storing, and dispensing a stranded material, the apparatus comprising:

a tubular member having an axial direction and a radial direction, configured to receive a stranded material wrapped therearound; and a first flange configured to engage the tubular member and comprising a core portion, having an arbor aperture therein and configured to support the apparatus on an arbor through the arbor aperture, and an outer portion extending radially away from the core portion to an outer edge and configured to restrain the stranded material in an axial direction, the core portion being corrugated to comprise a plurality of wedge-shaped web portions, each wedge-shaped web portion of the plurality of wedge-shaped web portions being offset axially from each of its two adjacent wedge-shaped web portions of the plurality of wedge-shaped web portions, and each wedge-shaped web portion of the plurality of wedge-shaped web portions being dimensionally of the same order of magnitude as each of its two adjacent wedge-shaped web portions of the plurality of wedge-shaped web portions.

2. The apparatus of claim 1, wherein the core portion further comprises a plurality of connecting walls, each connecting wall of the plurality of connecting walls being configured to extend between two adjacent outside and recessed web portions of the plurality of web portions.

3. The apparatus of claim 1, further comprising a second flange configured to engage the tubular member, the tubular member further configured to secure to the first and second flanges to support an axial tensile force therebetween.

4. The apparatus of claim 1, wherein the outer portion is substantially flat.

5. The apparatus of claim 4, wherein the outer portion further comprises a raised rim.

6. An apparatus for receiving, storing, and dispensing a stranded material, the apparatus comprising:

a tubular member having an axial direction and a radial direction, configured to receive a stranded material wrapped therearound; and a first flange configured tubular member and comprising a core portion, having an arbor aperture therein and configured to support the apparatus on an arbor through the arbor aperture, and an outer portion extending radially away from the core portion to an outer edge and configured to restrain the stranded material in an axial direction, the core portion being corrugated to comprise a plurality of wedge-shaped web portions, and each wedge-shaped web portion of the plurality of wedge-shaped web portions being offset axially from adjacent wedge-shaped web portions of the plurality of wedge-shaped web portions, wherein the first flange further comprises a base, having corrugations, and a closure, and wherein the closure is configured to stiffen the first flange by creating a closed cross-section in corrugations of the base.

7. An apparatus for receiving, storing, and dispensing a stranded material, the apparatus comprising:

a tubular member having an axial direction and a radial direction, configured to receive a stranded material wrapped therearound; and a first flange configured to engage the tubular member and comprising a core portion, having an arbor aperture therein and configured to support the apparatus on an arbor through the arbor aperture, and an outer portion extending radially away from the core portion to an outer edge and configured to restrain the stranded material in an axial direction, the core portion being corrugated to comprise a plurality of web portions, and each web portion of the plurality of web portions being offset axially from adjacent web portions of the plurality of web portions, wherein the outer portion is ribbed and the outer portion ribs are further configured to have a plurality of corrugations alternatingly displaced in a circumferential direction along a radial path.

8. An apparatus for receiving, storing, and dispensing a stranded material, the apparatus comprising:

a tubular member having an axial direction and a radial direction, configured to receive a stranded material wrapped therearound; and a first flange configured to engage the tubular member and comprising a core portion, having an arbor aperture therein and configured to support the apparatus on an arbor through the arbor aperture, and an outer portion extending radially away from the core portion to an outer edge and configured to restrain the stranded material in an axial direction, the core portion being corrugated to comprise a first plurality of wedge-shaped web portions, each wedge-shaped web portion of the first plurality of wedge-shaped web portions being offset axially from adjacent wedge-shaped web portions of the first plurality of wedge-shaped web portions, and the outer portion being corrugated to comprise a second plurality of wedge-shaped web portions, each wedge-shaped web portion of the second plurality of wedge-shaped web portions being offset axially from adjacent wedge-shaped web portions of the second plurality of wedge-shaped web portions, wherein the first plurality of web-shaped web portions is radially displaced from the second plurality of web-shaped web portions and the first plurality of web-shaped web portions is separated from the second plurality of web-shaped web portions by an annular sleeve or by a plurality of tabs forming a discontinuous annular ring.

9. The apparatus of claim 8, wherein the corrugations of the corrugated outer portion are synchronous with the corrugated core portion.

10. The apparatus of claim 8, wherein the corrugations of the corrugated outer portion are separated from the corrugations of the core portion by a slot formed for receipt of a radial end of the tubular member.

11. The apparatus of claim 10, wherein the corrugations of the corrugated outer portion are radially aligned with the corrugations of the corrugated core portion, such that each outside web portion of the outer portion corrugations is juxtaposed with an outside web portion of the core portion corrugations.

* * * * *